US006438347B2

(12) United States Patent
Nittani et al.

(10) Patent No.: US 6,438,347 B2
(45) **Date of Patent: *Aug. 20, 2002**

(54) DEVELOPING DEVICE FEATURING A CONTROL MEMBER HAVING A CENTER PORTION WIDTH WIDER THAN END PORTIONS WIDTH IN A LONGITUDINAL DIRECTION THEREOF FOR CONTROLLING DEVELOPER THICKNESS AND METHOD FOR USING SAME

(75) Inventors: Susumu Nittani, Shizuoka-ken; Kanji Yokomori, Odawara; Shigeo Miyabe, Numazu; Tachio Kawai, Odawara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/276,971

(22) Filed: Mar. 26, 1999

(30) Foreign Application Priority Data

Mar. 30, 1998 (JP) ..... 10-103421

(51) Int. Cl.[7] ..... G03G 15/08

(52) U.S. Cl. ..... 399/284; 399/274; 399/350; 399/351

(58) Field of Search ..... 399/284, 274, 399/350, 351, 174

(56) References Cited

U.S. PATENT DOCUMENTS

| | | | | |
|---|---|---|---|---|
| 4,334,766 A | * | 6/1982 | Sugiyama et al. | 399/351 |
| 5,895,150 A | * | 4/1999 | Watabe et al. | 399/284 |

FOREIGN PATENT DOCUMENTS

| | | | |
|---|---|---|---|
| JP | 8-114078 | * | 7/1983 |
| JP | 5-150631 | * | 6/1993 |
| JP | 6-27799 | * | 2/1994 |
| JP | 7-160116 | * | 6/1995 |
| JP | 9-222791 | * | 8/1997 |

* cited by examiner

*Primary Examiner*—Quana M. Grainger
(74) *Attorney, Agent, or Firm*—Fitzpatrick, Cella, Harper & Scinto

(57) ABSTRACT

In a developing device, a developer carrier carries developer and a control member controls the thickness of the developer on the developer carrier. The control member has an abutting member that abuts against a reference plane of a main body of the developing device and an elastic member that overlaps the abutting member. The elastic member is urged toward the developer carrier and has a center portion of the overlapped sections of the elastic member and the abutting member that is wider than the end portions of the overlapped sections. An overlap member overlaps the elastic member.

18 Claims, 42 Drawing Sheets

DEVELOPING DEVICE FEATURING A CONTROL MEMBER HAVING A CENTER PORTION WIDTH WIDER THAN END PORTIONS WIDTH IN A LONGITUDINAL DIRECTION THEREOF FOR CONTROLLING DEVELOPER THICKNESS AND METHOD FOR USING SAME

BACKGROUND OF THE INVENTION

1. Field of the Invention

The present invention relates to a developing device and to a process cartridge for use in, for example, an electrophotographic image forming apparatus.

As employed herein, a "process cartridge" refers to a cartridge including at least one of a unit for charging an electrophotographic photosensitive member, a unit for developing a latent image formed on the electrophotographic photosensitive member, and a unit for removing developer remaining on the electrophotographic photosensitive member integrally formed with the electrophotographic photosensitive member in a cartridge. The cartridge can be attached to and detached from the main body of the electrophotographic image forming apparatus.

In addition, a "developing cartridge", described hereinbelow, refers to a cartridge including a unit for developing a latent image formed on an electrophotographic photoconductive drum using toner integrally formed with a toner frame for accommodating the toner in a cartridge, and is removably attached to an image forming apparatus main body.

In this specification, a "longitudinal direction" refers to a direction that is perpendicular to a conveyance direction of a recording medium and is in parallel with the surface of the recording medium. In addition, a "lateral direction" refers to a direction perpendicular to the longitudinal direction.

2. Description of the Related Art

Hitherto, image forming apparatuses for forming multicolored images by electrophotographic methods have been proposed in which a plurality of developing cartridges for accommodating different-colored developers (toners) are arranged on a rotary selection mechanism (developing rotary) with respect to a photoconductive drum, which is an electrophotographic photosensitive member, a developing cartridge having a toner of a predetermined color accommodated therein is opposed to the photoconductive drum to effect developing, the developed image is transferred to a recording medium, and the developing and transferring operations are effected for each color to obtain the multicolored image. The developing cartridges are removably attached to the image forming apparatus main body so as to facilitate maintenance by a user.

Such a developing cartridge is formed by combining a developing frame for supporting developing members, such as a developing roller, a developing blade for controlling the thickness of toner coated on the developing roller, and a coating roller for applying the toner to the developing roller, and a toner frame having the toner accommodated therein into a cartridge so as to allow a reduction in size thereof.

In the above described developing cartridge, it is common for a supporting plate of the developing blade to be increased in its degree of straightness and flatness so that the developing blade (control member) for controlling the thickness of a developer on the developing roller (developer carrier) abuts equally against the developing roller along its length.

It is also common for both ends of the developing plate to be fixed by small screws so that the developing blade does not move with respect to a developing case.

In addition, a process cartridge has been proposed incorporating therein the developing device as the developing member.

SUMMARY OF THE INVENTION

It is an object of the present invention to provide a developing device and a process cartridge, each including a control member for reducing variations in an abutting force against a developer carrier. The control member controls the thickness of the developer on the developer carrier, as described above.

It is another object of the present invention to provide a developing device and a process cartridge in which a difference in abutting pressure of the developing blade on the developing roller may not be created by a flexure, etc., of the developing blade between the center and the end portion in the longitudinal direction of the developing blade, resulting in unevenness of image density.

It is a still another object of the present invention to provide a developing device including a developer carrier for carrying a developer; and a control member for controlling the thickness of the developer on the developer carrier, the control member including an abutting member abutting against a reference plane of a developing device main body; an elastic member overlapping the abutting member, the elastic member being urged toward the developer carrier, the width in the center portion of overlapped portions of the elastic member and the abutting member being wider than that in both ends thereof; and an overlap member overlapping the elastic member.

It is a further object of the present invention to provide a process cartridge including an image carrier; a developer carrier for carrying a developer; and a control member for controlling the thickness of the developer on the developer carrier, the control member including an abutting member abutting against a reference plane of a developing device main body; an elastic member overlapping the abutting member, the elastic member being urged toward the developer carrier, the width in the center portion of overlapped portions of the elastic member and the abutting member being wider than that in both ends thereof; and an overlap member overlapping the elastic member.

Further objects, features and advantages of the present invention will become apparent from the following description of the preferred embodiments with reference to the attached drawings.

DESCRIPTION OF THE PREFERRED EMBODIMENT

A developing cartridge in accordance with embodiments of the present invention, and an electrophotographic image forming apparatus (hereinafter, referred to as "an image forming apparatus") using the cartridge will now be described.

In the following description, a "longitudinal direction" refers to a direction that is perpendicular to a conveyance direction of a recording medium and is in parallel with the surface of the recording medium.

First Embodiment

Figure 1:
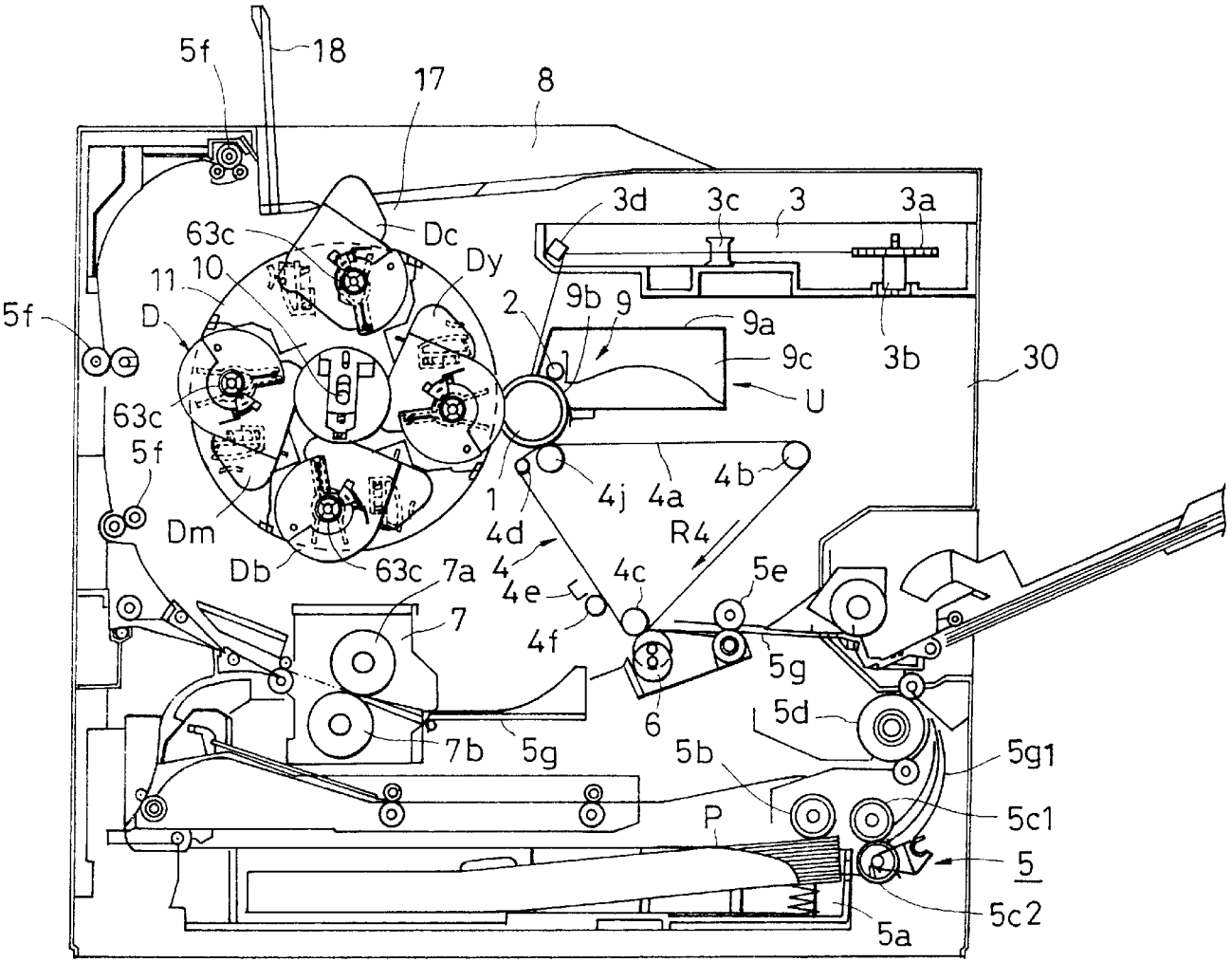
FIG. 1 is a vertical section of an electrophotographic image forming apparatus.
Figure 2:
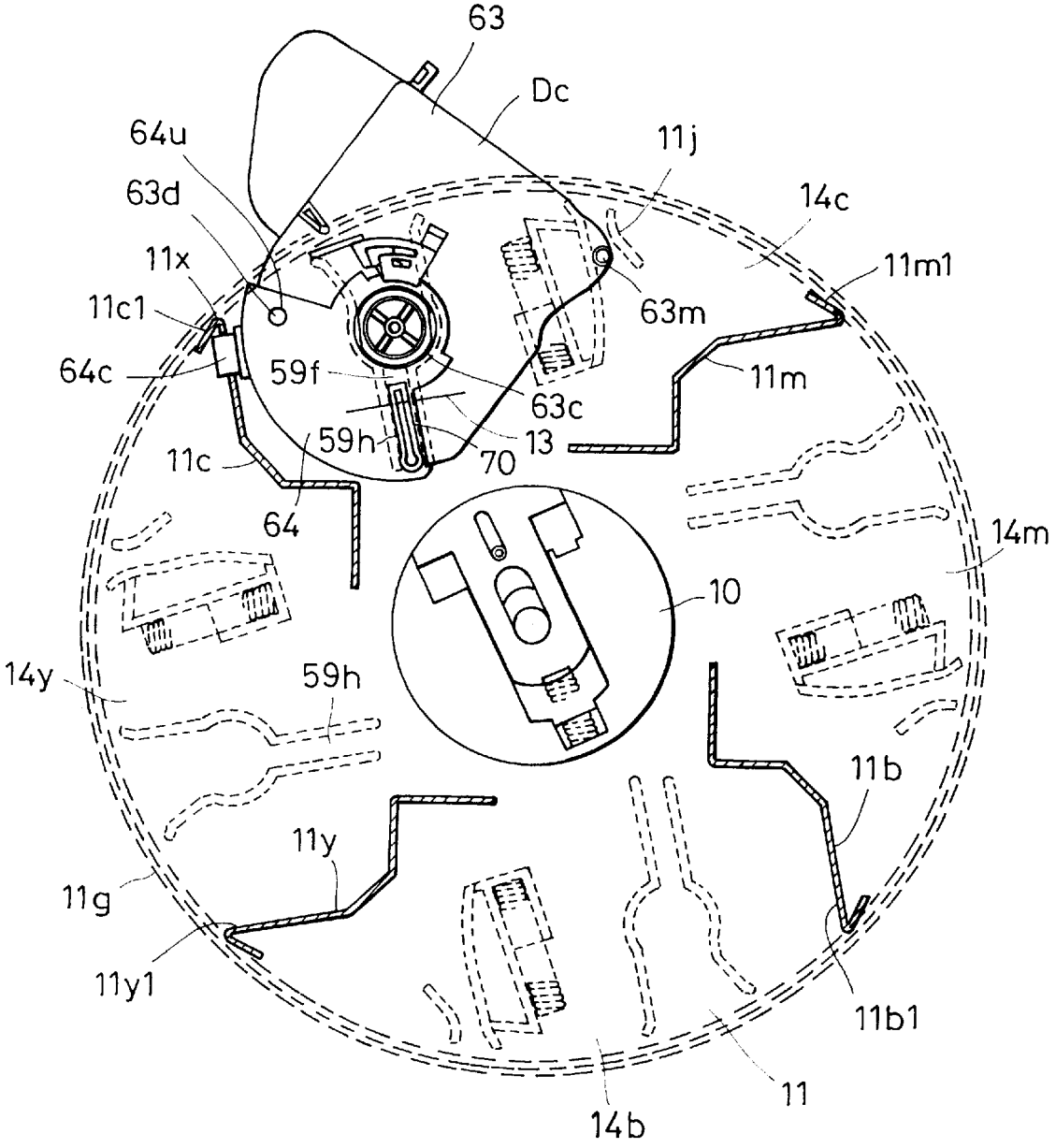
FIG. 2 is a sectional view of a rotary unit perpendicular to the axis thereof.
Figure 3:
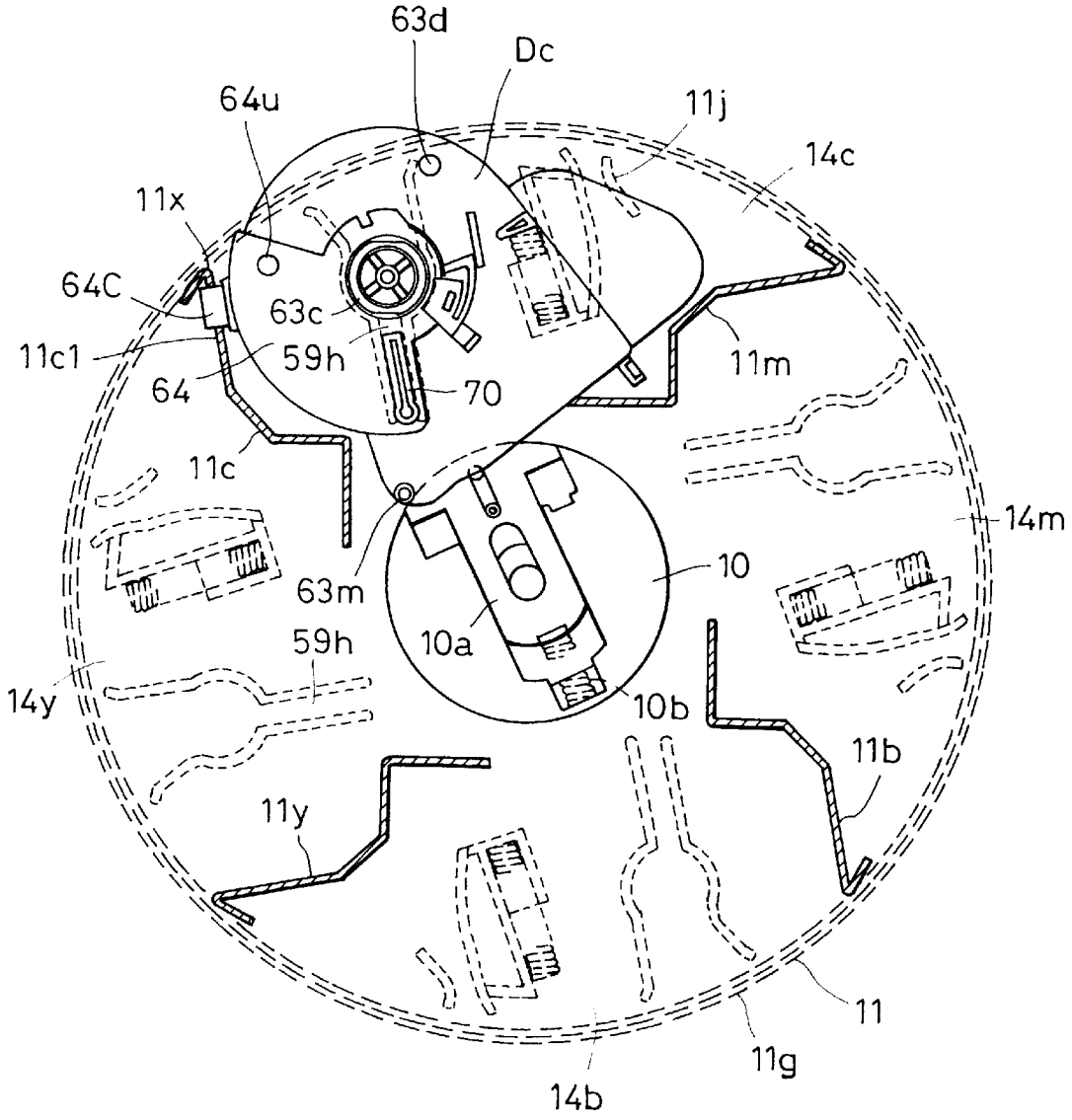
FIG. 3 is a sectional view of a rotary unit perpendicular to the axis thereof.
Figure 4:
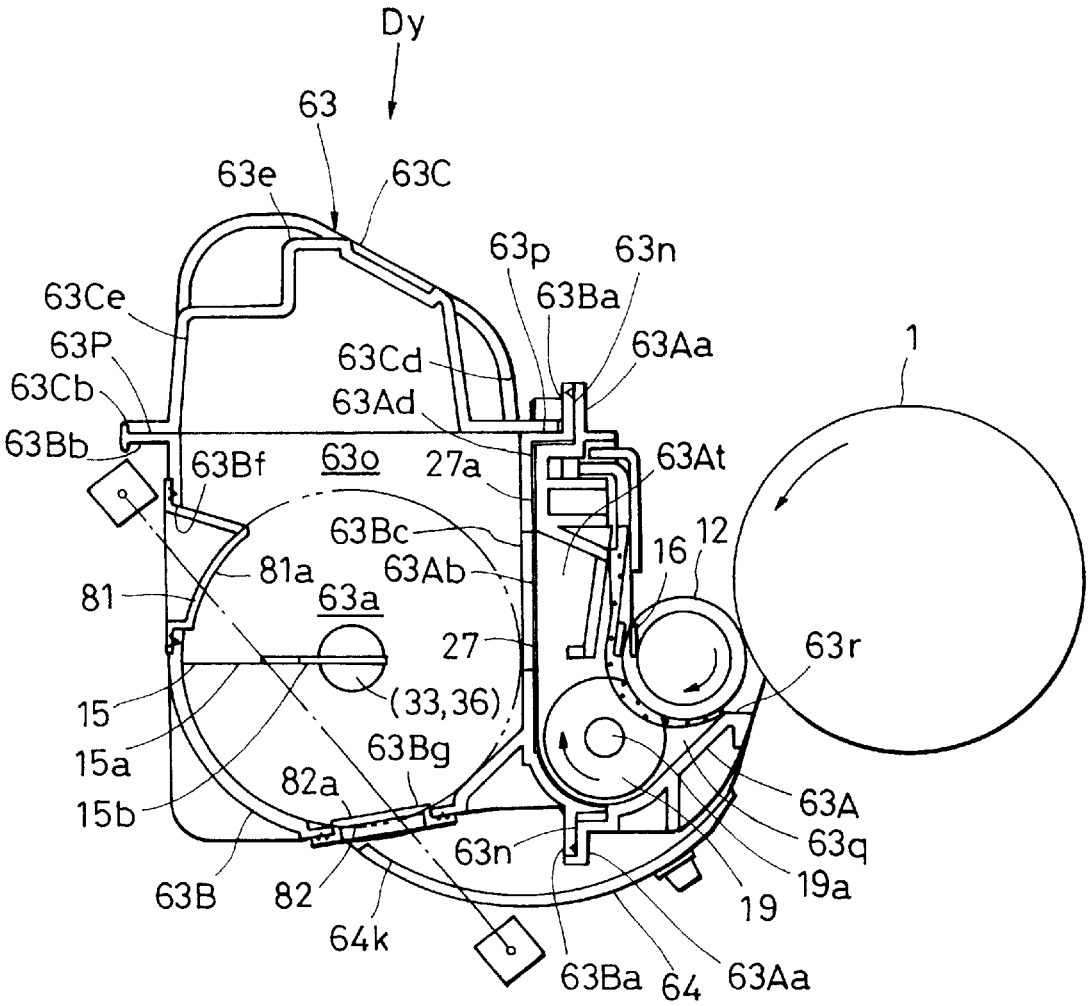
FIG. 4 is a vertical sectional view of a yellow developing cartridge.
Figure 5:
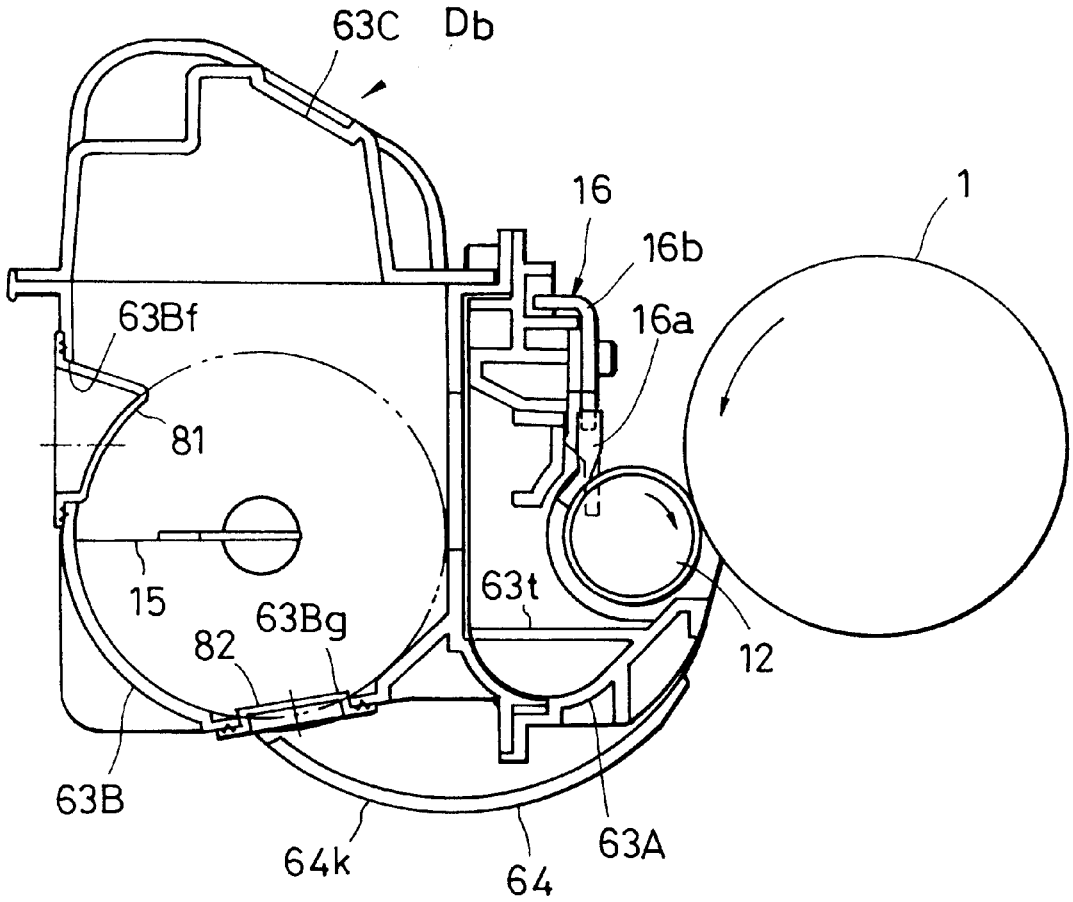
FIG. 5 is a vertical sectional view of a black developing cartridge.
Figure 6:
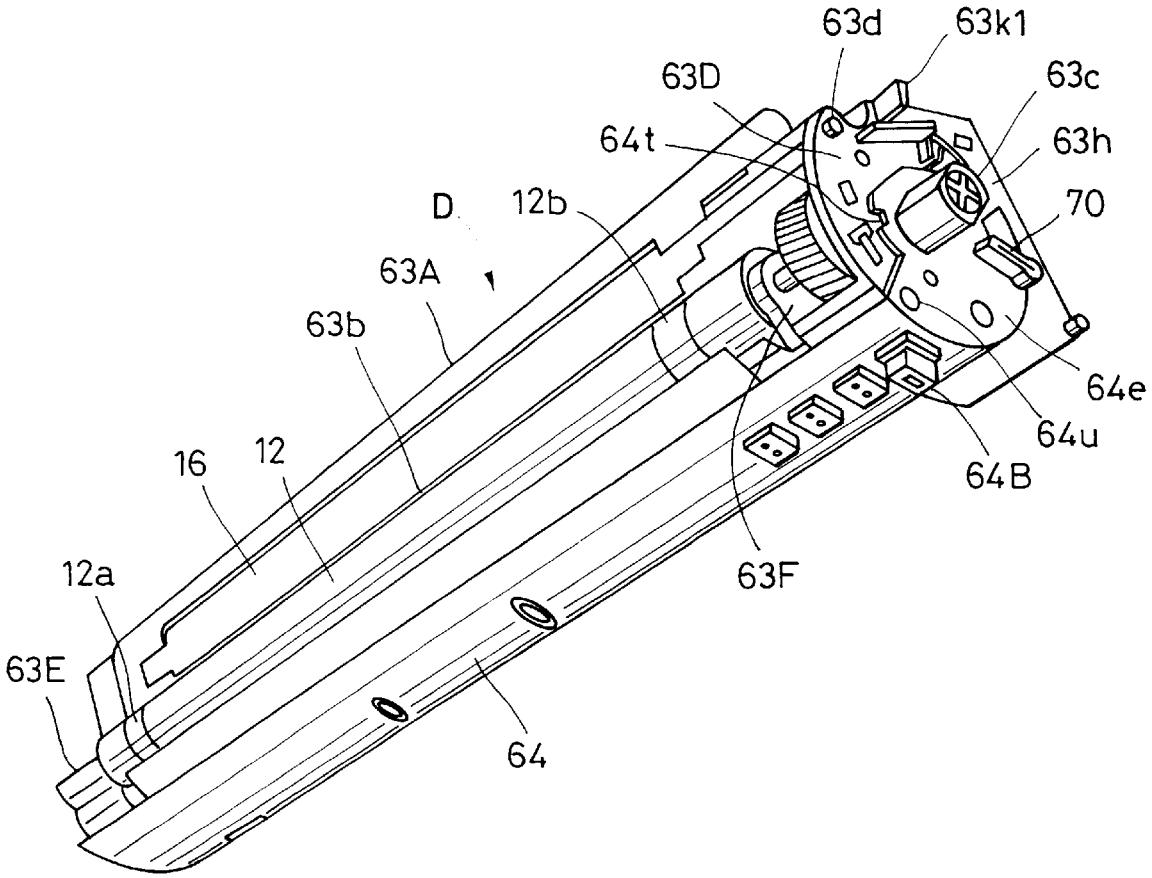
FIG. 6 is a perspective view of a developing cartridge in a state where a shutter is opened.
Figure 7:
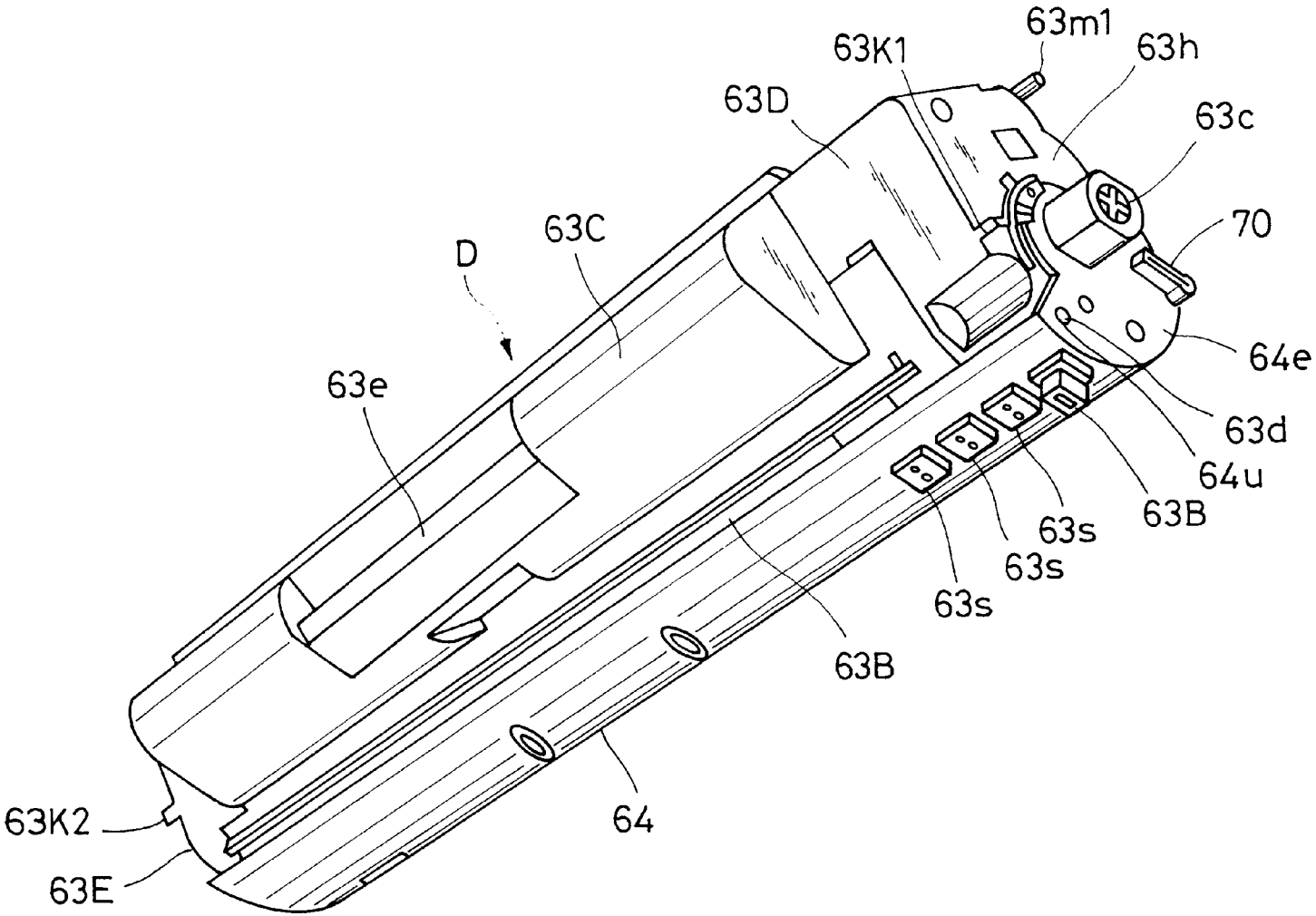
FIG. 7 is a perspective view of the developing cartridge in a state where the shutter is closed.
Figure 8:
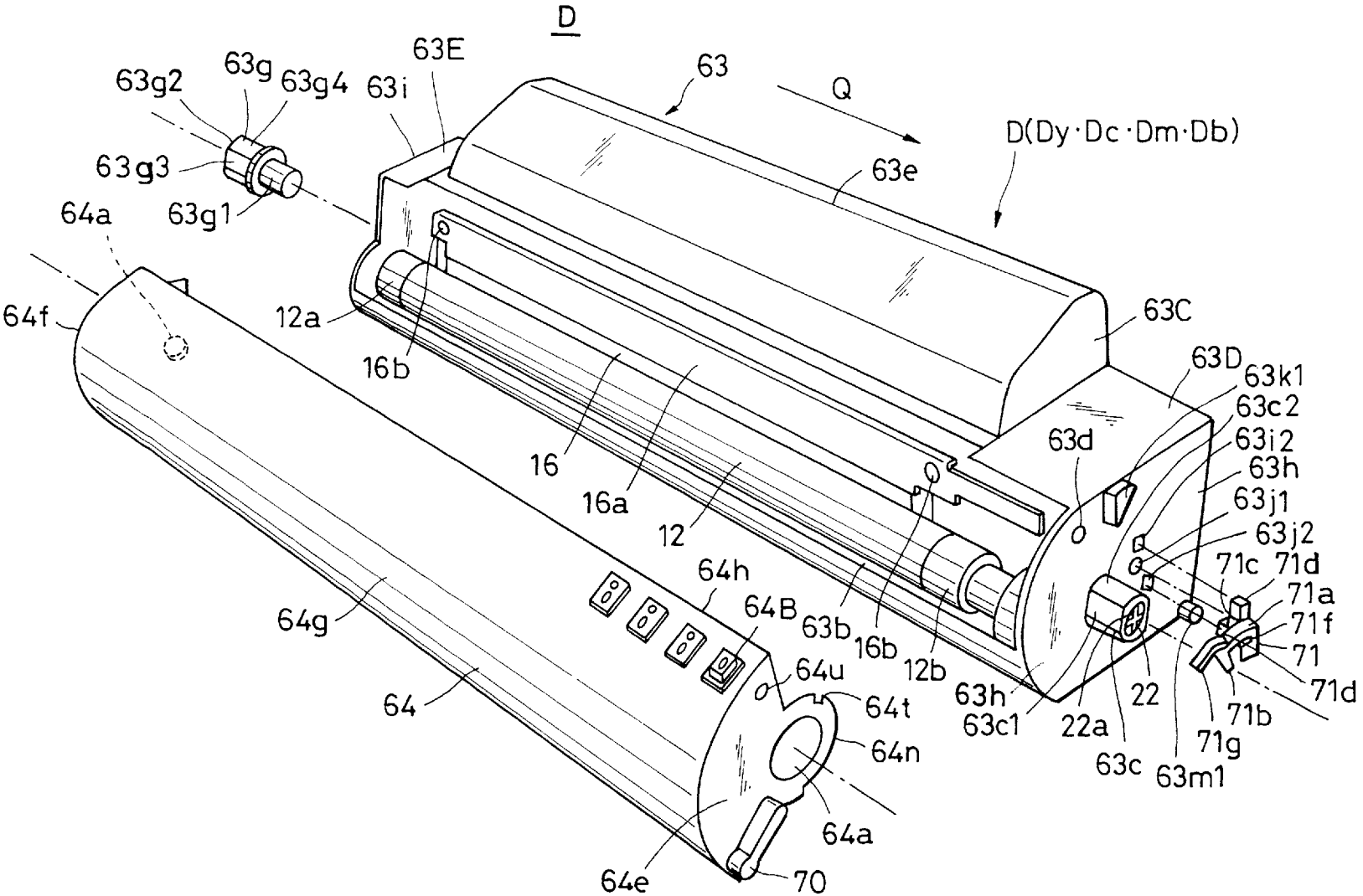
FIG. 8 is an exploded view in perspective of a developing cartridge schematically showing the vicinity of the shutter.

FIGS. 1 to 3 illustrate a configuration of an image forming apparatus; FIGS. 4 and 5 are vertical sectional views of a developing cartridge; FIGS. 6 to 8 are perspective views of the developing cartridge; and FIGS. 9 to 14 illustrate a mounting configuration of the developing cartridge. In FIGS. 2, 3, and 15 to 19, dotted lines are employed as imaginary lines.

The overall configuration of the image forming apparatus will first be described, and then the configuration of the developing cartridge will be described.

(Image Forming Apparatus)

First, a schematic configuration of the image forming apparatus according to this embodiment will be described.

FIG. 1 is a side view of a laser beam printer that is an example of the image forming apparatus for forming a color image by the electrophotographic method. The surface of a drum-shaped electrophotographic photosensitive member (hereinafter, referred to as "a photoconductive drum") 1 is uniformly charged by charging unit 2. Then, a laser beam corresponding to image information is applied from an exposure device 3 onto the photoconductive drum 1 to form a latent image, and the latent image is developed by four developing cartridges Dm, Dc, Dy, and Db (referred to collectively as D). The developed images formed on the photoconductive drum 1 are sequentially transferred to a belt-shaped intermediate transfer unit 4 one over another to form a color image. The color image is transferred by a transfer unit 6 to a recording medium P (such as a recording paper and an OHP sheet) that is conveyed by a conveyer unit 5 from a feed section. The recording medium P is conveyed to a fixing unit 7 to fix the color image, and is then discharged to a discharge section 8 formed on the top of the apparatus.

Configurations of each of the above components will now be specifically described.

First, the photoconductive drum 1 is integrally formed with a box-like frame 9*a* of a cleaning device 9 for removing a developer (hereinafter, referred to as a "toner") remaining on the photoconductive drum after a toner image has been transferred to the intermediate transfer unit 4, as a process cartridge U. The process cartridge U is removably attached to an image forming apparatus main body 30, and can be replaced by a user in accordance with the service life of the photoconductive drum 1.

The photoconductive drum 1 is formed by coating an aluminum cylinder of about 50 mm in diameter with an organic photoconductive layer, and is rotatably supported by the frame 9*a* of the cleaning device 9 which also serves as a holder for the photoconductive drum 1. A cleaning blade 9*b* for scraping off the toner remaining on the photoconductive drum 1, and the charging unit 2 are disposed on the periphery of the photoconductive drum 1. Accordingly, in this embodiment, the photoconductive drum 1, the cleaning device 9, and the charging unit 2 are made into the process cartridge U that is attachable to and detachable from the apparatus main body 30.

Figure 21:
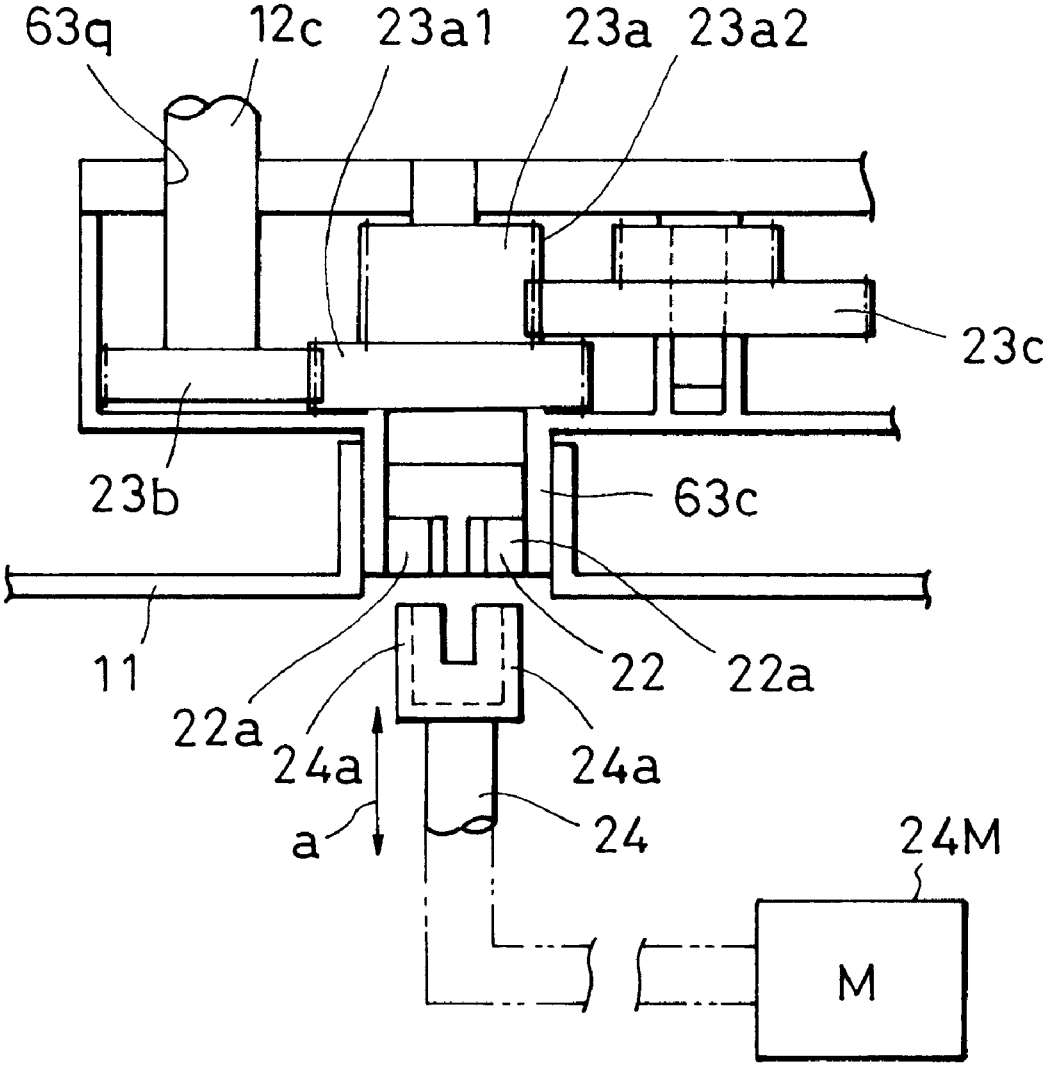
FIG. 21 is a plan view showing a driving device of the developing cartridge.

In addition, the photoconductive drum 1 is rotated counterclockwise in FIG. 1, responsive to the image forming operation, by transmitting a driving force of a driving motor 24M (see FIG. 21).

The charging means 2 in this embodiment employs a so-called "contact charging method", and contacts the surface of the photoconductive drum 1 to apply voltage to a rotating conductive roller, thereby uniformly charging the surface of the photoconductive drum 1.

The exposure means 3 for exposing the charged photoconductive drum 1 includes a polygon mirror 3*a*, a scanner motor 3*b*, an image forming lens 3*c*, and a reflecting mirror 3*d*. When an image signal is transmitted to a laser diode (not shown), the laser diode applies image light responsive to the image signal to the polygon mirror 3*a*. The polygon mirror 3*a* is rotated at a high speed by the scanner motor 3*b*, and the image light reflected from the mirror 3*a* selectively exposes the surface of the constant-speed-rotating photoconductive drum 1 through the image forming lens 3*c* and the reflecting mirror 3*d* to form a latent image.

The latent image is developed by the developing cartridge D for each color. The configuration of the developing cartridge will be described later.

The toner image developed by the developing cartridge D is transferred to the intermediate transfer unit 4. The intermediate transfer unit 4, also serving as a second image carrier, secondarily and collectively transfers a plurality of toner images, which are primarily transferred sequentially one over another from the photoconductive drum 1, to the recording medium P. The intermediate transfer unit 4 includes an intermediate transfer belt 4*a* running in the direction of the arrow R4. In this embodiment, the intermediate transfer belt 4*a* has a length of about 440 mm, and is looped over a driving roller 4*b*, a secondary opposite roller 4*c*, and a follower roller 4*d*. A presser roller 4*j* is provided in the vicinity of the follower roller 4*d*. The presser roller 4*j* retracts to be located in a position where it presses the intermediate transfer belt 4*a* to the photoconductive drum 1 and the intermediate transfer belt 4*a* moves away from the photoconductive drum 1. The intermediate transfer belt 4*a* runs in the direction of the arrow R4 by the rotation of the driving roller 4*b*. In addition, a cleaning unit 4*e* is provided at a predetermined position outside the intermediate transfer belt 4*a* so as to be brought into contact with and be separated from the surface of the intermediate transfer belt 4*a*. The cleaning unit 4*e* removes the toner remaining on the transfer belt after secondary transfer to the recording medium P. The cleaning unit 4*e* brings a charging roller 4*f* into abutment with the intermediate transfer belt 4*a* to apply a charge to the toner which is opposite to the charge for transferring. The toner that has received the opposite charge is electrostatically allowed to adhere on the photoconductive drum 1, and is then recovered by the cleaning device 9 for the photoconductive drum 1. A method for cleaning the intermediate transfer belt 4*a* is not limited to the above electrostatic cleaning method. A mechanical cleaning method, such as a blade cleaning or a fur brush cleaning method, or a combination of these methods may be employed.

The toner remaining on the surface of the photoconductive drum 1 after the toner image has been transferred to the intermediate transfer unit 4 is removed by the cleaning device 9. The cleaning device 9 scrapes off the toner by the cleaning blade 9*b* abutted against the surface of the photoconductive drum 1 to store the removed toner in a waste toner container 9*c*. The waste toner container 9*c* is formed by the frame 9*a*. The amount of waste toner to be stored in the waste toner container 9*c* is set so as not to fill the waste toner container 9*c* before the expiration of the service life of the photoconductive drum 1, and the waste toner in the waste toner container 9*c* is removed together with the process cartridge U upon expiration of the service life of the photoconductive drum 1.

In this embodiment, the transfer unit 6 for transferring the toner images that are successively transferred to the intermediate transfer unit 4 to the recording medium P is constructed of a transfer roller. The transfer roller 6 is formed by winding a medium-resistance-foaming elastic member around a metal shaft, and is provided so as to move in the up and down directions in FIG. 1.

The transfer roller 6 is located downward as shown by the solid line in FIG. 1 so as to be separated from the intermediate transfer unit 4 during the formation of four-colored toner images on the intermediate transfer unit 4, i.e., during the rotation of the intermediate transfer unit 4 a plurality of times, so as not to disturb the images.

After the toner images have been successively transferred onto the intermediate transfer unit 4 to form a color image, the transfer roller 6 is moved to the upper position by a cam (not shown) as shown by the single-dot chain line in FIG. 1. This allows the transfer roller 6 to be pressed onto the intermediate transfer unit 4 at a predetermined pressure via the recording medium P. At the same time, a bias voltage is applied to the transfer roller 6, and the toner images on the intermediate transfer unit 4 are transferred to the recording medium P.

As shown in FIG. 1, the conveyer unit 5 for conveying the recording medium P consists of a paper feeding cassette 5*a* containing therein a plurality of recording media P, a pickup roller 5*b*, a feed roller 5*c*1, a retarding roller 5*c*2 for preventing overlap-feeding of the recording medium P, conveyer roller pair 5*d*, register roller pair 5*e*, discharge roller pair 5*f*, and a conveyer guide 5*g*1.

When forming an image, the pickup roller 5*b* is rotationally driven in response to the image forming operation to individually feed the recording media P stored in the paper feeding cassette 5*a*. The recording medium P fed from the paper feeding cassette 5*a* is guided by the conveyer guide 5*g* to reach the register roller pair 5*e* via the conveyer roller pair 5*d*. During the image forming operation, the register roller pair 5*e* performs a nonrotary operation for allowing the recording medium P to be on standby, and a rotary operation for conveying the recording medium P toward the intermediate transfer unit 4 at a predetermined sequence, and then performs registration of the image and the recording medium during the next transfer step, whereby the color image is transferred onto the recording medium P by the above-mentioned transfer roller 6.

The recording medium P having the color image transferred thereon is conveyed to the fixing unit 7, and a toner image is fixed thereon. The fixing unit 7 consists of a fixing roller 7*a* for applying heat to the recording medium P and a presser roller 7*b* for pressing the recording medium P into contact with the fixing roller 7*a*. These rollers 7*a* and 7*b* are hollow rollers including therein heaters, respectively, and are rotationally driven. The rollers 7*a* and 7*b* convey the recording medium P while applying heat and pressure thereto, whereby the toner image is fixed to the recording medium P.

The recording medium P having the toner image fixed thereto is discharged by the discharge roller pair 5*f* to the discharge section 8.

(Developing Cartridge)

The configuration of the developing cartridge for developing a latent image formed on the photoconductive drum 1 will now be described.

The image forming apparatus of this embodiment includes four developing cartridges D (Dm, Dc, Dy, and Db) in order to enable development of magenta, cyan, yellow, and black, respectively. The developing cartridges D are removably attached to a rotary unit 11 that rotates about a central shaft 10, as shown in FIGS. 1 to 3. In forming images, each developing cartridge D rotationally moves about the central shaft 10 while being held by the rotary unit 11, and stops at a position where the developing cartridge D containing therein a predetermined color toner is opposed to the photoconductive drum. Further, after a developing roller (developer carrier) described hereinbelow has been positioned to oppose the photoconductive drum 1 with a narrow clearance (about 300 $\mu$m), each developing cartridge D supplies a toner in response to an electrostatic latent image on the photoconductive drum 1 to develop the latent image.

When forming a color image, the rotary unit 11 rotates at each rotation of the intermediate transfer unit 4 to perform development operation in the order of a magenta developing cartridge Dm containing magenta toner, a cyan developing cartridge Dc containing cyan toner, a yellow developing cartridge Dy containing yellow toner, and a black developing cartridge Db containing black toner. The black toner is a magnetic toner, and other color toners are nonmagnetic toners.

FIG. 4 shows a state where the developing cartridge D (for example, the yellow developing cartridge Dy) is standing still at a development position opposed to the photoconductive drum 1. The developing cartridge D includes a developing roller 12 that is a toner carrier for supplying a toner to the photoconductive drum 1, and a toner storage section 63*a* for storing the toner, a cartridge frame 63 combining a plurality of frames, and a shutter 64 that can open and close an opening provided in the cartridge 63 to expose the developing roller 12. In addition, a toner-feeding member 15 is provided inside the toner storage section 63*a*. A toner seal 27 is attached to the developing cartridge D to prevent leakage of the toner stored in the toner storage section 63*a*. The user tears off the toner seal 27 to open the toner storage section 63*a* before attaching the developing cartridge D to the apparatus main body 30, whereby the toner in the toner storage section 63*a* can be supplied to the developing roller 12.

Upon receipt of a driving force from the apparatus main body 30, the toner-feeding member 15 rotates to feed the toner in the toner storage section 63*a* to the developing roller 12. The developing roller 12 is a rotatable aluminum roller, and a developing blade 16 is pressed into contact with the peripheral surface of the developing roller 12. Therefore, when the developing roller 12 rotates in a clockwise direction in FIG. 4, the toner is coated in a thin layer on the peripheral surface thereof, and the toner is frictionally statically charged.

A development bias voltage supplied from the apparatus main body 30 is applied to the developing roller 12 that is opposed to the photoconductive drum 1 having the latent image formed thereon, whereby a toner image can be formed on the photoconductive drum 1 in response to the latent image.

The above-mentioned configuration and development process are identical to those of the magenta developing cartridge Dm, the cyan developing cartridge Dc, the yellow developing cartridge Dy, and the black developing cartridge Db. In addition, the developing roller 12 of each developing cartridge D is connected to a high-voltage power supply for each color development and to a drive source provided in the apparatus main body 30 when each developing cartridge D is moved to the development position. A development bias voltage is sequentially and selectively applied to each developing cartridge D, and a driving force is transmitted to each developing cartridge D to rotate the developing roller 12.

The magenta developing cartridge Dm, the cyan developing cartridge Dc, and the yellow developing cartridge Dy shown in FIG. 4 have the same structure. That is, these developing cartridges Dm, Dc, and Dy include an application roller 19, which has a peripheral surface moving in the direction opposite to that of the developing roller 12, provided in a developing member-supporting frame 63A of the cartridge frame 63.

The black developing cartridge Db shown in FIG. 5 does not include the application roller. The arrangement is such that the toner is adhered onto the developing roller 12 by a magnetic force and an adhering force of a magnet (not shown) incorporated into the developing roller 12, the thickness of the toner layer is controlled by the developing blade 16 contacting the peripheral surface of the developing roller 12, and the toner is frictionally statically charged.

(Attachment of Developing Cartridge to Apparatus Main body)

A configuration for the attachment of the developing cartridge D to the image forming apparatus main body 30 will now be described.

Figure 13:
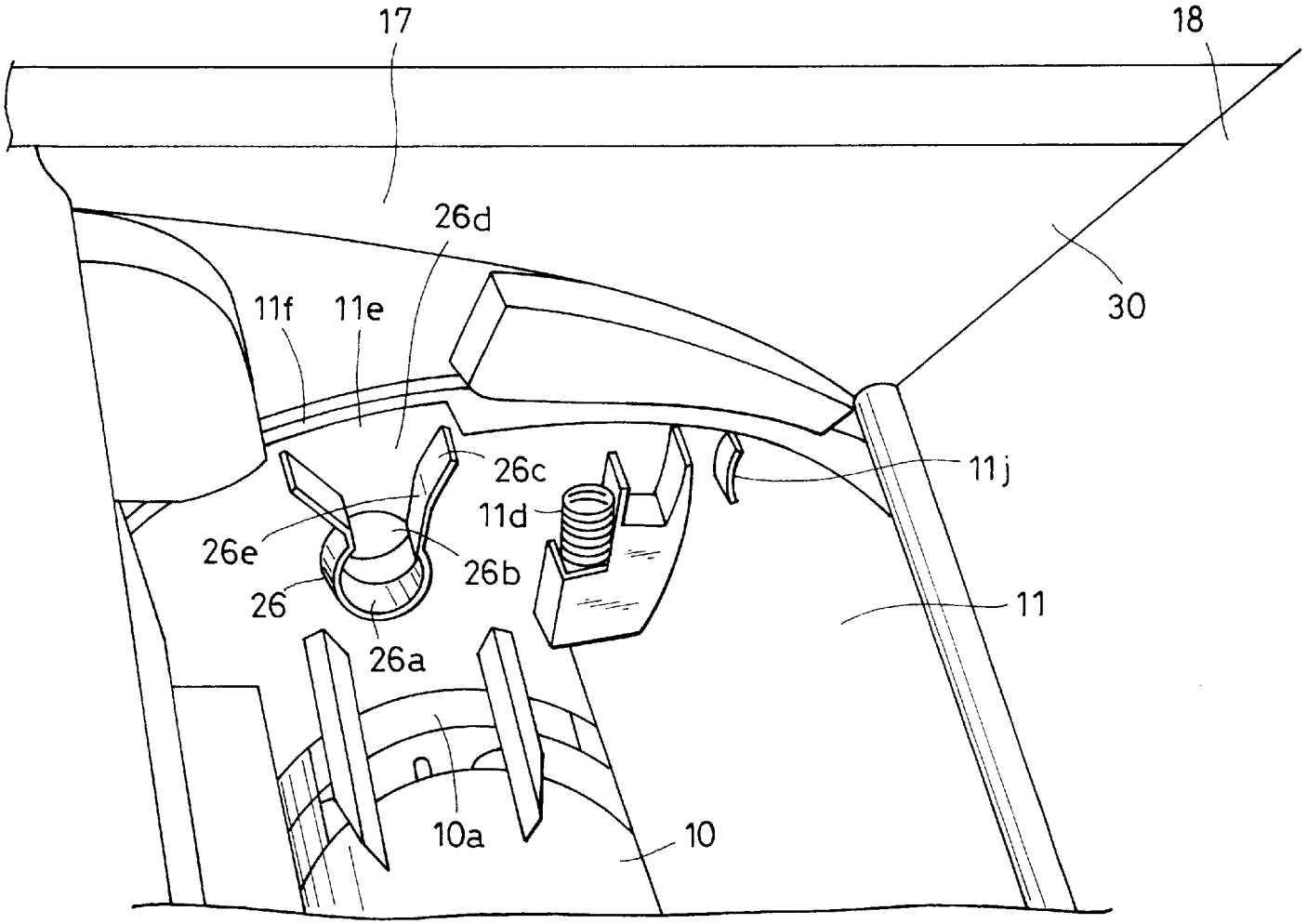
FIG. 13 is a perspective view of a developing cartridge attachment section of the rotary unit on the non-drive side.
Figure 14:
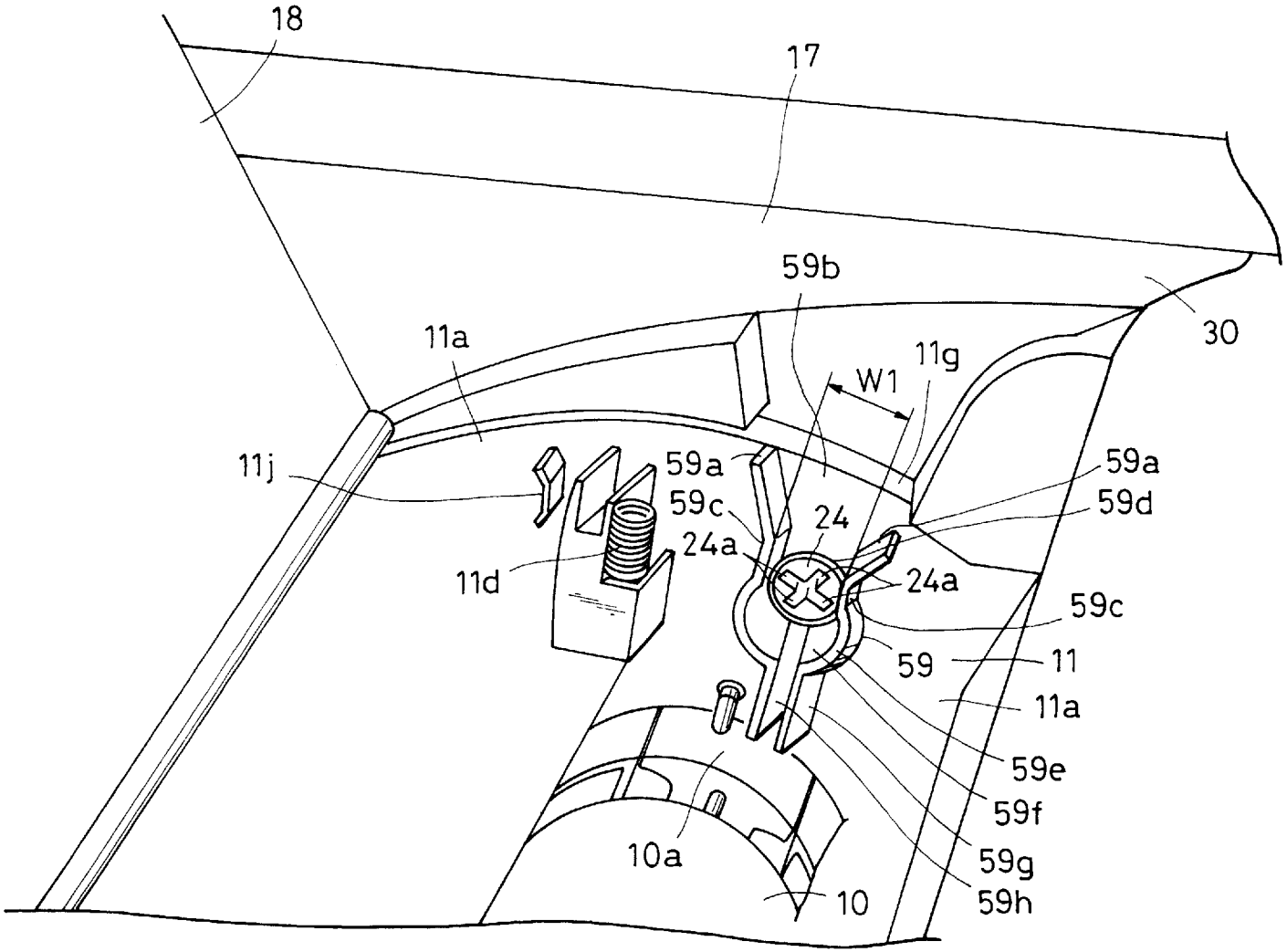
FIG. 14 is a perspective view of the developing cartridge attachment section of the rotary unit on the drive side.

As shown in FIGS. 1, 13, and 14, an insertion opening 17 having the width longer than the length of the developing cartridge D is formed in a predetermined position of the apparatus main body 30, and a cover 18 is mounted on the insertion opening 17 in such a manner that it can be opened and closed. The insertion opening 17 is normally closed by the cover 18.

In addition, the apparatus main body 30 is provided with a developing device replacement switch (not shown). When the user pushes the switch for the replacement of the developing cartridge D by reason of consumption of the toner, etc., the rotary unit 11 rotates about the central shaft 10, and one of the developing cartridges D to be replaced is moved to the insertion opening 17.

When the user opens the cover 18, a guide 59 constituting attachment means of the developing cartridge D is provided on one side of the apparatus main body 30, as shown in FIG. 14. Four guides 59 are equally provided circumferentially on the rotary unit 11. On the other hand, a shutter 64 of the developing cartridge D is provided with a guide section 70, as shown in FIGS. 6, 7, 8, and 10. The user can attach the developing cartridge D to the apparatus main body 30 by inserting the guide section 70 along the guide 59. The guide section 70 is provided longitudinally on only one side (the direction of the rotation axis of the developing roller 12) of the developing cartridge D. Accordingly, the guide 59 is also provided on only one inner wall surface 11*a* of the rotary unit 11. In addition, circular ribs 26*a* and 59*e* are provided longitudinally on both inner wall surfaces 11*a* and 11*e* of the rotary unit 11, and projections 63*c* and 63*g* (see FIGS. 9 to 12), which are fitted into the circular ribs 26*a* and 59*e*, are provided longitudinally at both side surfaces of the developing cartridge D on the same center line parallel to the developing roller 12.

The developing cartridge D is inserted into the rotary unit 11 in a direction perpendicular to the longitudinal direction of the developing roller 12 by being gripped by hand at its grip 63*e* (see FIG. 7) with the developing roller 12 being directed forward (the direction in which the developing roller 12 can oppose the photoconductive drum 1 after the attachment).

After the developing cartridge D has been attached to the apparatus main body 30, the user rotates the developing cartridge D about the projections 63*c* and 63*g*, whereby the shutter 64 is opened, the developing roller 12 is exposed from the cartridge frame 63 to oppose the photoconductive drum 1, and the developing cartridge D is attached in a developable state.

The developing cartridge D attached to the attachment position of the rotary unit 11 is urged longitudinally by a spherical presser member 26*b* that is located at the circular rib 26*a* provided on one inner wall surface 11*e* of the rotary unit 11 (the developing cartridge D is urged toward a driving force receiver member 22). The presser member 26*b* is elastically and longitudinally urged by a spring (not shown). The developing cartridge D is urged to the driving side. Accordingly, the developing cartridge D is attached to the rotary unit 11 (the apparatus main body 30) longitudinally of the developing roller 12 with reference to the side of the driving force receiver member 22.

Figure 9:
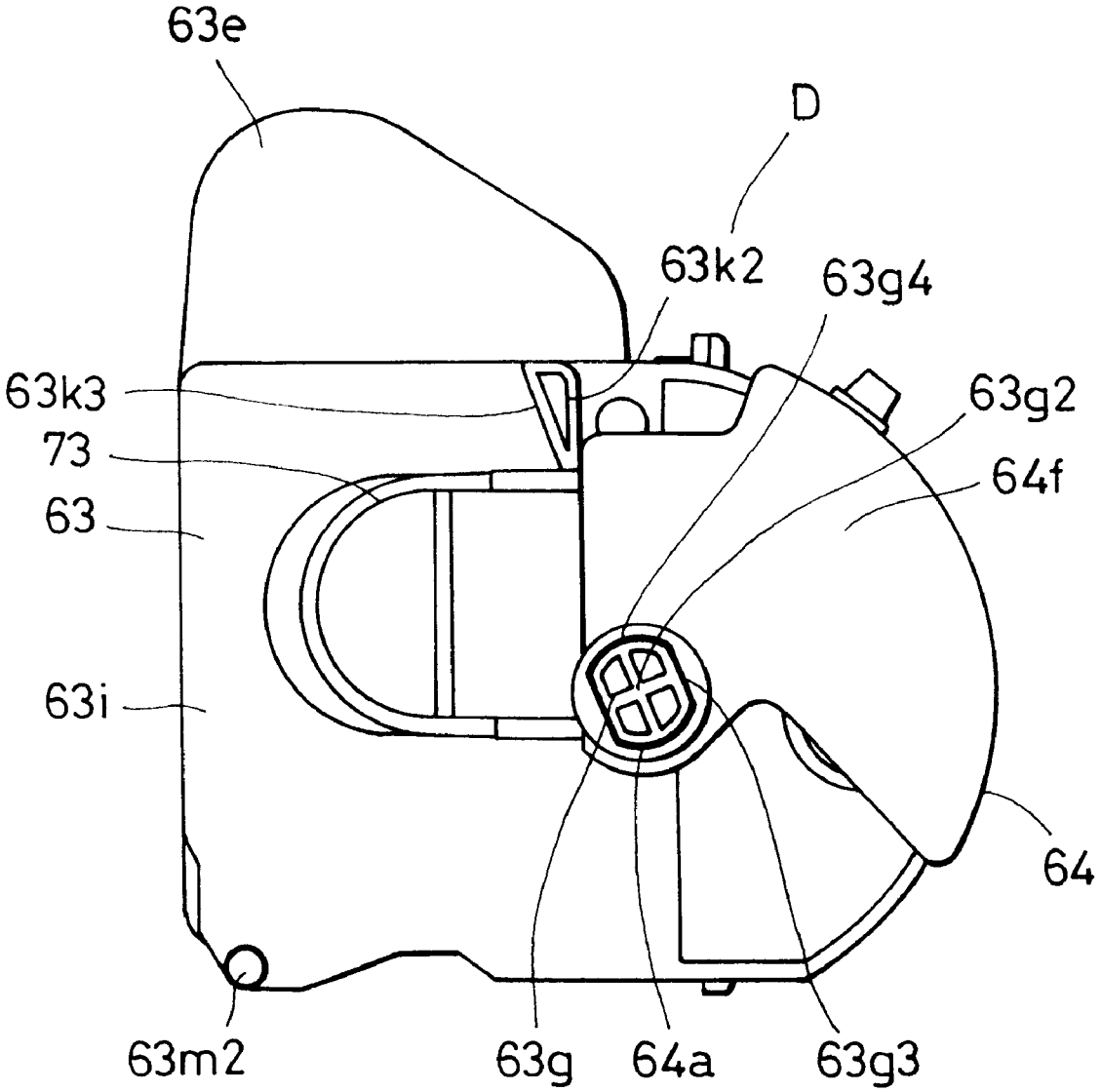
FIG. 9 is a side view of a non-drive side of the developing cartridge in a state where the shutter is closed.
Figure 10:
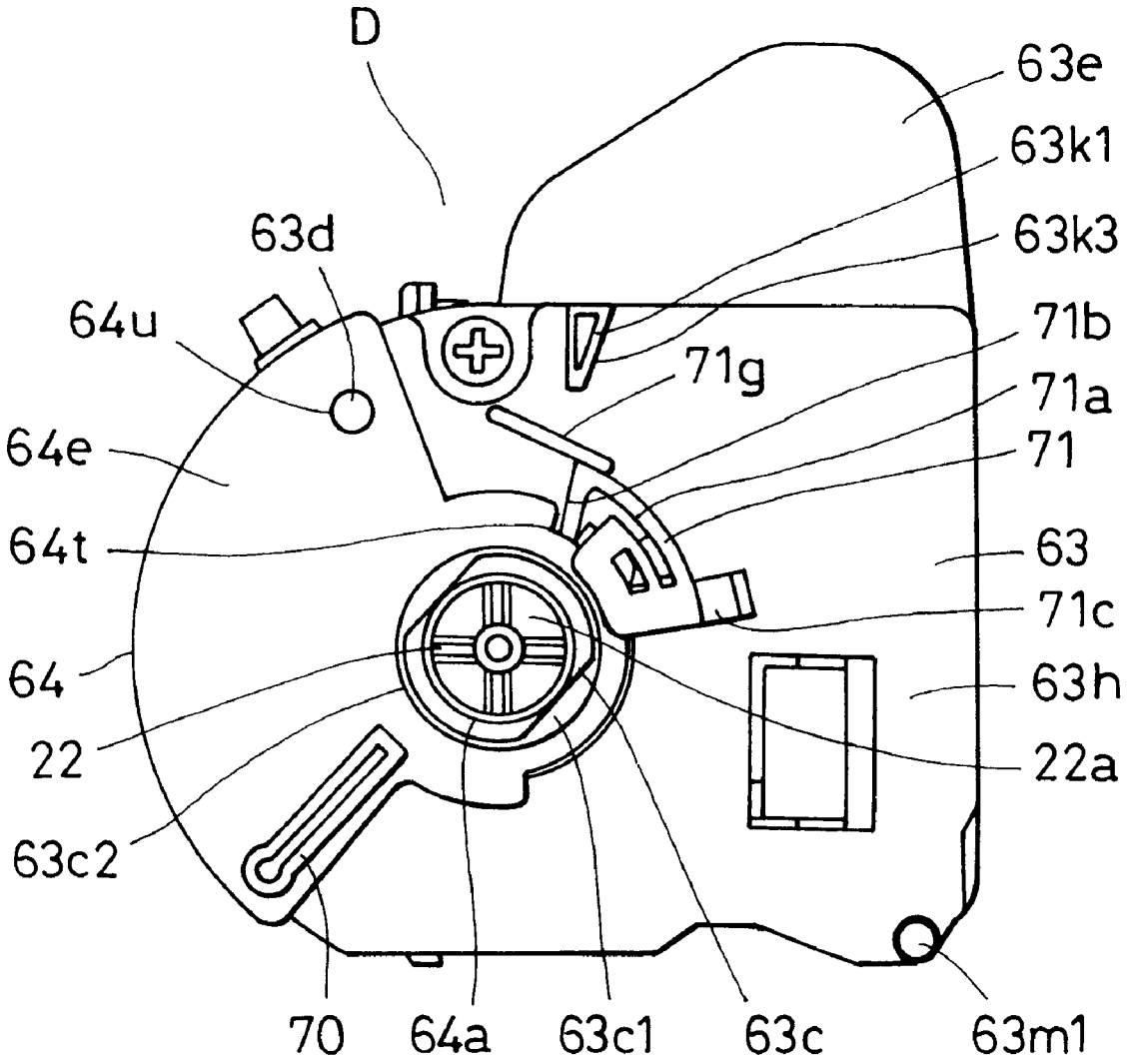
FIG. 10 is a side view of a drive side of the developing cartridge in a state where the shutter is closed.
Figure 11:
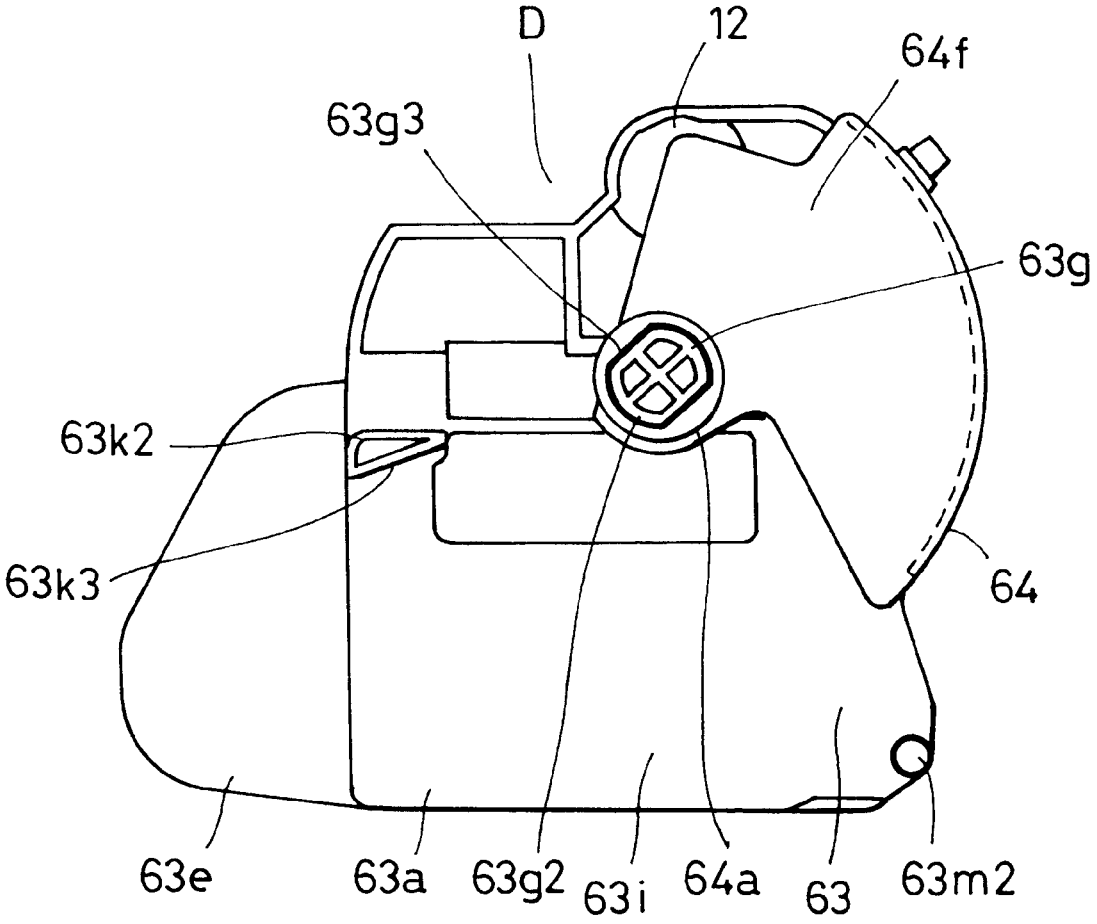
FIG. 11 is a side view of the non-drive side of the developing cartridge in a state where the shutter is opened.
Figure 12:
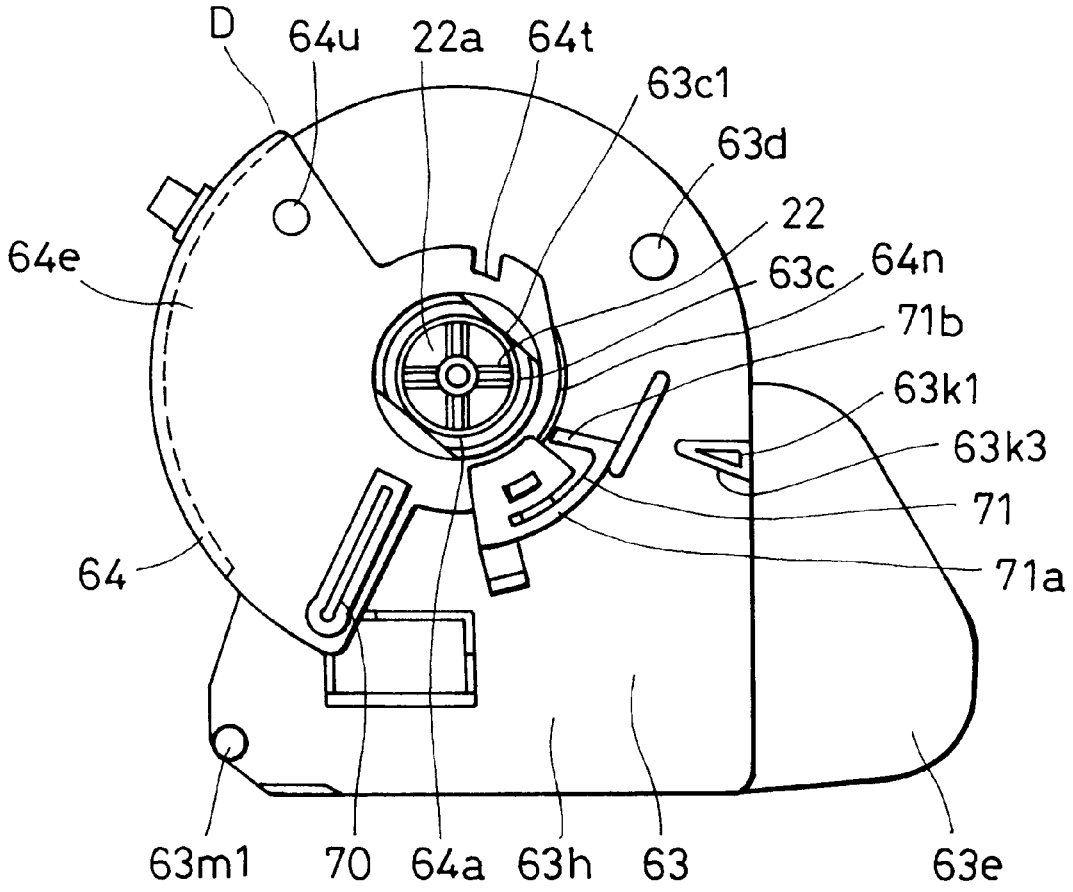
FIG. 12 is a side view of the drive side of the developing cartridge in a state where the shutter is opened.

The configuration of the developing cartridge D will now be described in detail with reference mainly to FIGS. 8 to 12. FIG. 8 is a perspective view of the developing cartridge D in a state where the shutter 64, etc. are removed. FIGS. 9 and 10 show both sides of the developing cartridge D in a state where the shutter 64 is closed, and FIGS. 11 and 12 show both sides of the developing cartridge D in a state where the shutter 64 is opened.

As shown in FIG. 8, an opening 63*b* is formed longitudinally in the cartridge frame 63 of the developing cartridge D, and the developing roller 12 is mounted in the cartridge frame 63 so as to be exposed from the opening 63*b*. The projection 63*c* is integrally formed with the cartridge frame 63 in substantially a center of one side surface 63*h* of the cartridge frame 63. The projection 63*c* is formed in a cylindrical shape, and serves as a guide when the developing cartridge D is inserted into the apparatus main body 30 and as a center of rotation when the developing cartridge D is attached to and detached from the apparatus main body 30. The projection 63*c* is formed in a cylindrical shape.

The projection 63*g* is removably mounted in substantially a center of the other side surface 63*i* (FIG. 9) of the cartridge frame 63 (FIG. 8 shows a removed state). The projection 63*g* is mounted on the cartridge frame 63 by inserting an insertion portion 63*g*1 into a hole (not shown) formed in the side surface 63*i*. The insertion portion 63*g*1 has an inverted shaft/post part (not shown) formed at its terminal end, and the inverted shaft/post part engages with the cartridge frame 63, whereby the projection 63*g* is mounted to the cartridge frame 63. In addition, when the developing cartridge D is attached to the attachment position of the rotary unit 11, a terminal end face 63*g*2 of the projection 63*g* is pressed by the presser member 26*b*. Accordingly, the developing cartridge D is pressed toward the side surface 63*h* (in the direction indicated by the arrow Q in FIG. 8). The developing cartridge D is attached to the rotary unit 11 (apparatus main body 30) with reference to the side surface 63*h* provided with the driving force receiver member 22.

Spacer rollers 12*a* and 12*b*, each having a radius larger than that of the developing roller 12 by a development clearance, are fitted to both ends of the developing roller 12. Accordingly, the spacer rollers 12*a* and 12*b* are pressed onto the peripheral surface of the photoconductive drum 1 by a biasing force of a biasing means 25 (see FIG. 24) or a helical compression spring 10*b* (see FIG. 3) biasing a sliding member 10*a* at a development position, whereby a predetermined clearance is maintained between the developing roller 12 and the photoconductive drum 1.

The developing blade 16 made of rubber, etc., is mounted on the cartridge frame 63 via a blade-supporting sheet metal 16*a* secured by small screws 16*b*1. A configuration of the developing blade 16 will be described later in detail.

A locking member 71 is mounted on the side surface 63*h* of the developing cartridge D (FIG. 8 shows a removed state thereof). The locking member 71 includes an engagement section 71*b* engaging with an engagement recess 64*t* provided in a side wall 64*e* of the shutter 64, a support section 71*a* for supporting the engagement section 71*b*, and mounting sections 71*c* and 71*d* attached on the side surface 63*h*. Mounting holes 63*j*1 and 63*i*2 are provided in the side surface 63*h* into which the mounting sections 71*c* and 71*d* are inserted. The locking member 71 is an integrally molded article which may be made of plastic. In the attachment process of the developing cartridge D, an arm section 71*g* of the locking member 71 comes into contact with a fixture section provided in the apparatus main body 30, whereby the support section 71*a* flexes and the engagement section 71*b* is disengaged from the engagement recess 64*t* to unlock the shutter 64.

A hemispherical projection 63*d* is provided only on the side surface 63*h* of the cartridge frame 63, as shown in FIGS. 2, 3, 6, 7, 8, 10, and 12. A hole 64*u* into which the projection 63*d* can be fitted is formed in the corresponding position of the shutter 64. Accordingly, since the projection 63*d* is fitted into the hole 64*u* when the shutter 64 is closed, the cartridge frame 63 does not rotate to an unstable position with respect to the shutter 64 even if the shutter 64 is unlocked.

In addition, positioning bosses 63*m* (63*m*1 and 63*m*2), and spring receivers 63*k* (63*k*1 and 63*k*2) described hereinbelow are projected on the side surfaces 63*h* and 63*i* of the cartridge frame 63, respectively.

A toner seal grip 73 shown in FIG. 9 is used when the user tears off the toner seal 27.

(Shutter)

Figure 25:
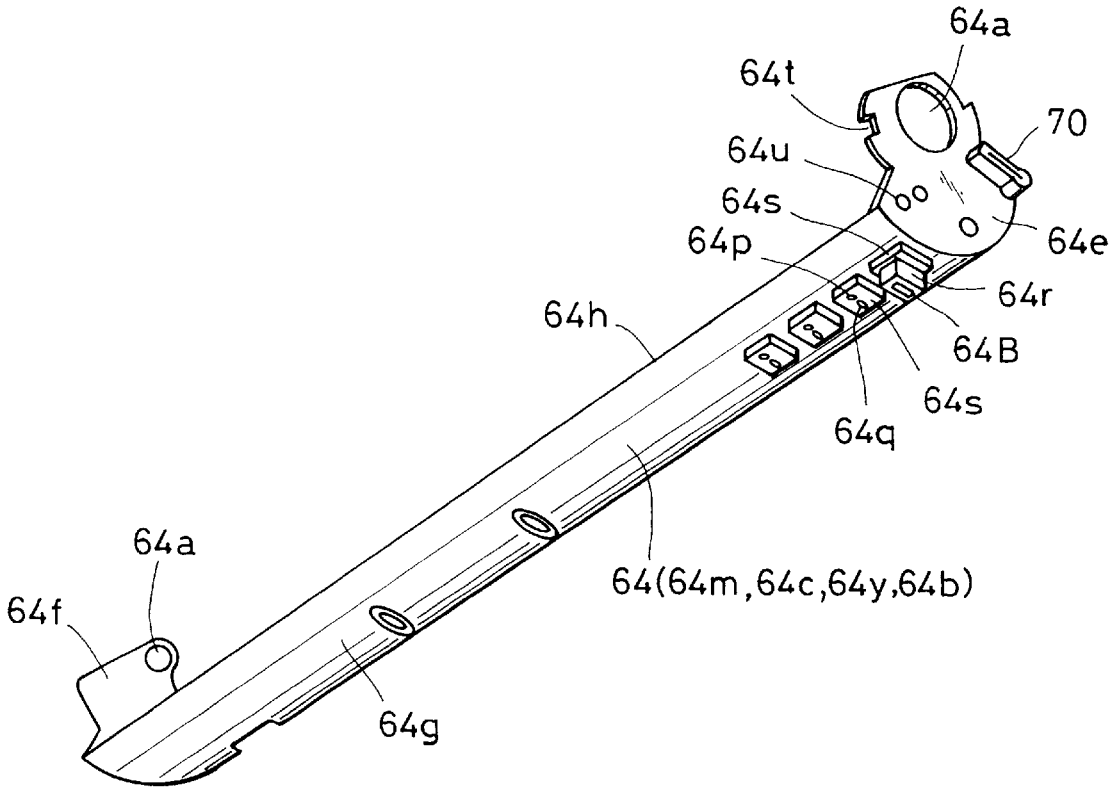
FIG. 25 is a perspective view of the shutter.

As shown in FIG. 25, round holes 64*a* are formed longitudinally in both side walls 64*e* and 64*f* of the shutter 64, and the projections 63*c* and 63*g* are fitted into the round holes 64*a*, whereby the shutter 64 is rotatably mounted on the cartridge frame 63. A shutter cover section 64*g* for covering the opening 63*b* of the cartridge frame 63 forms a part of a cylinder having the center line passing through the center of the round holes 64*a*. When the shutter 64 is closed, as shown in FIG. 7, the opening 63*b* is closed and the developing roller 12 is covered with the shutter 64. Since the shutter 64 is closed when the developing cartridge D is removed from the apparatus main body 30, dust or the like does not adhere to the developing roller 12 and the developing roller 12 is not damaged. In addition, no foreign matter enters into the developing cartridge D.

The support section 71*a* of the locking member 71 can be elastically deformed by being supported only at the side of the mounting sections 71*c* and 71*d* by forming a slit 71*f*, as shown in FIG. 8, and has the engagement section 71*b* and the unlocking aluminum arm section 71*g* formed at a terminal end thereof. The mounting section 71*c* has a longitudinal cylindrical shape, and is fitted into the mounting hole 63*j*1. The two mounting sections 71*d* provided around the mounting section 71*c* are square dowels projecting longitudinally, each having an inverted shaft/post portion (not shown). These mounting sections 71*d* are fitted into the square mounting holes 63*j*2 formed around the mounting hole 63*j*1, whereby the locking member 71 is mounted to the side surface 63*h* of the cartridge frame 63.

When the shutter 64 is opened, the terminal end of the engagement section 71*b* is located on a cam edge 64*n* having a circular section coaxial with the round hole 64*a* of the side wall 64*e* of the shutter 64, as shown in FIG. 12. When the shutter 64 is closed, the engagement section 71*b* engages with the engagement recess 64*t* provided on the cam edge 64*n*, whereby the shutter 64 is locked in a closed state so as not to open accidentally. When the developing cartridge D is attached to the apparatus main body 30, the shutter 64 is automatically unlocked and opened.

(Attachment of Developing Cartridge)

A step for attaching the developing cartridge D to the apparatus main body 30, and a step for positioning the developing cartridge D in the apparatus main body 30 will now be specifically described with reference to FIGS. 13 to 19.

As shown in FIG. 14, the guide 59 provided on one inner wall surface 11*a* of the rotary unit 11 includes a guide insertion section 59*b* having inclined parts 59*a* that are inclined to open upward, a projection insertion section 59*d* having substantially parallel linear ribs 59*c*, a fitting section 59*f* that serves as a support member having circular ribs 59*e*, and a guide insertion section 59*h* having substantially parallel linear ribs 59*g* extending from the fitting section 59*f*. The guide 26 is provided on the other inner wall surface 11*e*.

Figure 15:
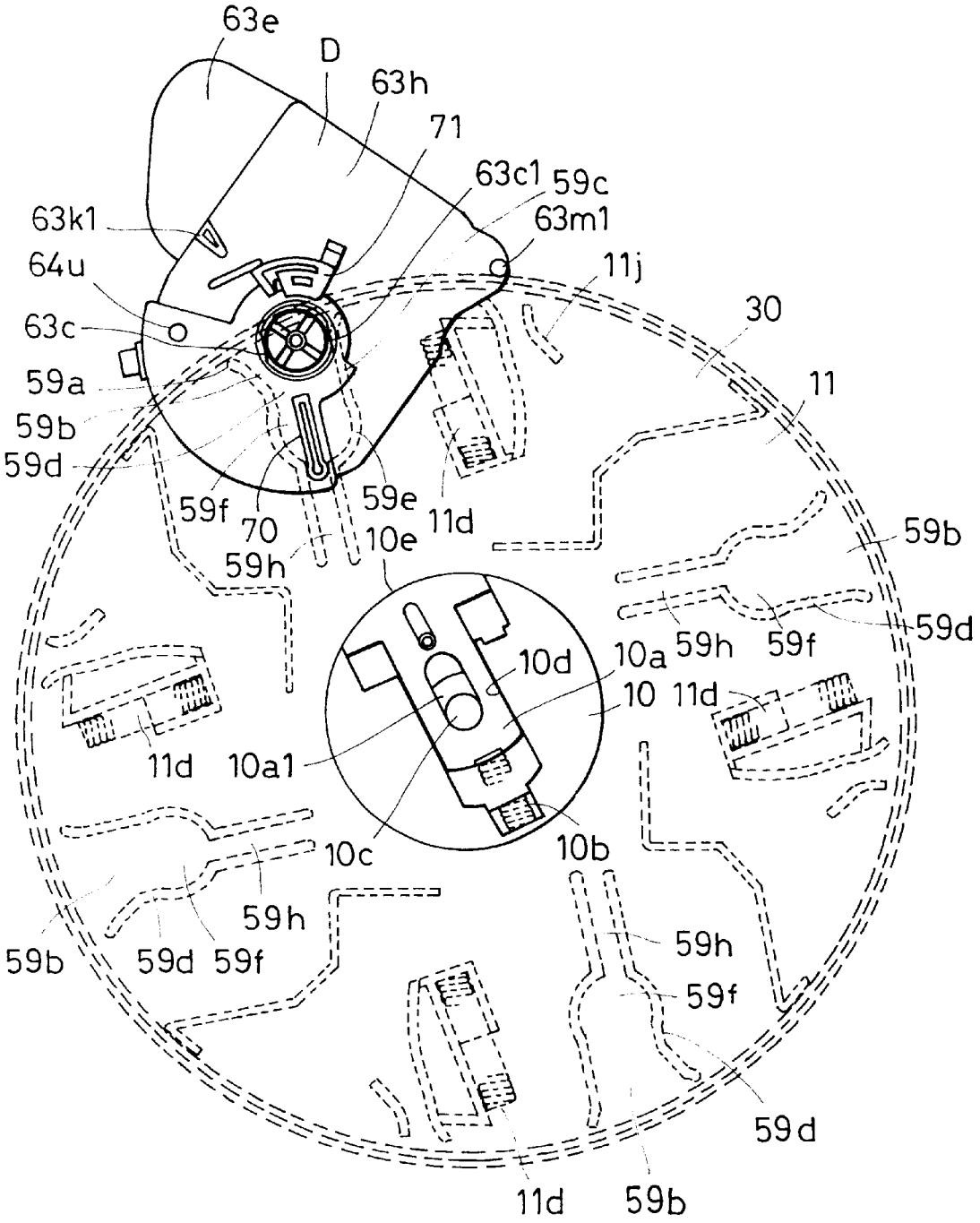
FIG. 15 is a sectional view of a rotary unit perpendicular to the axis thereof showing an operation for attaching the developing cartridge to the rotary unit.
Figure 18:
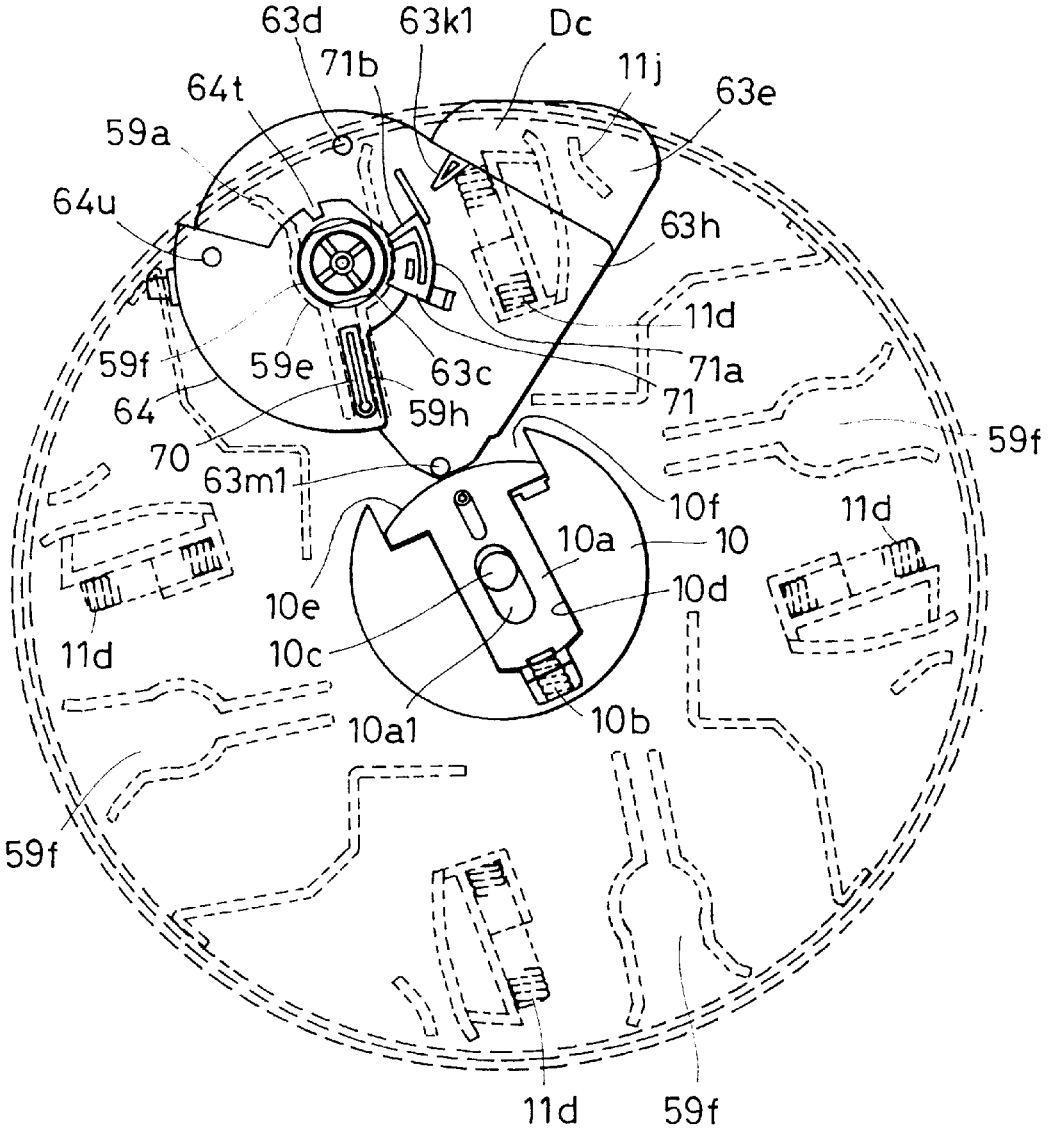
FIG. 18 is a sectional view of a rotary unit perpendicular to the axis thereof showing an operation for attaching the developing cartridge to the rotary unit.

As shown in FIGS. 13 and 14, the central shaft 10 has the sliding members 10*a* that are provided near the inner wall surface 11*e* of a flange 11*f* of one end of the rotary unit 11 and near the inner wall surface 11*a* of a flange 11*g* of the other end of the rotary unit 11 so as to move radially of the central shaft 10. As shown in FIG. 15, the sliding member 10*a* is movably fitted to guide sections 10*d* that are provided symmetrically about a straight line connecting substantially the center of the central shaft 10 and the center of the circular ribs 59*e* in the attachment position of the developing cartridge D to be substantially in parallel with the straight line. A slot 10*a*1 is formed in the sliding member 10*a* in parallel with the guide sections 10*d*, and a pin shaft 10*c* fixed to the central shaft 10 is fitted to the slot 10*a*1 so that the sliding member 10*a* is located at a position to form a continuous single circle on the outer periphery of the central shaft 10 by its front-end circular face 10*e*, as shown in FIG. 15, and at a position to form a recess 10*f* having the front-end circular face 10*e* as a bottom in the central shaft 10, as shown in FIG. 18. The helical compression spring 10*b* is provided in a compressed manner between the bottom of the guide sections 10*d* and a rear end of the sliding member 10*a*. The width (the size perpendicular to a straight line connecting the center of the central shaft 10 and the center of the circular ribs 59*e*, and parallel with the plane of FIG. 18) of the front-end circular face 10*e* of the sliding member 10*a* is set such that the positioning bosses 63*m*1 and 63*m*2 of the developing cartridge D are located on the front-end circular face 10*e* with the developing cartridge D being attached to an attachment section by an operation described hereinbelow.

In inserting the developing cartridge D into the apparatus main body 30, the user first inserts the guide section 70 provided on the shutter 64 and the projection 63*c* provided on a toner frame 63B into the guide insertion section 59*b* (see FIG. 15).

Figure 16:
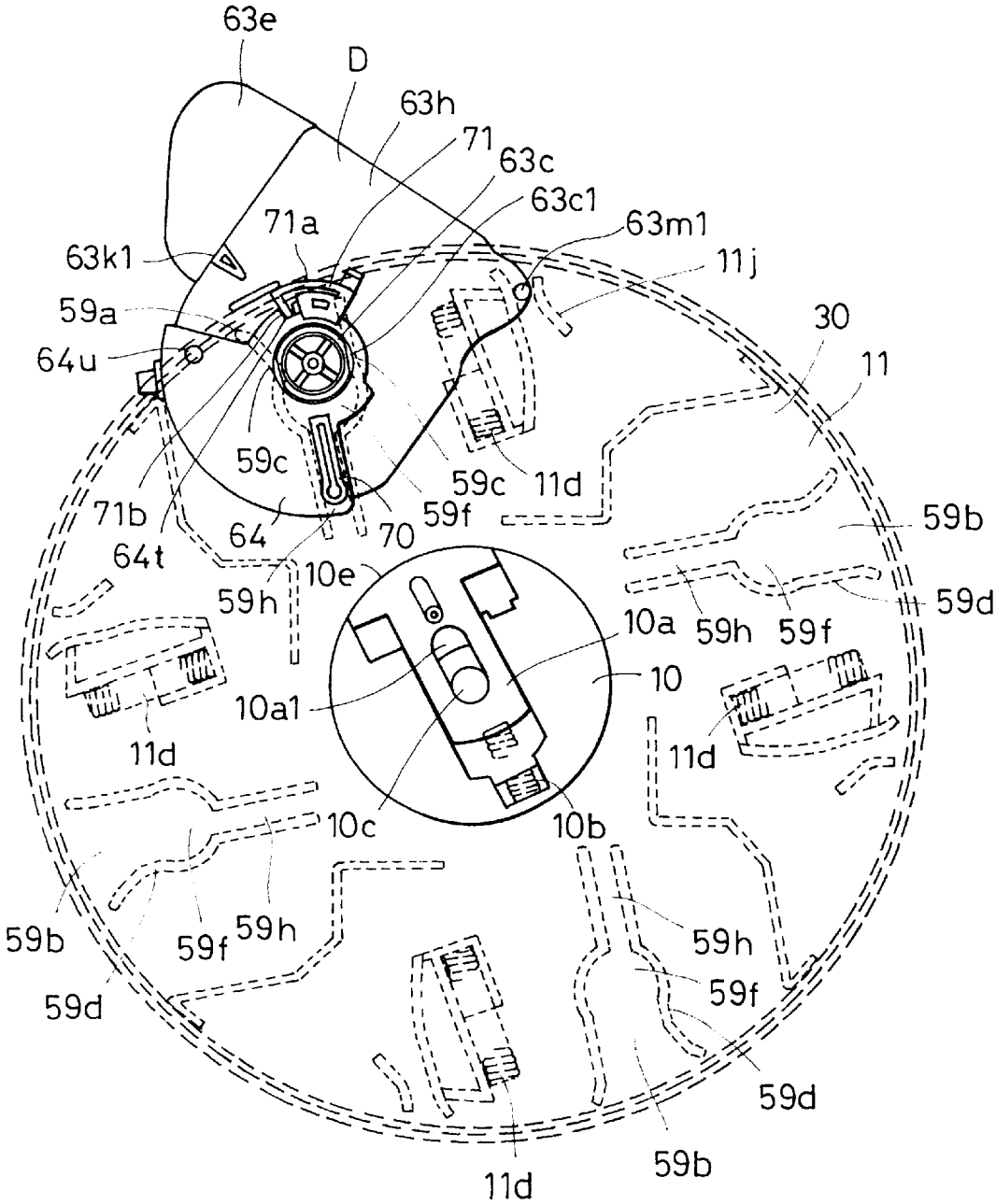
FIG. 16 is a sectional view of a rotary unit perpendicular to the axis thereof showing the operation for attaching the developing cartridge to the rotary unit.

When the developing cartridge D is further inserted, the projection 63*c* enters into the linear portion of the projection insertion section 59*d*, as shown in FIG. 16. The projection 63*c* has cut sections 63*c*1, each formed by partially and linearly cutting a cylinder at an angle parallel to each of the linear ribs 59*c* so as to have a flat width thereacross, and the two linear ribs 59*c* into which the cut sections 63*c*1 are fitted have a width W1 shown in FIG. 14 through which the cut sections 63*c*1 can pass only in the direction of parallel movement thereof. Therefore, the cut sections 63*c*1 are fitted and inserted between the linear ribs 59*c*, whereby the developing cartridge D is inserted into the apparatus main body 30 while maintaining a predetermined angle.

Figure 17:
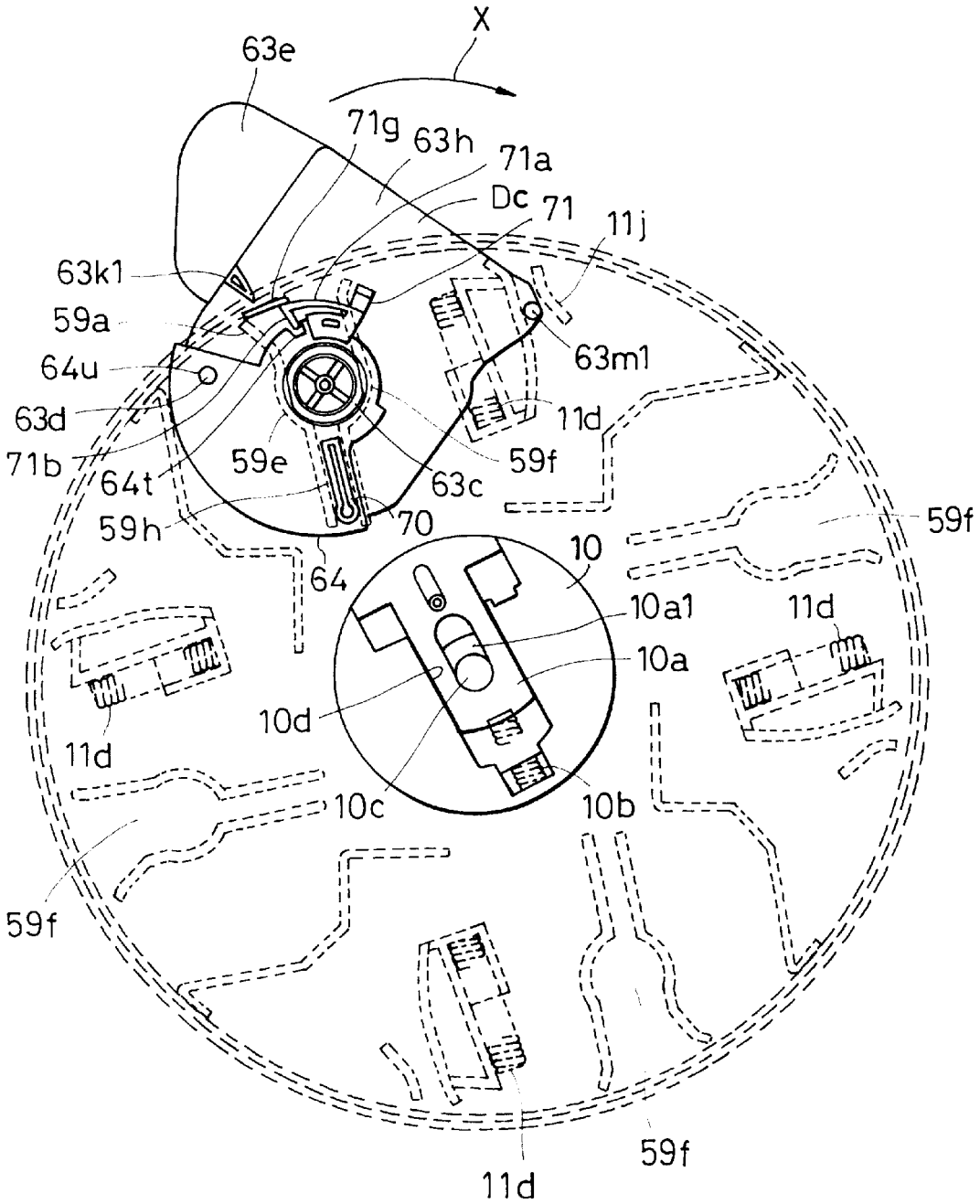
FIG. 17 is a sectional view of a rotary unit perpendicular to the axis thereof showing the operation for attaching the developing cartridge to the rotary unit.

When the projection 63*c* is inserted to reach the circular ribs 59*e*, as shown in FIG. 17, a terminal end of one of the inclined parts 59*a* abuts against the arm section 71*g* of the locking member 71 locking the shutter 64 to push it upward, as shown in FIG. 17. This allows the support section 71*a* to be elastically deformed, and the engagement section 71*b* comes out of the engagement recess 64*t*, so that the shutter 64 is unlocked. (That is, in this embodiment, the inclined sections 59*a* also have a function of unlocking the locking member 71). In this state, the shutter 64 can be rotated with respect to the cartridge frame 63. In addition, each circular rib 59*e* has a radius such that the projection 63*c* can rotate therein, whereby the developing cartridge D can be rotated about the projection 63*c*.

On the other hand, the projection 63*g* provided on the other side surface 63*i* of the developing cartridge D is guided by an inclined section 26*c* of the guide 26 shown in FIG. 13 to enter a guide insertion section 26*d*. When the developing cartridge D is further inserted, as in the case of the projection 63*c*, cut sections 63*g*3 (see FIG. 8) oppose each other in parallel, and are fitted and inserted between two linear ribs 26*e*, so that the developing cartridge D is inserted into the apparatus main body 30 while maintaining a predetermined angle. The projection 63*g* is inserted to reach the circular rib 26*a*. The circular rib 26*a* has a radius so that the projection 63*g* can rotate therein. Accordingly, the developing cartridge D can be rotatably supported about the projections 63*c* and 63*g* by the rotary unit 11 with the projection 63*c* on one side end of the cartridge frame 63 supported by the circular ribs 59*c*, and with the projection 63*g* on the other side end of the cartridge frame 63 supported by the circular rib 26*a*.

In the attachment of the developing cartridge D to the rotary unit 11, a configuration for securely attaching the developing cartridges Dm, Dc, Dy, and Db to cartridge attachment sections 14*m*, 14*c*, 14*y*, and 14*b*, respectively, will be described later.

When the user manually pushes the grip 63*e* of the cartridge frame 63 in the state shown in FIG. 17, the shutter 64 is fixed because the guide section 70 is fitted to a guide section-insertion section 59*h*. The projection 63*c* of the cartridge frame 63, however, can be rotated within the circular ribs 59*e*, and the projection 63*g* can be rotated within the circular rib 26*a*, so that the hemispherical projection 63*d* rotates to a predetermined position (in the direction shown by the arrow X in FIG. 17) passing over the hole 64*u* of the shutter 64. As mentioned above, in this embodiment, since the shutter 64 is provided with the guide section 70, the cartridge frame 63 can be easily rotated with the shutter 64 fixed. When the cartridge frame 63 is rotated to a predetermined position, it is positioned by positioning means described hereinbelow and the developing cartridge D is attached.

Figure 19:
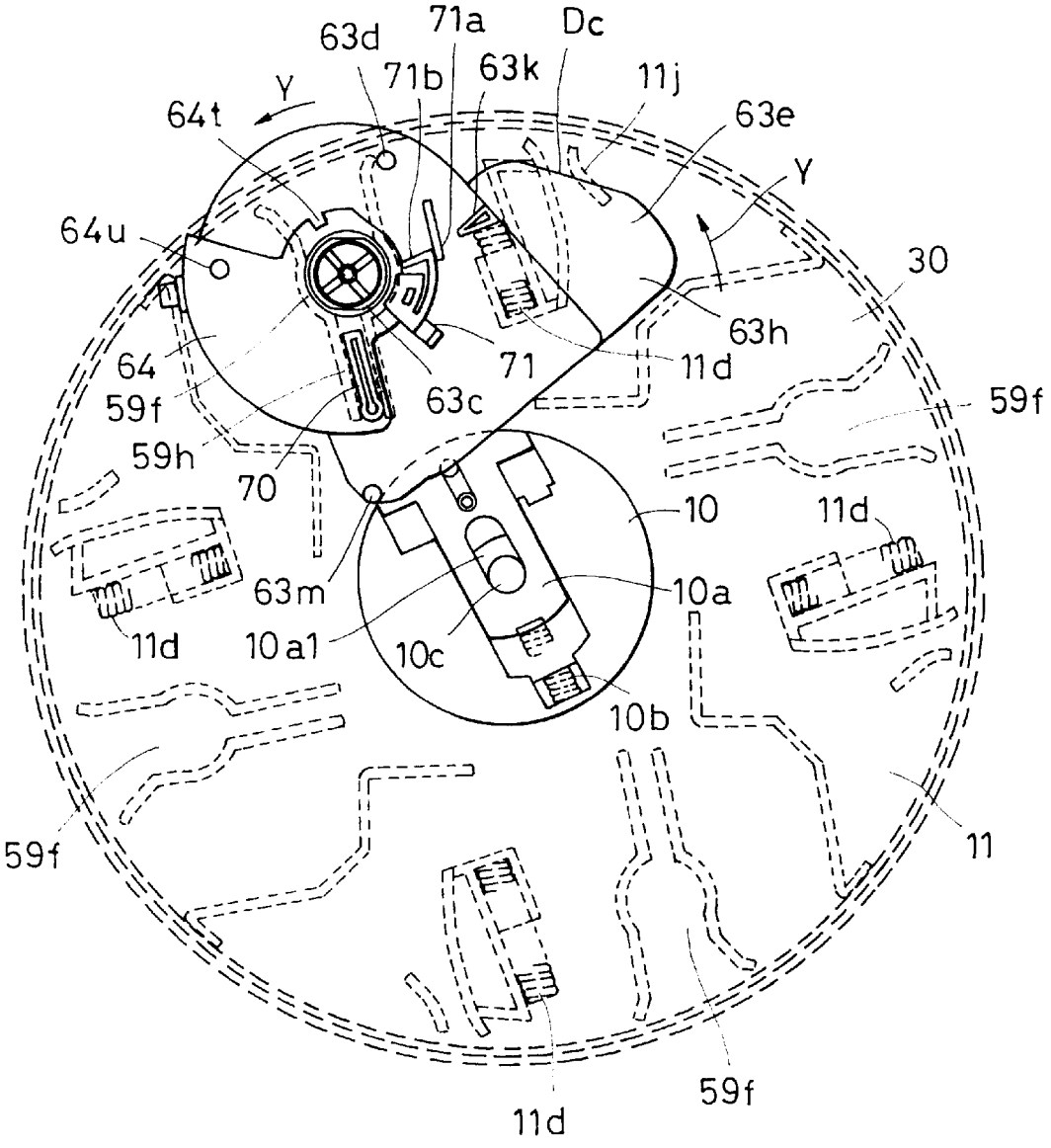
FIG. 19 is a sectional view of a rotary unit perpendicular to the axis thereof showing the operation for attaching the developing cartridge to the rotary unit.

In rotating the developing cartridge D in the state shown in FIG. 17 in the direction of the arrow X, the positioning bosses 63*m* (63*m*1 and 63*m*2) provided on both longitudinal side surfaces 63*h* and 63*i* of the cartridge frame 63 press the sliding member 10*a* that is movably fitted between guide sections 10*d* provided on both sides of the central axis 10 and biased by the helical compression spring 10*b* over the diameter of the central axis 10 downward (see FIG. 18). The pin shaft 10*c* fixed to the central shaft 10 is fitted into the slot 10*a*1, so that the sliding member 10*a* can slide in a constrained manner. That is, the front-end circular face 10*e* of the sliding member 10*a* is flush with the outer periphery of the central shaft 10 with the pin shaft 10*c* abutting against one end of the slot 10*a*1. When the cartridge 63 is further rotated, as shown in FIG. 19, the spring receivers 63*k* (63*k*1 and 63*k*2) provided longitudinally on both side surfaces 63*h* and 63*i* are pressed by helical compression spring 11*d* provided on both ends of the rotary unit 11. This applies a rotating force in the direction shown by the arrow Y in FIG. 19 to the cartridge frame 63. Both of the positioning bosses 63*m*, however, abut against the sliding member 10*a*, and the cartridge frame 63 is stable at an attachment position shown in FIG. 19.

That is, the developing cartridge D is attached to a predetermined attachment position of the rotary unit 11. Guide sections 11*j* are provided on the rotary unit 11 to guide the bosses 63*m*.

With the described arrangement, the shutter 64 is opened with respect to the cartridge frame 63 to expose the developing roller 12 so as to oppose the photoconductive drum 1. The user can recognize a rotation start position of the developing cartridge D by a clicking sensation made by the hemispherical projection 63*d* when coming out of the hole 64*u*.

Since the diameter of a cylindrical part 63*c*2 of the projection 63*c* is longer than the distance between the cut sections 63*c*1, the projection 63*c* does not come out between the linear ribs 59*c* in a state where it is rotated at the position of the circular ribs 59*e*.

Similarly, since the diameter of a cylindrical part 63*g*4 of the projection 63*g* is longer than the distance between the cut sections 63*g*3, the projection 63*g* does not come out between the linear ribs 26*e* in a state where it is rotated at the position of the circular rib 26*a*.

On the other hand, in detaching the developing cartridge D from the apparatus main body 30, the user rotates the cartridge frame 63 in the opposite direction, whereby the cut sections 63*c*1 are in parallel with the linear ribs 59*c* and the shutter 64 is closed. At this time, the user can recognize a rotation end position (detachment position) of the developing cartridge D by a click sensation made by the hemispherical projection 63*d* when it is fitted into the hole 64*u*. When the developing cartridge D is pulled out of the apparatus main body 30 in this state, the support section 71*a* of the locking member 71 elastically returns, whereby the engagement section 71*b* enters into the engagement recess 64*t*, as shown in FIG. 16. This allows the shutter 64 to be locked automatically.

As described above, the developing cartridge D is provided with the shutter 64, thereby preventing dust, etc. from adhering to the developing roller 12. In addition, the shutter 64 is provided with a locking mechanism, thereby preventing the shutter 64 from being accidentally opened.

The shutter 64 is kept closed when inserting the developing cartridge D into the apparatus main body 30, so that the developing roller 12 is not damaged in the middle of the insertion. In addition, unlike conventional developing cartridges, no labor is required in which the user manually removes a developing roller-protecting member, etc. before inserting the developing cartridge.

Further, in the attachment of the developing cartridge D to the apparatus main body 30, the shutter 64 is automatically unlocked, and the shutter 64 is opened and the developing roller 12 opposes the photoconductive drum 1 to complete the attachment only by rotating the developing cartridge D after the insertion thereof. Therefore, attachment operability of the developing cartridge D is improved.

(Positioning of Developing Cartridge)

Positioning of the developing cartridge D will now be described.

Figure 20:
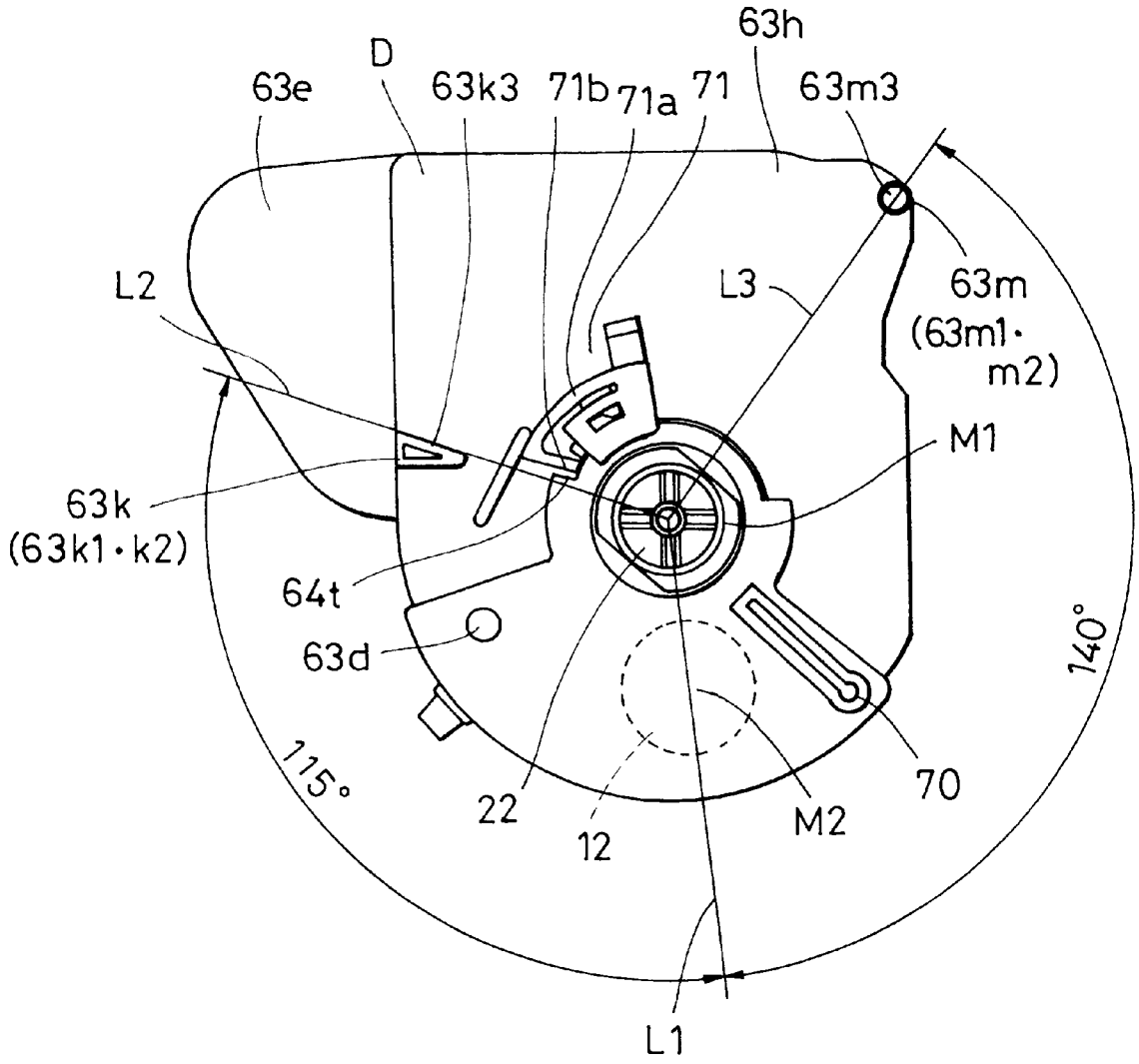
FIG. 20 is a side view showing the relationship between a guide and a positioning member of the developing cartridge.

The arrangement of the spring receivers 63*k* (63*k*1 and 63*k*2) and the positioning bosses 63*m* (63*m*1 and 63*m*2) will first be described with reference to FIG. 20.

While the arrangement on one side surface 63*h* of the cartridge frame 63 will be described in relation to the longitudinal direction of the developing roller 12, the arrangement is similar to that on the other side surface 63*i*.

In this embodiment, the spring receivers 63*k* (63*k*1 and 63*k*2), as viewed longitudinally of the developing roller 12, are arranged within the range of about 110° to 130° with respect to a straight line L1 connecting the center of rotation M2 of the developing roller 12 and the center of rotation M1 of the driving force receiver member 22 about the center of rotation M1.

More specifically, the spring receiver 63*k*1 (63*k*2) is arranged so that an angle formed between a straight line L1 connecting the center of rotation M2 of the developing roller 12 and the center of rotation M1 of the driving force receiver member 22 and a straight line L2 connecting a spring receiver face 63*k*3 (located radially on a plane about the center of rotation M1) and the center of rotation M1 is within the range of about 100° to 130°. In this embodiment, the angle is set to about 115°.

In addition, the bosses 63*m* (63*m*1 and 63*m*2) are arranged within the range of about 130° to 150° on the opposite side of the spring bearing 63*k* with respect to the straight line L1.

More specifically, the bosses 63*m* (63*m*1 and 63*m*2) are arranged so that an angle formed between the straight line L1 and a straight line L3 connecting a center 63*m*3 of the bosses 63*m* (63*m*1 and 63*m*2) and the center of rotation M1 is within the range of about 130° to 150°. In this embodiment, the angle is set to about 140°.

By arranging the spring receivers 63*k* (63*k*1 and 63*k*2) and the bosses 63*m* (63*m*1 and 63*m*2) as described above, the spring receivers 63*k* (63*k*1 and 63*k*2) can advantageously receive a resilient force of the helical compression springs 11*d* provided on the rotary unit 11. In addition, the bosses 63*m* can advantageously abut against the sliding member 10*b* provided on the central shaft 10. Accordingly, the developing cartridge D can be accurately positioned on the attachment position.

The bosses 63*m* (63*m*1 and 63*m*2) project outward by about 2 mm to 5 mm from the side surfaces 63*h* and 63*i* of the cartridge frame 63. In this embodiment, the bosses 63*m* (63*m*1 and 63*m*2) project by about 4 mm.

In addition, the spring receivers 63*k* (63*k*1 and 63*k*2) project outward by about 2 mm to 20 mm from the side surfaces 63*h* and 63*i* of the cartridge frame 63. In this embodiment, the spring receiver 63*k*1 projects by about 10 mm, and the spring receiver 63*k*2 projects by about 6 mm. That is, the amount of projection of the spring receiver 63*k*1 provided on the side of the driving force receiver member 22 is larger than that of the spring receiver 63*k*2.

(Drive Section of Development Cartridge)

A configuration for the transmission of the driving force from the apparatus main body 30 to the developing cartridge D will now be described.

Figure 22:
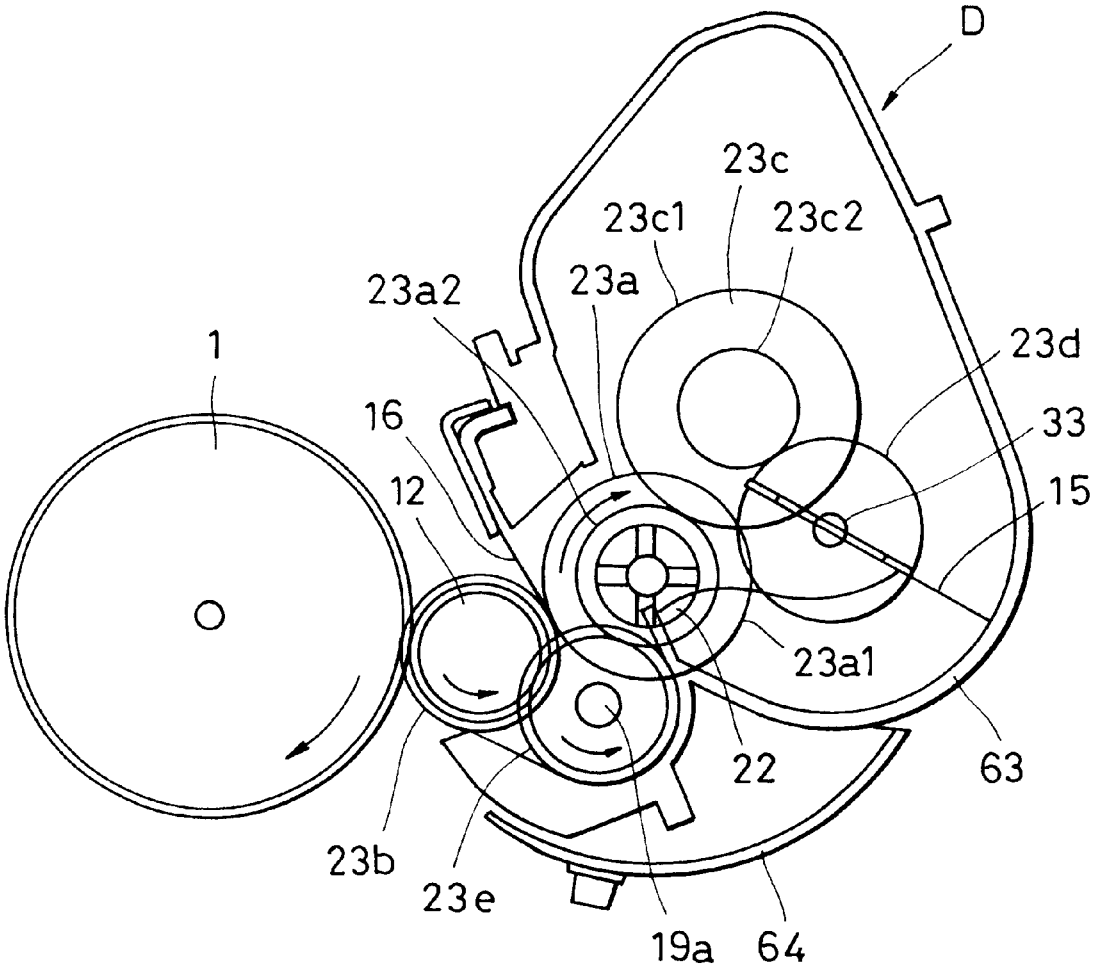
FIG. 22 is a side view showing the driving device of the developing cartridge.

As shown in FIGS. 21 and 22, the driving force receiver member 22 is provided in the cylindrical projection 63*c* for transmitting a rotational driving force from the apparatus main body 30 to the developing roller 12, and a stepped driving gear 23*a* is integrally formed with the driving force receiver member 22. A development roller gear 23*b* meshes with a large gear 23*a*1 of the gear 23*a* to rotate the developing roller 12 when the driving force is transmitted to the driving force receiver member 22. In addition, a small gear 23*a*2 of the gear 23*a* meshes with a large gear 23*c*1 of a stepped idler gear 23*c*, and a small gear 23*c*2 of the stepped idler gear 23*c* meshes with an agitation gear 23*d* integrally molded with a journal 33 (see FIG. 31), which is a rotation shaft of the toner feeding member 15, so as to also transmit the rotating force to the toner feeding member 15. In addition, an application roller gear 23*e* fixed to a rotation shaft 19*a* of the application roller 19 meshes with the small gear 23*a*2.

The head of the driving force receiver member 22 is formed in the shape of a projected cross rib, and this portion is further formed into a coupling shape so as to be coupled to a drive-transmission member of the apparatus main body 30 described hereinbelow.

On the other hand, as shown in FIG. 21, a drive-transmission member 24 for transmitting the driving force from the motor 24M is provided outside the rotary unit 11 to coaxially oppose the driving force receiver member 22 in a state where the developing cartridge D is attached to the apparatus main body 30. A transmission mechanism for transmitting a driving force from the motor 24M to the drive-transmission member 24 is schematically shown by the double-dot chain line. The drive-transmission member 24 is provided so as to move toward the rotation shaft of the driving force receiver member 22, as shown by the arrow a in FIG. 21, and the head thereof is formed into a coupling shape so as to be fitted to the rib of the driving force receiver member 22. The "coupling shape" refers to a shape formed such that both of the driving force receiver member 22 and the drive-transmission member 24 engage with each other when the drive-transmission member 24 axially moves to the driving force receiver member 22, and both members 22 and 24 are integrally rotated with each other when one of them is rotated. In this embodiment, four recesses 22*a* are formed in the driving force receiver member 22, while four projections 24*a* are formed on the drive-transmission member 24. Therefore, the drive-transmission member 24 is rotated with the projections 24*a* fitted to the recesses 22*a*, whereby the driving force receiver member 22 is rotated.

In the image formation, the arrangement is such that when the attached developing cartridge D is moved to a developing position for the image formation by the rotation of the rotary unit 11, the drive-transmission member 24 is moved toward the driving force receiver member 22 by a moving mechanism (not shown) so as to be coupled to the driving force receiver member 22 to transmit the driving force to the developing roller 12, etc. With the described arrangement, the driving force is transmitted to the developing cartridge D always from the same position, and only a driving torque produced by coupling is transmitted even if the stop position of the developing cartridge D is more or less shifted relative to the photoconductive drum 1, or even if generating lines of the photoconductive drum 1 and the rotary unit 11 deviate from each other. Therefore, it is possible to reduce pitch variations, etc., caused by improper engagement of the gears.

A configuration for stabilizing a pressing force of the developing roller 12 to the photoconductive drum 1 will now be described with reference to FIGS. 23 and 24. In these drawings, components performing functions similar to those of the driving members shown in FIG. 22 are indicated by the same reference numerals, and a description thereof will be omitted.

As described above, the developing cartridge D receives the driving force transmitted from the drive-transmission member 24 provided in the apparatus main body 30 at the development position via the driving force receiver member 22.

Figure 23:
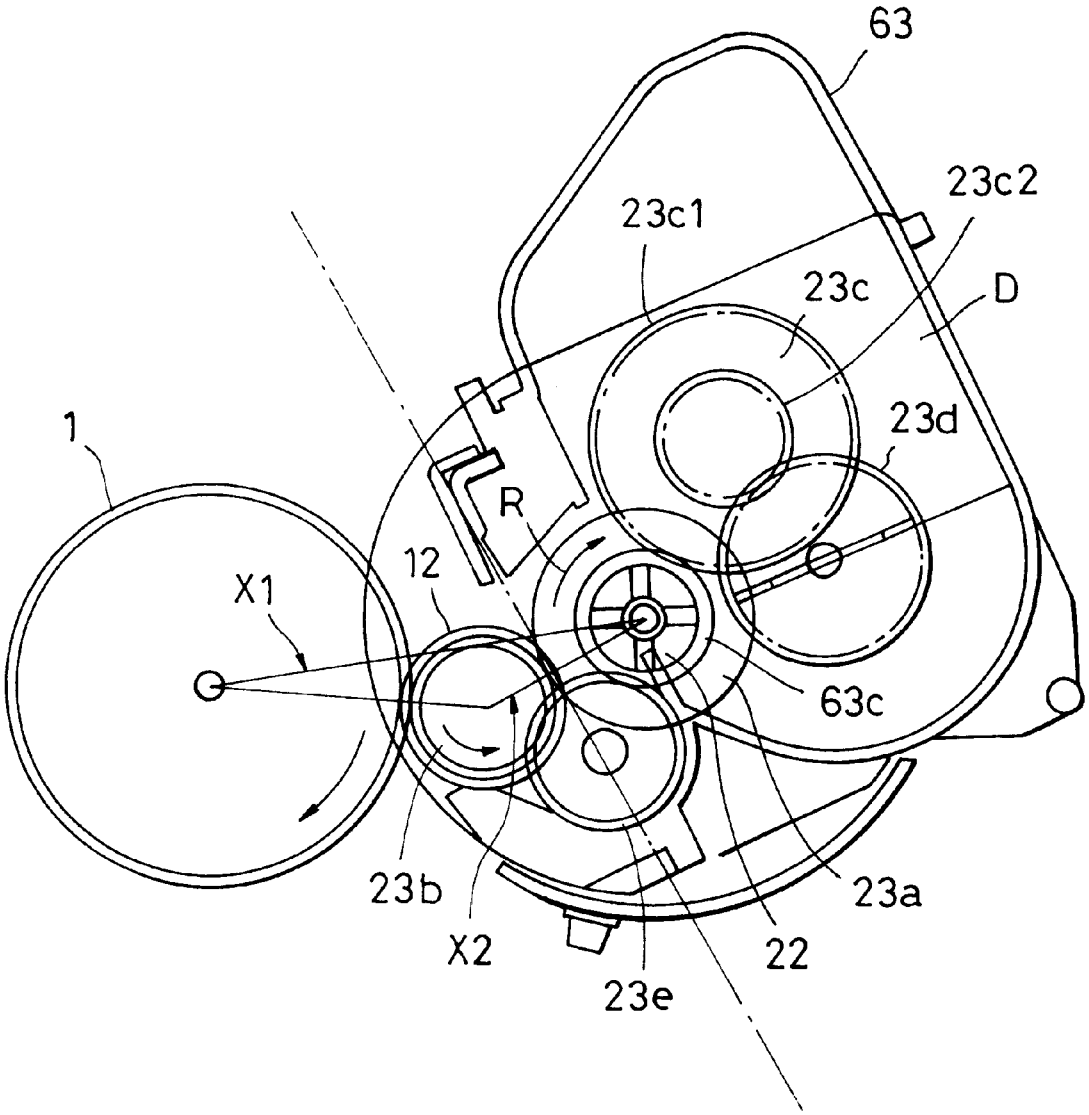
FIG. 23 is a side view showing a preferred arrangement of driving members of the developing cartridge.

When the developing cartridge D is located at the development position, as shown in FIG. 23, if a straight line connecting the center of rotation of the developing cartridge D about the projection 63*c* and the center of rotation of the photoconductive drum 1 is taken as X1, and a straight line connecting the center of rotation of the projection 63*c* and the center of rotation of the developing roller 12 is taken as X2, the straight line X2 is located upstream of the straight line X1 as viewed from the center of rotation of the projection 63*c*.

With the described arrangement, the developing cartridge D receives rotation moment in the direction of R, and a force is always exerted on the developing roller 12 in a direction to be urged into the photoconductive drum 1, and the developing roller 12 is arranged in such a manner as to be urged into the photoconductive drum 1. Therefore, the developing roller 12 is always stably pressed toward the photoconductive drum 1, thereby performing stable development. This fact is effective in so-called contact development, but is particularly effective in non-contact development because a stable gap is maintained between the photoconductive drum 1 and the developing roller 12.

Figure 24:
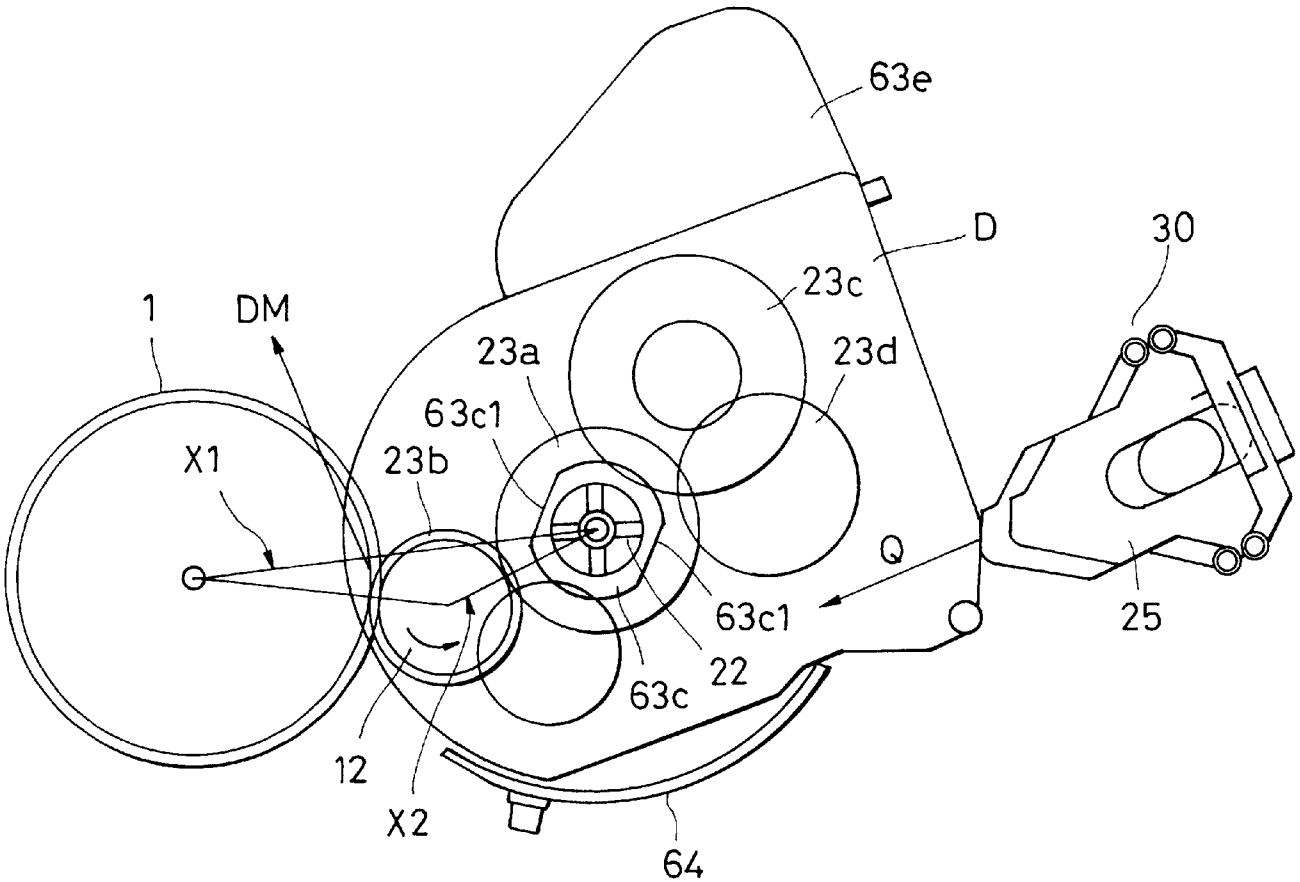
FIG. 24 is a side view of a preferred arrangement of driving members of the developing cartridge.

In addition, as shown in FIG. 24, in the case where the urging means 25 for urging and fixing the developing cartridge D to the photoconductive drum 1 is provided when the developing cartridge D is located at the development position, if a direction of moment generated by an urging direction Q of the urging means 25 on the developing cartridge D is taken as DM, a straight line connecting the center of rotation of the developing cartridge D and the center of rotation of the photoconductive drum 1 is taken as X1, and a straight line connecting the center of rotation of the projection 63*c* and the center of rotation of the developing roller 12 is taken as X2, the straight line X2 is located upstream of the straight line X1 with respect to the direction of moment DM as viewed from the center of rotation of the projection 63*c*. Such an arrangement may provide advantageous effects similar to the foregoing arrangement. The urging means 25 is located longitudinally at both ends of the developing cartridge D to press a rear portion of the toner storage section 63*a*.

(Means for Improving Operability of Developing Cartridge)

The developing cartridges D (Dm, Dc, Dy, and Db) have the same mounting features, such as mounting shapes and dimensions, and can at least be attached to a plurality of cartridge attachment sections 14 (14*m*, 14*c*, 14*y*, and 14*b*) of the rotary unit 11. By preventing the developing cartridge, other than that to be attached to one of the cartridge attachment sections 14 of a predetermined color, from being attached to the cartridge attachment section, operability of the user attaching the developing cartridge to the cartridge attachment section can be improved. As shown in FIGS. 2, 3, 13, and 14, the rotary unit 11 has disk-like flanges 11*f* and 11*g* formed on both ends thereof, and the center of the flanges 11*f* and 11*g* is supported by the central shaft 10. The cartridge attachment sections 14 are equally provided circumferentially on the rotary unit 11. In this embodiment, the four cartridge attachment sections 14*m*, 14*c*, 14*y*, and 14*b* are equally provided circumferentially on the rotary unit 11 so as to be attached to the developing cartridges Dm, Dc, Dy, and Db, respectively.

Partitions 11*m*, 11*c*, 11*y*, and 11*b* for partitioning the cartridge attachment sections 14 are provided between the flanges 11*f* and 11*g* to connect them. The partitions 11*m*, 11*c*, 11*y*, and 11*b* are axially located at different positions of the rotary unit 11 on the cross section shown in FIGS. 2 and 3. The partitions 11*m*, 11*c*, 11*y*, and 11*b* have identification parts 11*m*1, 11*c*1, 11*y*1, and 11*b*1, respectively, provided at their ends near the flange 11*g* (on the side of a driving force receiver section). In FIGS. 2 and 3, the rotary unit 11 is cut by a plane perpendicular to the axis at the position of identification part 11*c*1, and the identification parts 11*y*1 and 11*b*1 are not shown in the drawings. The identification parts 11*m*1, 11*c*1, 11*y*1, and 11*b*1 are axially located at different positions of the rotary unit 11 (see FIG. 26). The identification parts 11*m*1, 11*c*1, 11*y*1, and 11*b*1 have the same recessed shape cut into the outer peripheral edges of the partitions 11*m*, 11*c*, 11*y*, and 11*b*, respectively.

Figure 26:
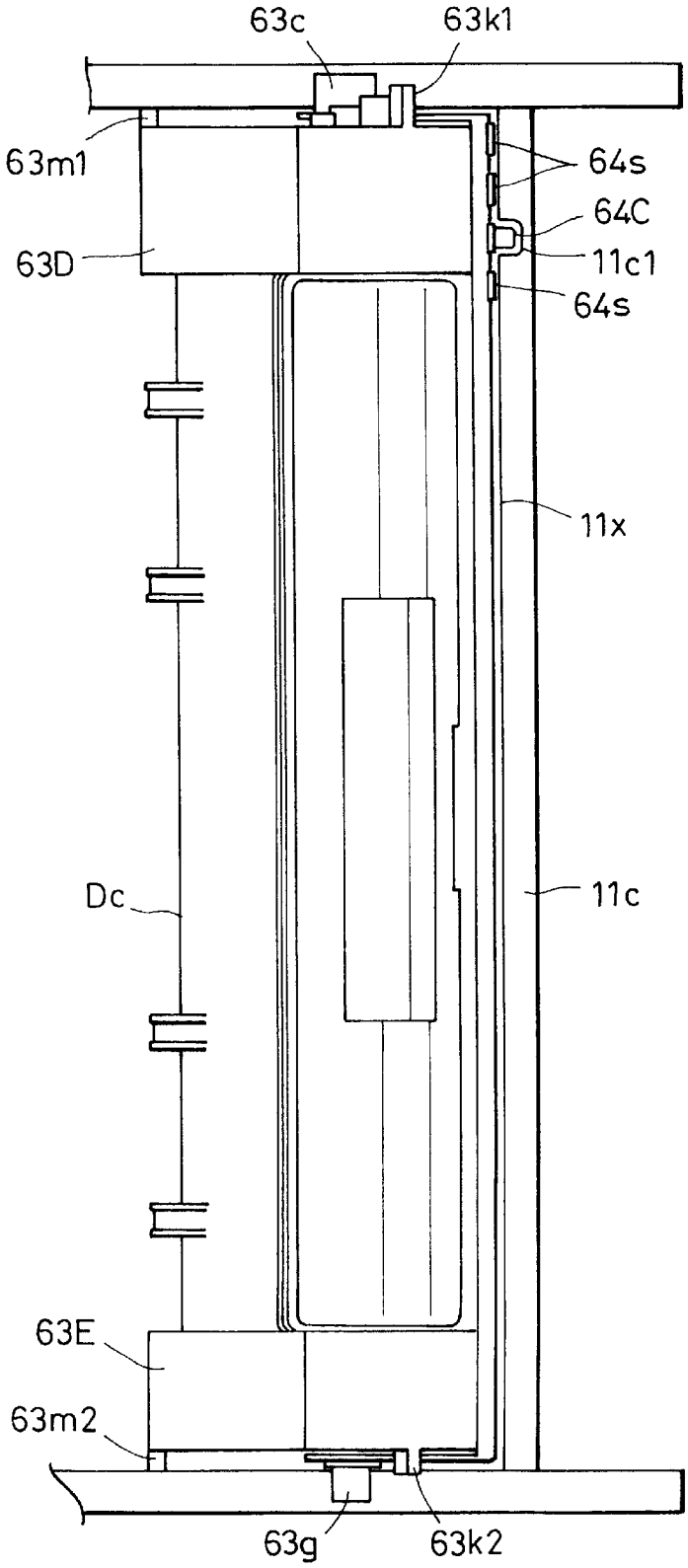
FIG. 26 is a plan view showing attachment of the developing cartridge to the rotary unit.

On the other hand, as shown in FIGS. 25 and 26, the shutters 64 (64*m*, 64*c*, 64*y*, 64*b*) of the developing cartridges D are provided with identification parts 64M, 64C, 64Y, and 64B, respectively, for identifying respective developing cartridges D (FIGS. 2 and 3 show the identification part 63C, and FIG. 25 shows the identification part 64B). These identification parts 64M, 64C, 64Y, and 64B are longitudinally provided at different positions of the cylindrical outer periphery of the shutter cover section 64*g* of the shutters 64 of the developing cartridges D to project from the outer periphery of the shutters 64 (64*m*, 64*c*, 64*y*, 64*b*). The identification parts 64M, 64C, 64Y, and 64B are substantially perpendicular to the guide section 70 directed toward substantially the center of the round holes 64*a* formed in the shutters 64 (64*m*, 64*c*, 64*y*, 64*b*) when the shutters 64 (64*m*, 64*c*, 64*y*, 64*b*) are seen longitudinally, and the center thereof coincides with the center of the round holes 64*a*. The identification parts 64M, 64C, 64Y, and 64B are collectively provided near an open end 64*h* that is an edge of the shutters 64 (64*m*, 64*c*, 64*y*, 64*b*) facing the developing roller 12, and near the longitudinal side of the driving force receiver section.

As shown in FIG. 25, four seats 64*s* capable of longitudinally and equally attaching thereto pieces 64*r* in a straight line are equally spaced on the shutters 64 (64*m*, 64*c*, 64*y*, 64*b*) in order to mount thereon the identification parts 64M, 64C, 64Y, and 64B. Each of the seats 64*s* has positioning holes 64*p* and 64*q* arranged side by side in a circumferential direction of the shutters 64 (64*m*, 64*c*, 64*y*, 64*b*). The hole 64*p* is a round hole, and the hole 64*q* is a slot elongated in the circumferential direction of the shutters 64 (64*m*, 64*c*, 64*y*, 64*b*). Each of the pieces 64*r* has a cubic shape, and projections are formed on its plane (not shown in FIG. 25) opposing each of the seats 64*s* so as to be fitted into the holes 64*p* and 64*q*. The projections are fitted into the holes 64*p* and 64*q* to position each of the pieces 64*r*, and the seat 64*s* and piece 64 are fixed by bonding.

One piece 64*r* is mounted on any one of the four seats 64*s* to form one of the identification parts 64M, 64C, 64Y, and 64B. When attaching the developing cartridges D (Dm, Dc, Dy, and Db) having the identification parts 64M, 64C, 64Y, and 64B to the cartridge attachment sections 14*m*, 14*c*, 14*y*, and 14*b*, respectively, the identification parts 64M, 64C, 64Y, and 64B can fit into the identification parts 11*m*1, 11*c*1, 11*y*1, and 11*b*1 of the cartridge attachment sections 14*m*, 14*c*, 14*y*, and 14*b* to enter into the cartridge attachment sections 14*m*, 14*c*, 14*y*, and 14*b*, respectively, as shown by one example in FIG. 26. However, all of the identification parts 64M, 64C, and 64B of the developing cartridges Dm, Dc, and Db abut against the edge of the partition 11*y* of the cartridge attachment section 14*y* without the identification part 11*y*1, so that the developing cartridges Dm, Dc, and Db cannot be attached to the cartridge attachment section 14*y* for the developing cartridge Dy.

Similarly, the developing cartridges Dy, Dc, and Db cannot be attached to the cartridge attachment section 14*m* for the developing cartridge Dm; the developing cartridges Dy, Dm, and Db cannot be attached to the cartridge section 14*c* for the developing cartridge Dc; and the developing cartridges Dy, Dm, and Dc cannot be attached to the cartridge attachment section 14*b* for the developing cartridge Db.

FIGS. 2 and 26 show a state where the developing cartridge Dc is being attached to the cartridge attachment section 14*c*. In the attachment of the developing cartridge Dc to the cartridge attachment section 14*c*, the guide section 70 of the developing cartridge Dc is inserted into the guide section-insertion section 59*h* of the cartridge attachment section 14*c*, the shutter 64 linearly enters into the cartridge attachment section 14*c* and at the same time, the developing cartridge Dc moves laterally to reach a position where the positioning bosses 63*m* (63*m*1 and 63*m*2) of the developing cartridge Dc can enter into the guide section 11*j* provided on the inner wall surface 11*a* of the drive side flange 11*g* of the rotary unit 11. In addition, the identification part 64C reaches an edge 11*x* of the partition 11*c*. However, since the edge 11*x* has the recessed identification part 11*c*1 into which only the identification part 63C can enter, the projection 63*c* is fitted into the fitting section 59*f*, the identification parts 11*c*1 and 64C fit to each other, and the bosses 63*m* (63*m*1 and 63*m*2) enter into the guide section 11*j*, so that the developing cartridge Dc is located at the position shown in FIGS. 2, 17, and 26. If the cartridge frame 63 is rotated clockwise, the developing cartridge Dc is attached to the cartridge attachment section 14*c* in such a manner as mentioned above, as shown in FIG. 3.

If the developing cartridges Dm, Dy, Db are to be attached to the cartridge attachment section 14*c* for the developing cartridge Dc, the guide sections 70 of the developing cartridges Dm, Dy, and Db can be inserted into the guide section-insertion section 59*h*. However, the identification parts 64M, 64Y, and 64B abut against the outer peripheral edge 11*x* of the partition 11*c* when the leading ends of the guide sections 70 reach the position 13 shown in FIG. 2, so that the developing cartridges Dm, Dy, and Db cannot further advance linearly. In addition, as shown in FIG. 16, since the cut sections 63*c*1 of the projection 63*c* have already entered between the linear ribs 59*c* (see FIG. 14), the developing cartridges Dm, Dy, and Db cannot be rotated. Accordingly, the developing cartridges Dm, Dy, and Db other than the developing cartridge Dc cannot be attached to the cartridge attachment section 14*c*.

Similarly, the developing cartridges Dm, Dy, and Db can be attached only to the corresponding cartridge attachment sections 14*m*, 14*y*, and 14*b*, respectively, but any other development cartridge cannot be attached.

As described above, in this embodiment, there are provided the shutters 64 (64*m*, 64*c*, 64*y*, and 64*b*) mounted on the developing cartridges D (Dm, Dc, Dy, and Db), which can be attached to and detached from the image forming apparatus main body 30 forming a multicolored image, and which develop a latent image formed on the photoconductive drum 1. The shutters 64 (64*m*, 64*c*, 64*y*, and 64*b*) are rotatably mounted on the developing cartridges D (Dm, Dc, Dy, and Db) at the longitudinal center of the cartridge frames 63 of the developing cartridges D (Dm, Dc, Dy, and Db). The shutters 64 (64*m*, 64*c*, 64*y*, and 64*b*) can move between a cover position to cover the portions of the developing rollers 12 exposed from the cartridge frames 63 when the cartridges D (Dm, Dc, Dy, and Db) are located outside the apparatus main body 30 and a retracted position to retract from the cover position so as to expose the developing rollers 12 from the cartridge frames 63 when the cartridges D (Dm, Dc, Dy, and Db) are attached to the cartridge attachment positions of the apparatus main body 30. The shutters 64 (64*m*, 64*c*, 64*y*, and 64*b*) include the identification parts 64M, 64C, 64Y, and 64B that coincide with and enter into the identification parts 11*m*1, 11*c*1, 11*y*1, and 11*b*1 formed in the apparatus main body 30 when one of the developing cartridges D (Dm, Dc, Dy, and Db) is attached to one of the developing cartridge attachment sections 14 (14*m*, 14*c*, 14*y*, and 14*b*) provided in the apparatus main body 30. The provision of such shutters 64 (64*m*, 64*c*, 64*y*, and 64*b*) on the developing cartridges D (Dm, Dc, Dy, and Db) can prevent the user from attaching an inappropriate developing cartridge to a cartridge attachment section of the apparatus main body.

Since common seats 64*s* are provided on each of the shutters 64 (64*m*, 64*c*, 64*y*, and 64*b*) in advance and the piece 64*r* is selectively attached thereto to form each of the identification parts 64M, 64C, 64Y, and 64Y, it is not particularly necessary to prepare a variety of shutters 64, thereby reducing an increase in the cost of the device.

The identification parts 64M, 64C, 64Y, and 64B, and 11*m*1, 11*c*1, 11*y*1, and 11*b*1 may be provided at places other than those on the side of the driving force receiver section, as long as the identification parts are in the longitudinal direction. In addition, these identification parts may be unequally spaced. The identification parts may be formed in any shape, as long as it is the shape of a square projection or recess.

(Configuration of Developing Frame)

As shown in FIGS. 4, 6, and 7, the cartridge frame 63 is composed of the developing member-supporting frame (main cartridge frame) 63A, a toner frame 63B, a cover frame 63C, side covers (developer cartridge side covers) 63D and 63E, and a coupling frame 63F.

As shown in FIG. 4, triangular ribs are longitudinally provided on combined surfaces 63*n* between flanges 63Aa provided laterally on both sides of the developing member-supporting frame 63A and flange 63Ba provided on the toner frame 63B, and the triangular ribs are ultrasonically welded to combine both frames 63A and 63B.

The flange 63Ba is formed to have a hooked shape in cross section so that openings 630 of the toner frame 63B and the cover frame 63C are combined to form one toner case, and a flange 63Bb having a combined surface 63*p* between the upper surface of the flange 63Bb and the cover frame 63C as one plane is provided to surround the openings 63*o*. A flange 63Cb surrounding the opening 63*o* of the cover frame 63C is brought into contact with the flange 63Bb on the combined surface 63*p* so as to be ultrasonically welded.

In addition, as shown in FIGS. 6 and 7, the side covers 63D and 63E cover the longitudinal both sides of the combined developing member-supporting frame 63A and the toner frame 63B, the side cover 63E is secured to the developing member-supporting frame 63A by screws, and the side cover 63D is secured by screws to the coupling frame 63F fixed to the developing member-supporting frame 63A, whereby all the frames form the integral cartridge frame 63.

(Developing Member-supporting Frame)

As shown in FIGS. 4, 5, 27 and 28, the developing member-supporting frame 63A project along substantially the entire length thereof from the flanges 63Aa toward a toner supply opening section 63Bc that is opened toward the developing member-supporting frame 63A. A projection front surface 63Ab has a longitudinal plane 63Ab1 whose longitudinal one end closely opposes a toner seal surface 27*a* to which the toner seal 27 is longitudinally applied with the toner seal 27 placed therebetween, and lateral planes 63Ab2 that extend laterally at both longitudinal ends of the front surface 63Ab opposite to an edge of the toner supply opening section 63Bc. The longitudinal plane 63Ab1 is flush with the lateral planes 63Ab2. Each of the lateral planes 63Ab2 consecutively forms a circular surface 63Ab3 that is coaxial with the application roller 19 and has a radius slightly larger than that of the application roller 19 immediately to the longitudinal outside of the application roller 19. Each of the lateral planes 63Ab2 and circular surface 63Ab3 has a narrow width. The longitudinal plane 63Ab1 projects perpendicularly from the flange 63Aa.

End seals 31*a* and 31*b* made of elastic members are adhered to the developing member-supporting frame 63A at both longitudinal ends of the projection front surface 63Ab. In addition, on the drawing side of the toner seal 27, a film 31*c* for reducing the friction between the toner seal 27 and the developing member-supporting frame 63A is adhered to the inner side on the end seal 31*a* (see FIG. 27). As shown in FIG. 28, an end seal-adhering surface 63Ac on which the end seal 31*a* (31*b*) is adhered is located in a position slightly retracted from the lateral plane 63Ab2 at its intermediate section, and has a shape such that both lateral ends thereof are rolled by the circular surfaces 63Ad, and is smoothly curved between the circular surfaces 63Ad and the flanges 63Aa to combine them by a circular surface. The end seal 31*a* (31*b*) is provided between the combined surfaces 63*n* where the flanges 63Aa are welded. On the other hand, the toner frame 63B has a seal surface 63Bu provided opposite to the end seal-adhering surface 63Ac for pressure-welding the end seal 31*a* (31*b*) when the developing member-supporting frame 63A and the toner frame 63B are combined opposite to the end seal 31*a* (31*b*).

An opening is formed by being surrounded by the projection front surface 63Ab, a shaft mounting section 63*q* for the application roller 19, and the longitudinal flange 63Aa. The opening passes through the developing member-supporting frame 63A, and is vertically narrowed between the cleaning blade 16 and a sheet-like seal member 34 to form a toner supply opening 63Ae facing the developing roller 12. The developing roller 12 is attached to a developing roller attachment section along the front face of the toner supply opening 63Ae (see FIG. 29).

As described above, the developing member-supporting frame 63A is a developing frame including the developing roller 12 for developing a latent image formed on the photoconductive drum 1, the toner storage section 63*a* for storing toner used by the developing roller 12 for development, and the application roller 19 for applying the toner around the developing roller 12, and is used for the developing cartridge D that can be attached to and detached from the apparatus main body 30. The developing member-supporting frame 63A includes the toner supply opening 63Ae for supplying the toner stored in the toner storage section 63*a* to the developing roller 12, the developing roller attachment section for attaching thereto the developing roller 12 along the toner supply opening 63Ae, the combined surfaces 63*n* provided longitudinally on both lateral ends of the toner supply opening 63Ae for combining the developing member-supporting frame 63A and the toner frame 63B having the toner storage section 63*a*, and a projected section formed by the projection front surface 63Ab, the shaft mounting section 63*q*, the adhering surfaces 63Ac for the end seals 31*a* and 31*b* that project in such a manner as to cut across a plane connecting the combined surfaces 63*n*.

A configuration of the developing member-supporting frame 63A on the opposite side of the toner frame 63B across the plane connecting the combined planes 63*n* will now be described.

As shown in FIG. 4, the shaft mounting section 63*q* for supporting a metallic rotation shaft 19*a* of the application roller 19 is integrally formed with the developing member-supporting frame 63A, and shaft receiver holes provided near longitudinal both ends of the developing member-supporting frame 63A into which the rotation shaft 19*a* is fitted are located closer to the developing roller 12 than the plane connecting the combined surfaces 63*n*. That is, the shaft receiver holes are located on the opposite side of the toner frame 63B with the plane connecting the combined surface 63*n* placed therebetween.

The shaft mounting section 63*q* includes a circularly recessed surface 63Ag in order to adhere a felt elastic seal member 32 of substantially uniform thickness for sealing between the development area and the outside on a portion without the spacer rollers 12*a* and 12*b* apart from both ends of the developing roller 12. The circularly recessed surface has continuously connected planes 63Ag1 that are substantially in parallel with the developing blade 16, and longitudinal both ends of an elastic blade 16*c* approaching the generating line of the developing roller 12 overlap the portion of the elastic seal member 32 adhered on the planes 63Ag1. In addition, the elastic sheet-like seal member 34, approaching the generating line of the developing roller 12 in parallel with the elastic blade 16*c*, is adhered on a seal mounting surface 63*r* having a stepped portion so as to be located higher than the circularly recessed surface 63Ag and to be brought closer to the surface of the developing roller 12 (see FIG. 28).

Figure 29:
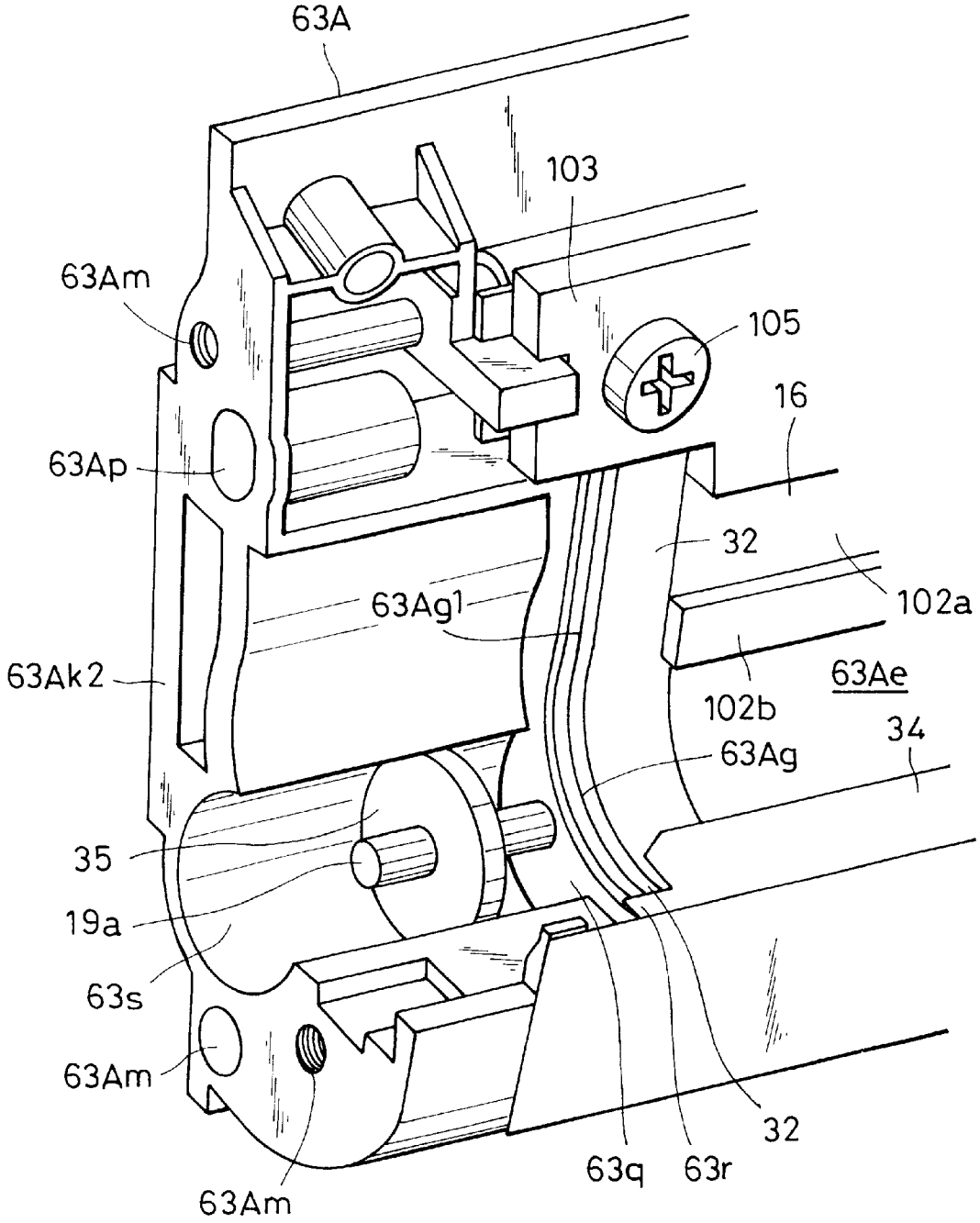
FIG. 29 is a perspective view of an end of the developing member-supporting frame.

As shown in FIG. 29, a recess 63*s* of circular cross section about the rotation shaft 19*a* of the application roller 19 is provided longitudinally on the outside of the shaft mounting section 63*q*, and a shaft seal packing 35 is provided so as to be fitted into the recess 63*c* and the rotation shaft 19*a*. The packing 35 is lightly pressed into contact with an axial outer surface of the shaft mounting section 63*q* by cylindrical projections 63Df and 63Ef (see FIG. 35, but projection 63Df is not shown therein) provided on the side cover 63D and the coupling frame 63F, respectively, which enter into the recess 63*s*, thereby performing shaft sealing operation. The above-mentioned arrangements are similar on both longitudinal ends.

The foregoing is the configuration of the developing member-supporting frame 63A for the developing cartridges Dm, Dc, and Dy. However, since the developing cartridge Db does not have the application roller 19, the developing member-supporting frame 63A thereof does not include the shaft mounting section 63*q* for mounting the rotation shaft 19*a* of the application roller 19, and the shape of a space, etc., to seal the rotation shaft. As shown in FIG. 5, a bottom 63*t* of the developing member-supporting frame 63A is formed to substantially a horizontal surface passing downward of the developing roller 12 at the development position provided opposite to the photoconductive drum 1.

Figure 27:
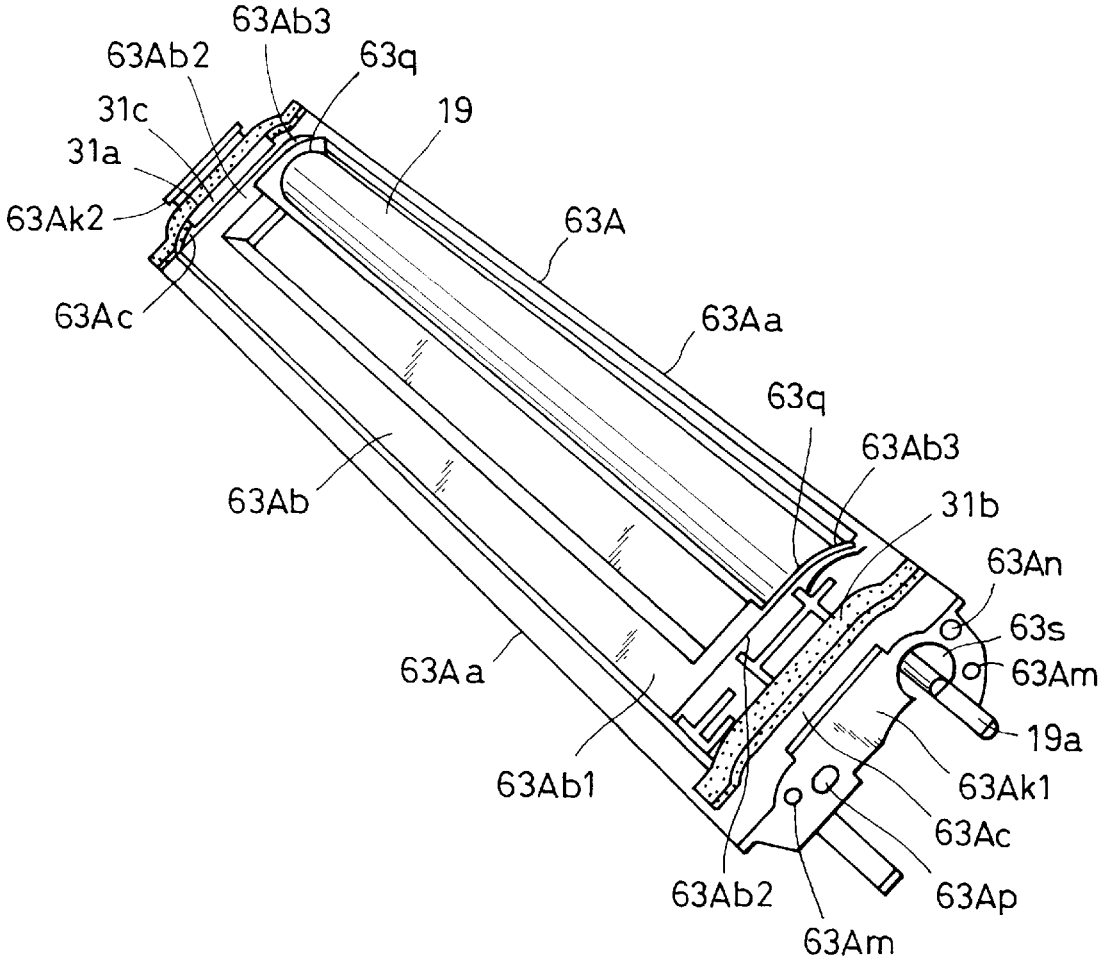
FIG. 27 is a perspective view of a developing member-supporting frame.
Figure 28:
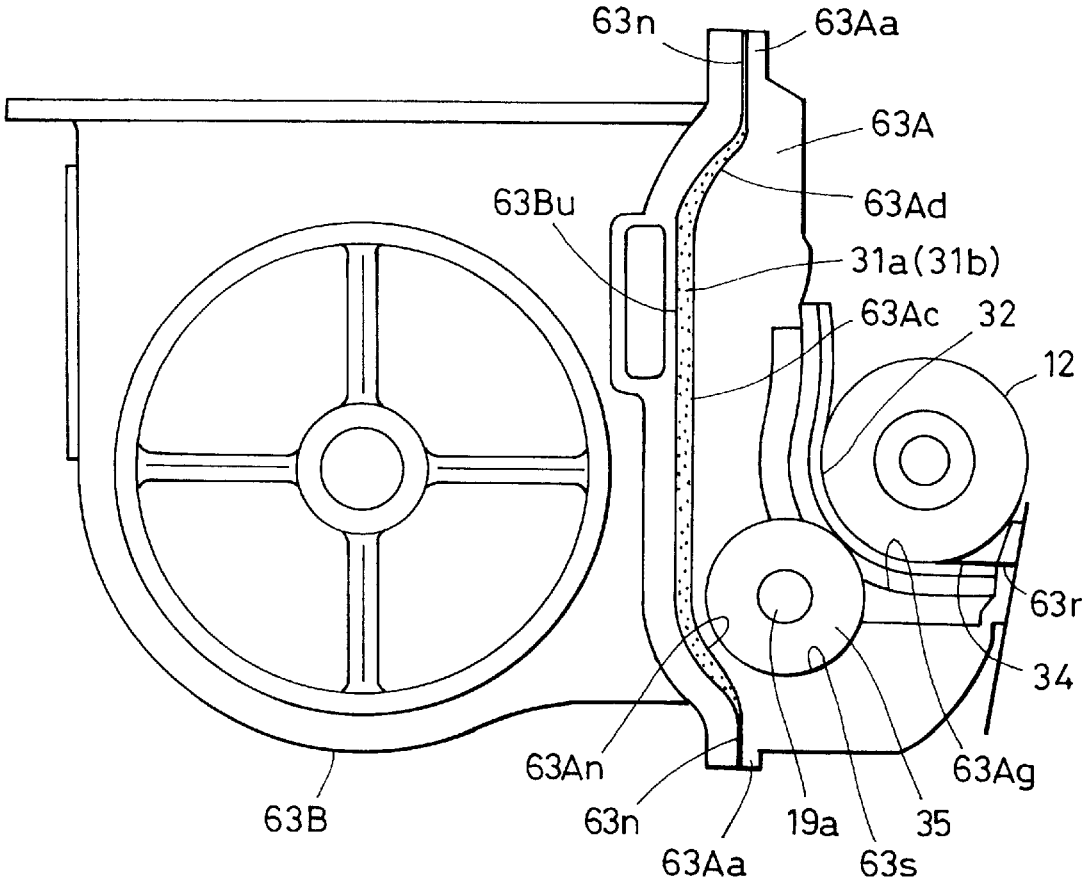
FIG. 28 is a side view of the developing member-supporting frame.

As shown in FIG. 27, bearing surfaces 63Ak1 and 63Ak2 are provided on both longitudinal ends of the developing member-supporting frame 63A so as to mount thereon the coupling frame 63F and the side cover 63E, respectively. These bearing surfaces 63Ak1 and 63Ak2 are of identical shape with each other. Each of the bearing surfaces 63Ak1 and 63Ak2 has a female screw hole 63Am, and positioning holes 63An and 63Ap. The positioning hole 63An is a round hole, and the positioning hole 63Ap is a slot of elongated section along a line connecting both holes 63An and 63Ap.

The developing member-supporting frame 63 configured as described above can allow the reduction in size of the developing cartridge as compared with a conventional configuration thereof. Alternatively, the developing cartridges of the same size can store larger amount of toner.

(Toner Frame)

As shown in FIG. 4, the combined surfaces 63*n* between the toner frame 63B and the developing member-supporting frame 63A, and the combined surface 63*p* between the toner frame 63B and the cover frame 63C are located on the planes substantially perpendicular to each other, respectively.

Figure 30:
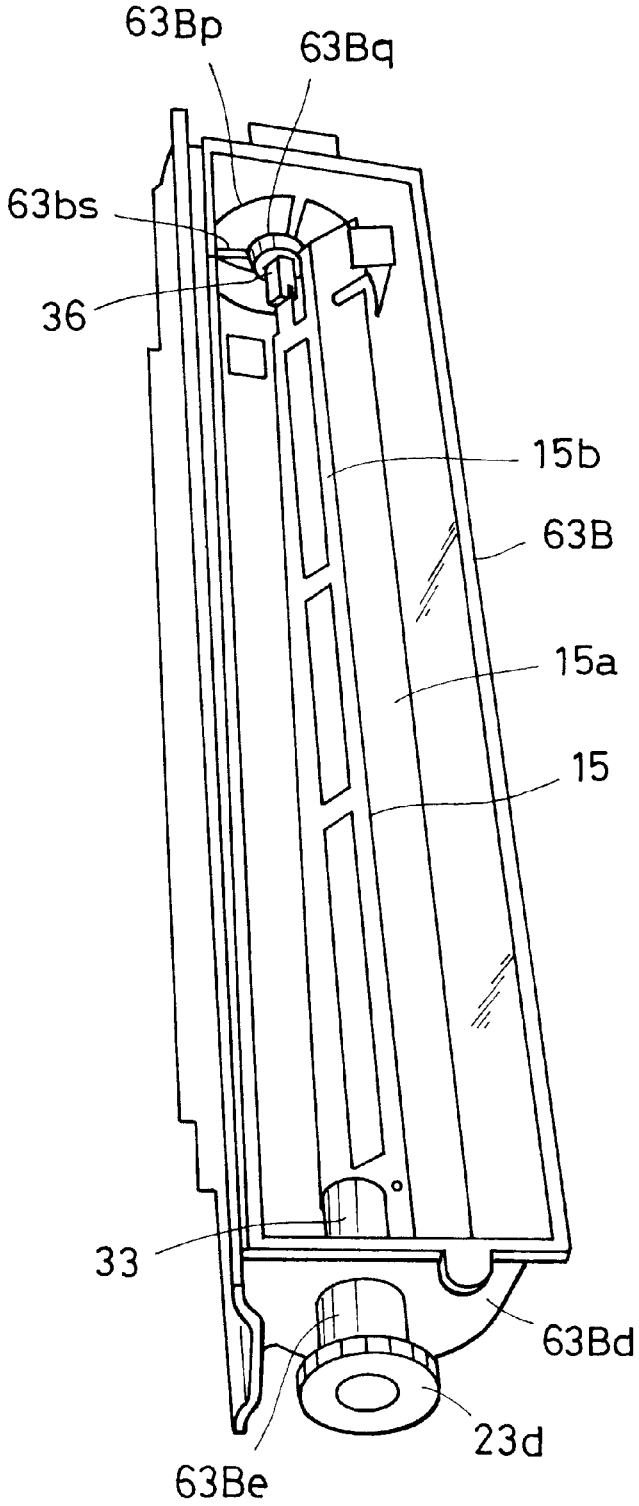
FIG. 30 is a perspective view of a toner frame.
Figure 31:
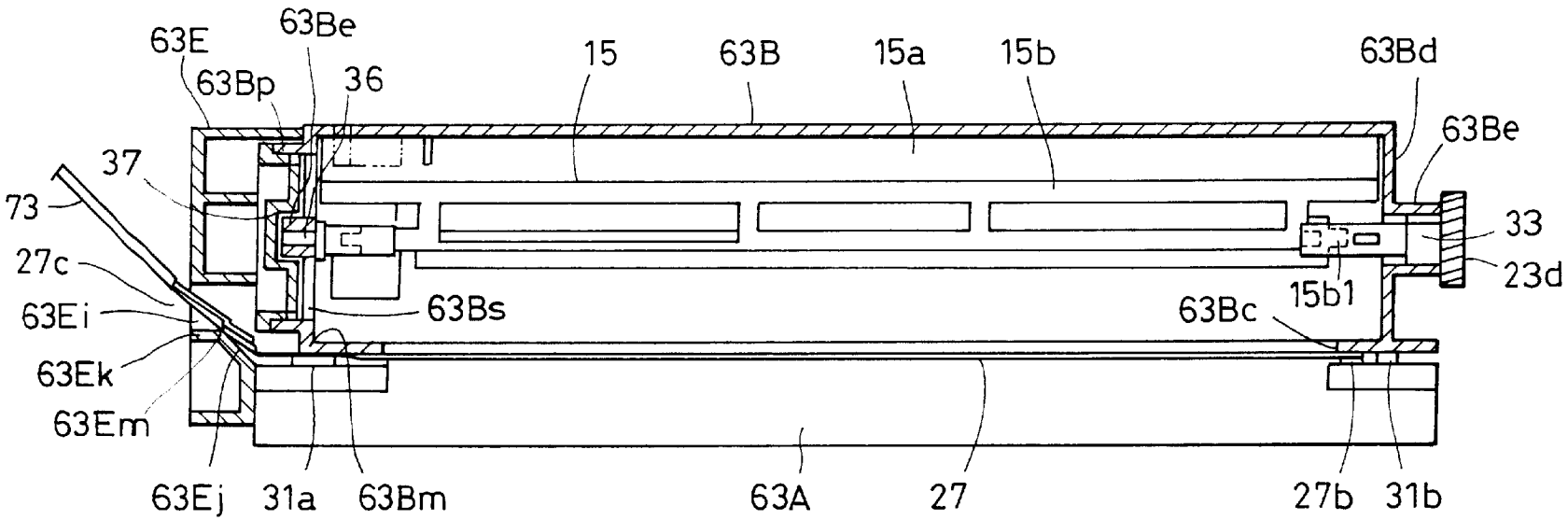
FIG. 31 is a horizontal sectional view of the toner frame.
Figure 32:
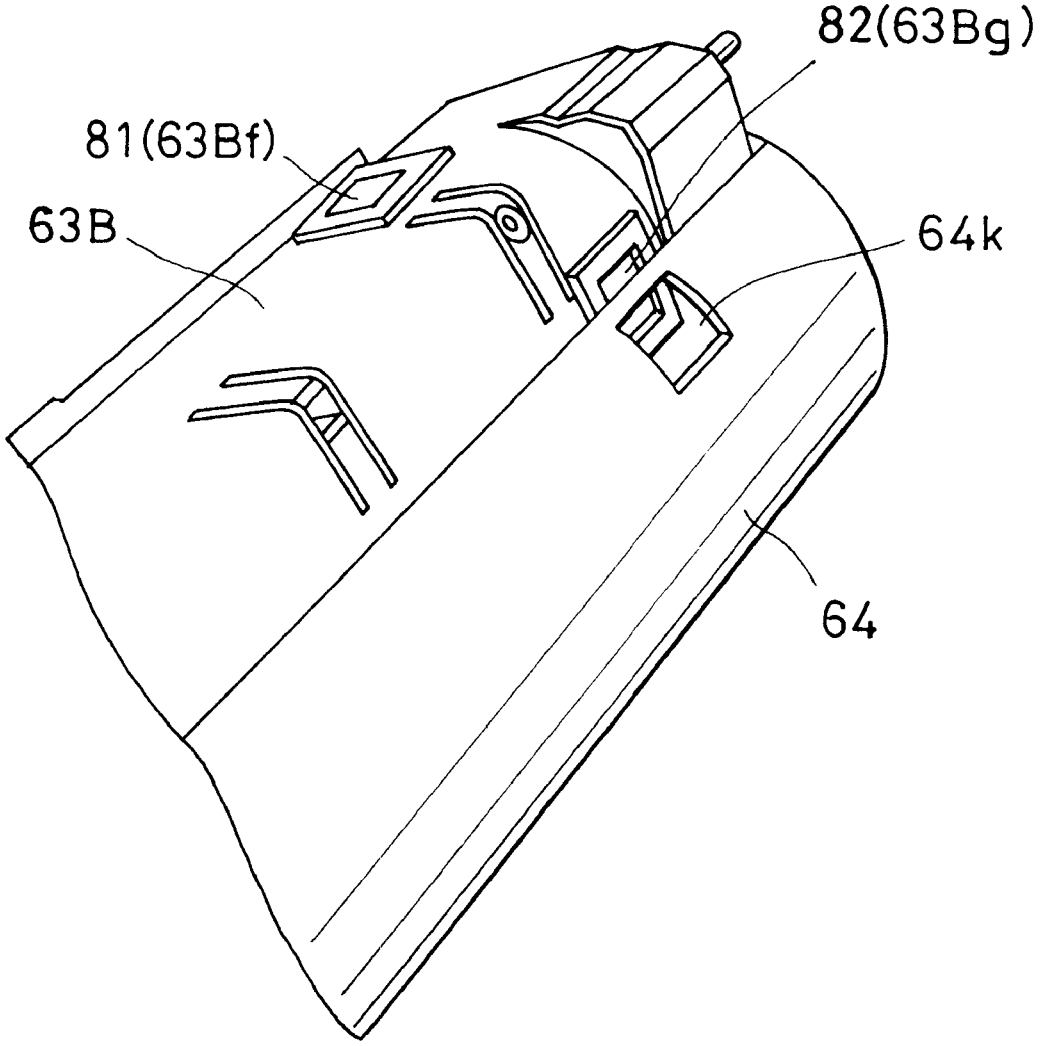
FIG. 32 is a perspective view of the non-drive side of the developing cartridge as seen from a lower angle.
Figure 33:
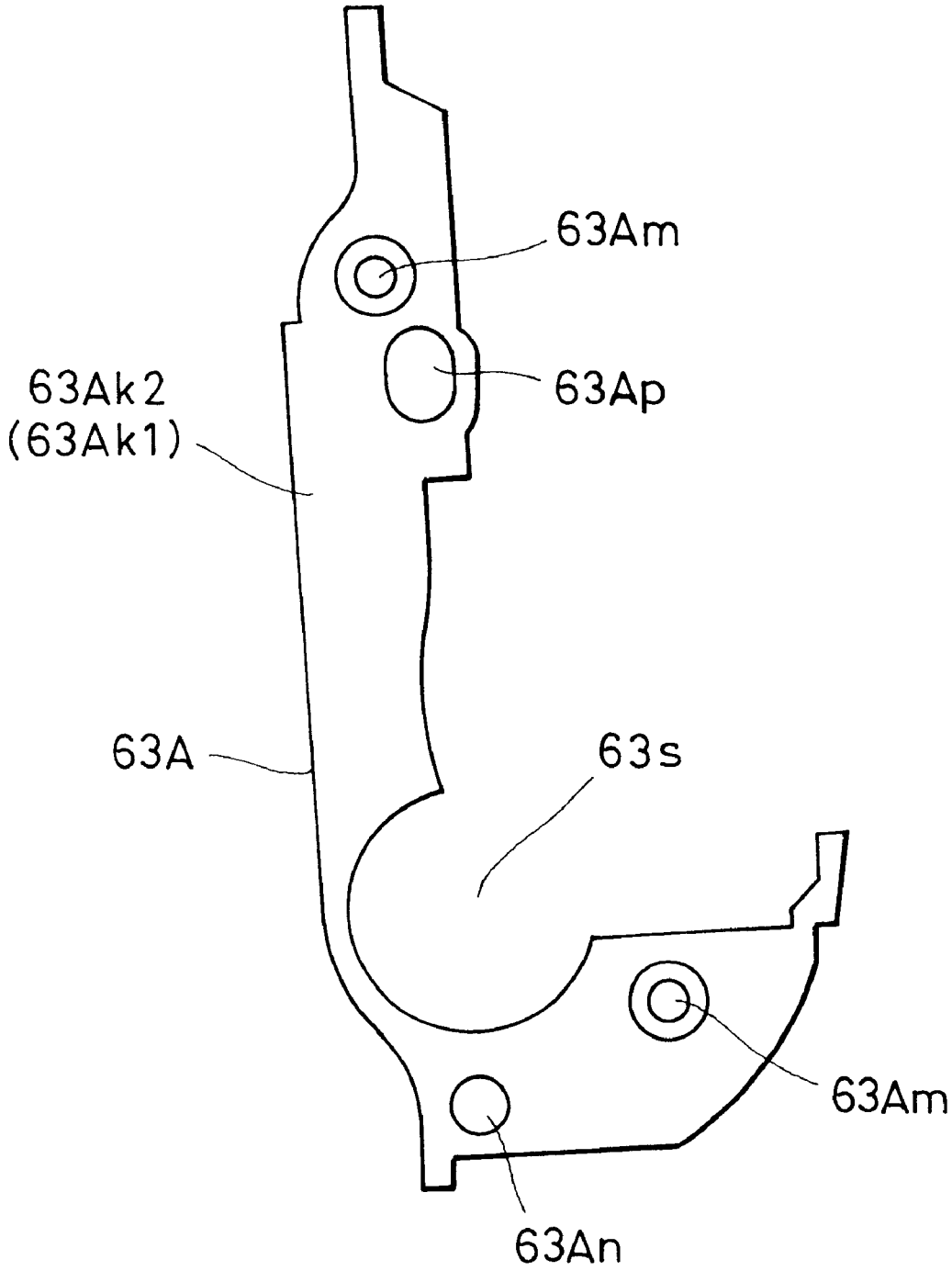
FIG. 33 is a side view showing one longitudinal end of the developing cartridge.

As shown in FIGS. 30 and 31, the journal 33 integrally molded with the agitation gear 23*d* is rotatably supported by a hollow cylindrical bearing section 63Be provided on an end plate 63Bd of one longitudinal end of the toner frame 63B, and a journal 36 is rotatably supported by a bearing section 63Bq located in the center of a cylindrical toner replenish port 63Bp provided on the other end longitudinal end of the toner frame 63B. The bearing section 63Bq is integrally molded with the toner frame 63B connected between the bearing section 63Be and the toner replenish port 63Bp by means of radial arms 63*bs*. The toner feeding member (referred to also as toner agitation member) 15 is supported by the journals 33 and 36. The toner feeding member 15 extends substantially the entire length of the toner frame 63B, and both ends thereof are located outside the development area. A first and second openings 63Bf and 63Bg are provided outside the development area on the side of a toner cap 37 fitted and fixed into the toner replenish port 63Bp, as shown in FIG. 4. Translucent members 81 and 82 made of, for example, synthetic resin, are fitted and fixed into the first and second openings 63Bf and 63Bg, respectively. An incident light from the first opening 63Bf can pass through the second opening 63Bg when a small amount of toner is stored within the toner frame 63B. As shown in FIGS. 4, 5, and 32, an opening 64*k* through which the emergent light from the second opening 63Bg passes is formed in the shutter 64.

The translucent members 81 and 82 have a cylindrical surface 81*a* and a flat surface 82*a*, respectively, on which an elastic blade 15*a* provided on a blade supporting sheet metal 15*b* of the toner feeding member 15 deflects and slides, provided within the toner frame 63B in such a manner as to cut into a movement path of the elastic blade 15*a*. The cylindrical surface 81*a* is a surface about the center of rotation of the toner feeding member 15, and the flat surface 82*a* is a plane that is at right angles to the perpendicular dropped from the center of the cylindrical surface 81*a* on the center of the flat surface 82*a*.

(Cover Frame)

As mentioned above, the flanges 63Aa and 63Ba for combining the developing member-supporting frame 63A and the toner frame 63B are shaped so as to be offset toward the developing roller 12 rather than the toner seal surface 27*a*, a front wall 63Cd of the cover frame 63C can be moved to the developing member-supporting frame 63A, thereby extending a distance between the rear wall 63Ce and the front wall 63Cd. Accordingly, a content volume obtained by combining the toner frame 63B and the cover frame can be increased.

(Coupling Frame)

Figure 34:
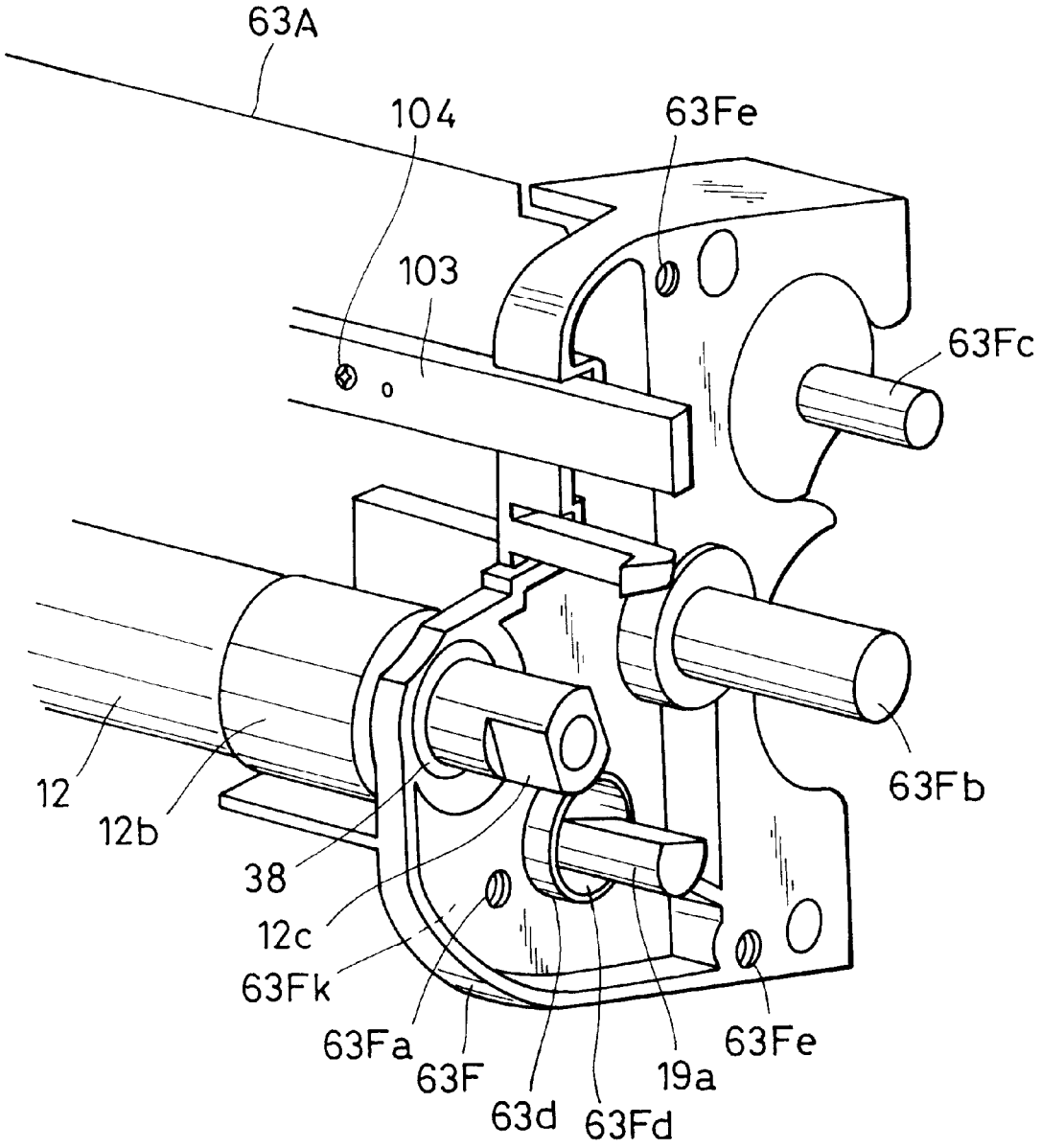
FIG. 34 is a perspective view showing a coupling frame of the developing cartridge.

As shown in FIG. 34, the coupling frame 63F is fixed to the bearing surface 63Ak1 on the driving force receive side of the developing member-supporting frame 63A by screwing a small screw (not shown) into the female screw hole Am through a small screw hole 63Fa. This allows the bearing surface 63Ak1 to abut against a mounting surface 63Fk of the coupling frame 63F. The shape of the mounting surface 63Fk is substantially the same as the bearing surface 63Ak1, and both surfaces coincide with each other. Longitudinal cylindrical dowels (not shown) fitted into the positioning holes 63An and 63Ap of the bearing surface 63Ak1, respectively, are provided on the mounting surface 63Fk.

As shown in FIG. 34, one end of the rotation shaft 12*c* of the developing roller 12 is supported by a developing roller bearing 38 fitted into the coupling frame 63F. A projection shaft 63Fb for supporting the driving force receiver member 22 is integrally formed with the coupling frame 63F. A projection shaft 63Fc is integrally formed with the coupling frame 63F. The idler gear 23*c* having the small gear 23c2 meshing with the gear 23*d* is rotatably supported by the projection shaft 63Fc (see FIGS. 22 and 34). In addition, a hole 63Fd is formed in the coupling frame 63F for inserting therethrough the rotation shaft 19*a* of the application roller 19. Further, a female screw hole 63Fe for mounting the side cover 63D is provided in the coupling frame 63F.

Support of the developing roller on the side opposite to the drive side, and a drawing port of the toner seal 27 will now be described.

(Side Cover on Non-Drive Side)

Figure 35:
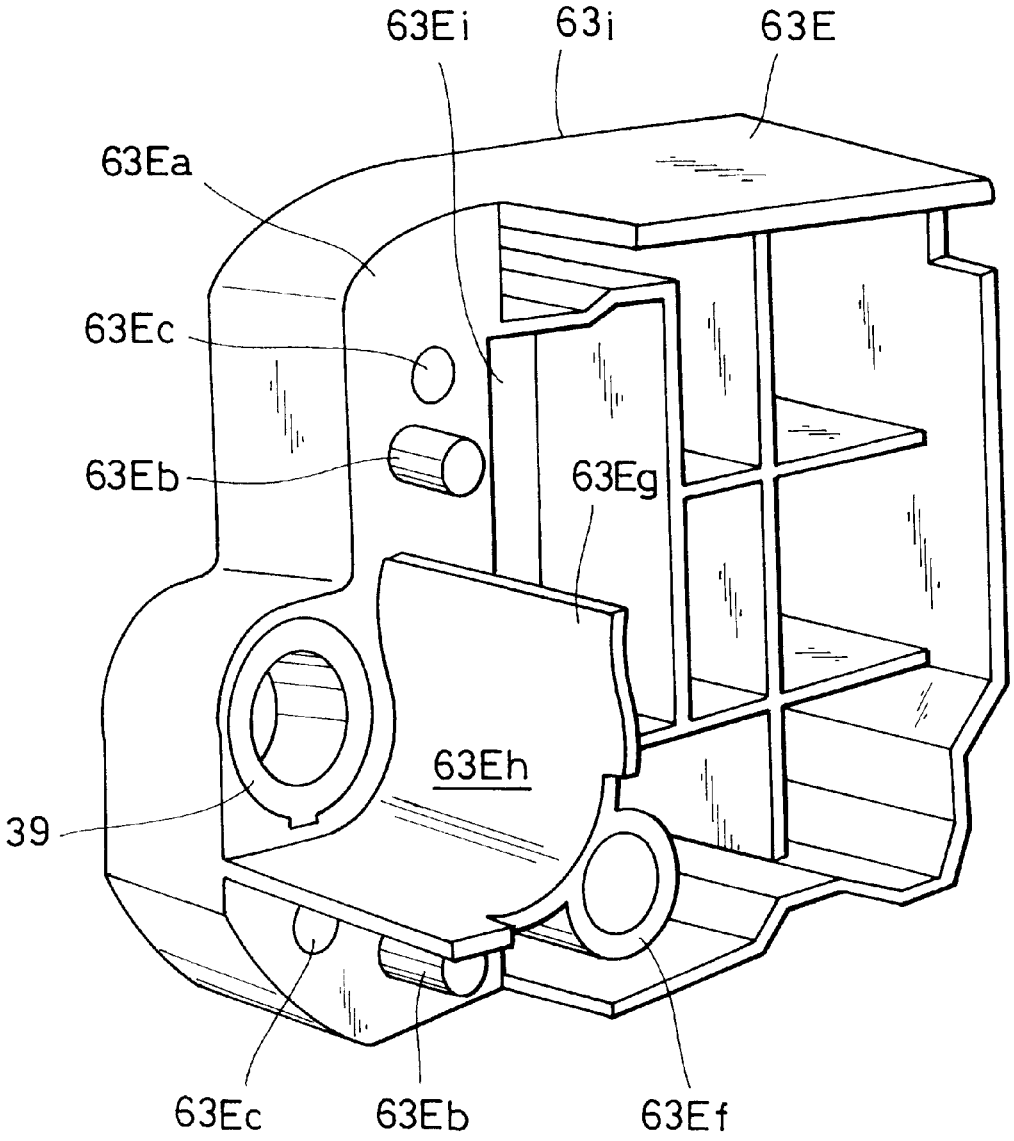
FIG. 35 is a perspective view of a side cover on the non-drive side.

As shown in FIG. 35, the side cover 63E on the non-drive side has a shape to cover the longitudinal end surfaces of the developing member-supporting frame 63A and the toner frame 63B. A mounting surface 63Ea is provided so as to contact the bearing surface 63Ak2, and the mounting surface 63Ea has provided thereon longitudinally cylindrical dowels 63Eb, which are fitted into the positioning holes 63An and 63Ap, respectively. In addition, a small screw hole 63Ec passes longitudinally through the side cover 63E at a position corresponding to the female screw hole 63Am into which a small screw is inserted to be screwed into the female screw hole 63Am from the outside so as to fix the side cover 63E to the developing member-supporting frame 63A. In a state where the side cover 63E is mounted on the developing member-supporting frame 63A, a developing roller bearing 39 for rotatably supporting the rotation shaft 12*c* of the developing roller 12 is longitudinally fitted into a hole of the side cover 63E.

A cylindrical projection 63Ef projects longitudinally from the mounting surface 63Ea so that the head of the projection 63Ef presses the shaft seal packing 35 of the rotation shaft 19*a* of the application roller 19 to the shaft mounting section 63*q* of the rotation shaft 19*a*. In addition, a cover 63Eg is integrally formed for covering the outer periphery of the projection end of the rotation shaft 12*c* of the developing roller 12. The cover 64Eg has an inner surface 63Eh that is the same as the seal surface of the elastic seal member 32 shown in FIG. 29, and is longitudinally connected to the seal surface so as to be flush therewith in a mounted state of the side cover 63E.

A toner seal opening 63Ei passes longitudinally through the side cover 63E through which an end of the toner seal 27 is inserted so as to draw the toner seal 27 out of the developing cartridge D. The toner seal opening 63Ei is of a rectangular shape elongated along the width of the toner seal 27, and a vertical side thereof shown in FIG. 35 is longer than the width of the toner seal grip 73 (see FIG. 9).

FIG. 31 is a horizontal sectional view of the toner frame 63B including a toner supply opening section 63Bc. The toner seal 27 is applied to the entire peripheral edge of the toner supply opening section 63Bc, is turned at a turn section 27*b*, is overlapped with the applied toner seal, and is bonded to the toner seal grip 73 at an end 27*c*. The end 27*c* of the toner seal 27 and the toner seal grip 73 are located within the toner seal opening 63Ei, and extend from the developing cartridge D.

As shown in FIG. 31, the toner seal opening 63Ei has a plane including the portion of the toner seal 27 applied to the edge of the toner seal opening section 63Bc, and a toner seal-leading inclined surface 63Ej intersected by the line perpendicular to the plane of FIG. 3 with respect to the drawing direction of the toner seal 27. The inclined surface 63Ej is a plane, and allows the toner seal 27 to be inclined toward the toner frame 63B rather than the toner seal surface 27*a* with respect to the drawing direction of the toner seal 27. In addition, the toner seal opening 63Ei has a plane 63Ek following the inclined surface 63Ej that is longitudinally in parallel with the applied surface of the toner seal 27. The inner wall of the toner seal opening 63Ei is formed into a square shape by one surface including the inclined surface 63Ej and the plane 63Ek, and other three planes. The inclined surface 63Ej may be a quadric surface whose generating line cuts across the toner seal 27.

When the toner seal grip 73 is pulled outward, the toner seal 27 is drawn out via the toner seal opening 63Ei from an end fixed by the toner seal grip 73, the turn section 27*b* moves leftward in FIG. 31, and the toner seal 27 is stripped from the edge of the toner supply opening section 63Bc. By drawing out the entire toner seal 27, the toner supply opening section 63Bc is fully open. This enables the toner in the toner frame 63B to be supplied to a development chamber 63At of the developing member-supporting frame 63A. When the toner seal 27 is drawn out, the toner seal 27 is stretched between a corner 63Bm sealed by the end seal 31*a* of the toner frame 63B and a corner 63Em formed by the inclined surface 63Ej and the mounting surface 63Ek, so that the toner seal 27 turned at the front face of the toner seal opening section 63Bc is pulled along the toner seal surface on the edge of the toner supply opening section 63Bc, and then is sequentially stripped from the turn section 27*b*. The toner seal is stripped in a fixed direction from the turn section 27*b* until it passes through the end seal 31*a*. The toner seal opening 63Ei of the side cover 63E allows the user to control the direction to pull the toner seal 27, thereby preventing tear of the end seal 31*a* and toner leakage when the toner seal 27 is pulled in improper directions.

By integrally forming a shaft supporting member for fitting therein the bearing 39 of the developing roller 12 with the side cover 63, the number of components can be reduced.

(Configuration of Developing Blade of Developing Cartridge)

Configurations of the developing blades (control members) of the yellow, cyan, and magenta developing cartridges except the black developing cartridge will now be described with reference to FIG. 36.

The developing blade 16 consists of the blade-supporting sheet metal 16*a* and the elastic blade 16*c*, as briefly described above. For a detailed description hereinbelow, the blade-supporting sheet metal 16*a* consists of a support plate 101 and a presser plate 103, and the reference numeral 16*c* of the elastic blade is replaced with 102.

The developing blade 16 has a three-layer construction of the support plate (abutting member) 101, the elastic blade (elastic member) 102, and a presser plate (overlap member)

Figure 36:
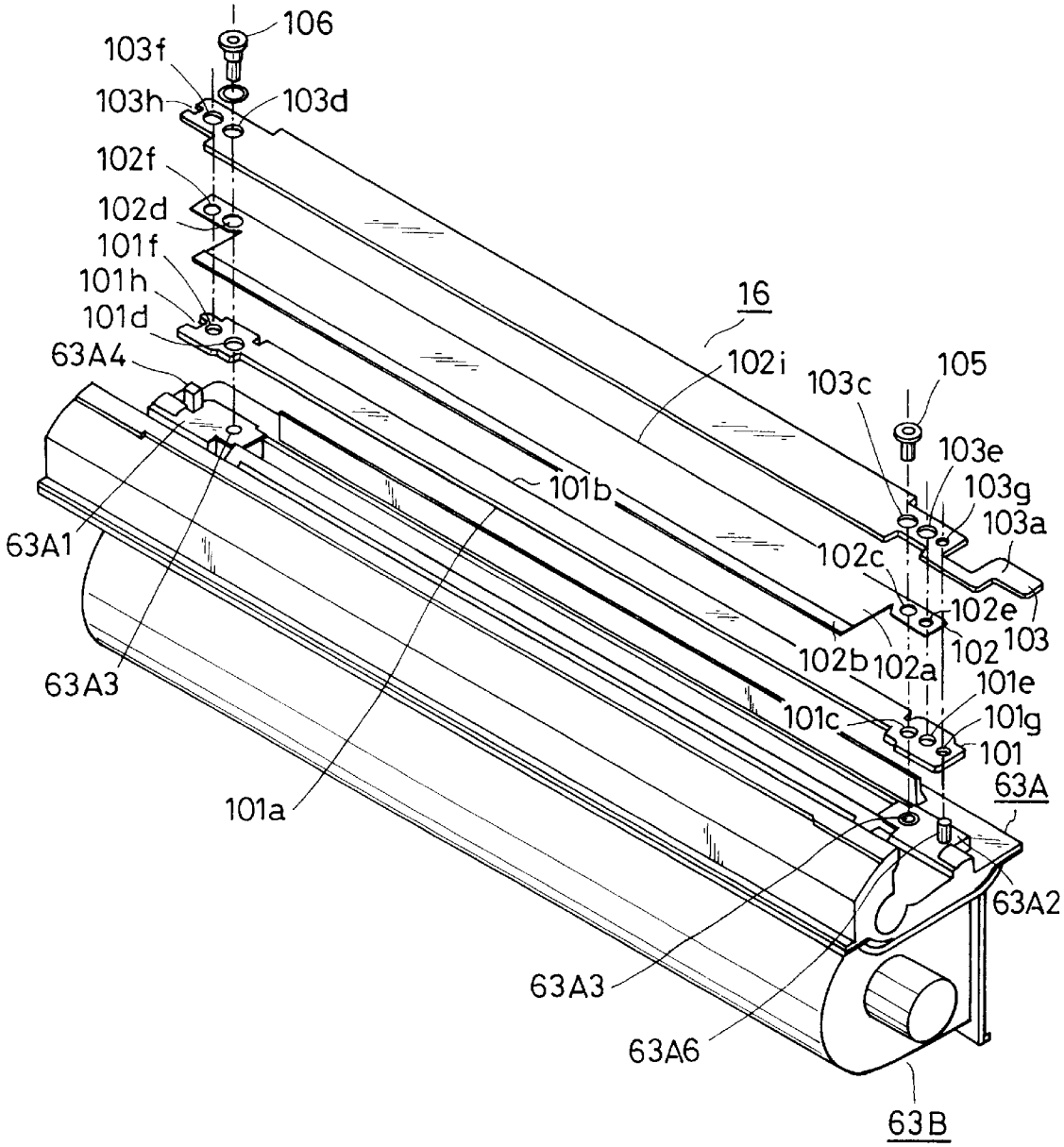
FIG. 36 is an exploded perspective view showing a structure of a developing blade.

103 in that order near the developing member-supporting frame 63A, as shown in FIG. 36.

Positioning bearing surfaces 63A1 and 63A2 are provided on both longitudinal ends of the developing member-supporting frame 63A for mounting thereon the developing blade 16. Female screw holes 63A3 are formed in the bearing surfaces 63A1 and 63A2, respectively, for fixing the developing blade 16 to the developing member-supporting frame 63A. A square dowel 63A4 stands upright on the bearing surface 63A1 at the longitudinal outside of the female screw 63A3. A round dowel 63A6 stands upright on the bearing surface 63A2 at the longitudinal outside of the female screw hole 63A3.

Holes 101*c*, 102*c*, and 103*c* for loosely fitting therein and inserting therethrough a small screw 105 are formed in one ends of the support plate 101, the elastic blade 102, and the presser plate 103, respectively, so as to coincide with the female screw hole 63A3 of the bearing surface 63A2, and holes 101*d*, 102*d*, and 103*d* for a small screw 106 are formed in the other ends, respectively, so as to coincide with the female screw hole 63A3 of the bearing surface 63A1.

In both ends of the support plate 101, the elastic blade 102, and the presser plate 103 at the same positions of the longitudinal outside of the holes 101*c*, 102*c*, 103*c*, and 101*d*, 102*d*, 103*d*, round holes 102*e* and 102*f* into which the round dowels 101*e* and 101*f* are fitted, respectively, are formed in the support plate 101 and the elastic blade 102, and round holes 103*e* and 103*f* into which the round dowels 101*e* and 101*f* are fitted, respectively, are formed in the presser plate 103.

Holes 101*g* and 103*g* into which the round dowels 63A6 provided on the bearing surface 63A2 are fitted are formed in the other end of the support plate 101 and the presser plate 103, respectively. The hole 101*g* of the support plate 101 is a slot that is perpendicular to the longitudinal direction and is elongated in the lateral direction, and the hole 103*g* is a round hole into which the round dowel 63A6 is just fitted. In addition, square notches 101*h* and 103*h* into which the square dowel 63A4 provided on the bearing surface 63A1 is fitted are provided in one end of each of the support plate 101 and the presser plate 103, respectively. The lateral width of the notch 101*h* of the support plate 101 is wider than that of the square dowel 63A4, and the notch 103*h* of the presser plate 103 has the width into which the square dowel 63A4 is just fitted.

The developing blade 16 is mounted to the developing member-supporting frame 63A in the following manner.

(1) The support plate 101 is placed on the bearing surfaces 63A1 and 63A2 of the developing member-supporting frame 63A.

(2) The elastic blade 102 is placed on the support plate 101 with reference to the round dowels 101*e* and 101*f* of the support plate 101 (the round holes 102*c* and 102*d* of the elastic blade 102 correspond to the round dowels 101*e* and 101*f* of the support plate 101).

(3) The presser plate 103 is placed on the elastic blade 102 with reference to the round dowel 63A6 and the square dowel 63A4 of the developing member-supporting frame 63A.

(4) The support plate 101, the elastic blade 102, and the presser plate 103 are fastened by the small screws 105 and 106.

Then, the round dowel 63A6 is fitted into the hole 101*g* of the support plate 101 and the hole 103*g* of the presser plate 103 so as to bring the both ends of the support plate 101 into abutment with the bearing surfaces 63A1 and 63A2, respectively. The lateral position of one end of the developing blade 16 and the longitudinal position of the developing blade 16 are determined by the round dowel 63A6 being fitted into the hole 103*g* of the presser plate 103. The lateral position of the other end of the developing blade 16 is determined by the square dowel 63A4 being fitted into the notch 103*h* of the presser plate 103.

The position of the developing blade can be adjusted. The adjustment is made by moving the support plate 101 laterally (and the developing blade 102 positioned by the round dowels 101*e* and 101*f*) with the small screws 105 and 106 loose.

The support plate 101 and the presser plate 103 are made from sheet metal materials each having a thickness of about 1 to 2 mm. Since rust or the like formed on these sheet metal materials causes a malfunction of development, stainless steel materials are employed for these sheet metal materials or these sheet metals are plated with nickel, etc. The elastic blade (elastic member) 102 includes a metallic plate member, and a resin member provided on an end of the plate member. More specifically, resin as a developing roller-abutting section 102*b* having a thickness of about 1 mm and a width of about 5 mm is integrally molded with an end of a springy thin sheet metal 102*a* (such as phosphor bronze) having a thickness of about 0.2 mm by an outsert molding, etc. The developing roller-abutting section 102*b* is urged by a resilient force generated from the springy thin sheet metal 102*a* toward the developing roller 12 so as to abut against the developing roller 12 with a certain abutting force. Since the amount of charging of the toner is changed by the abutting force, the abutting force is always kept constant by a method described below.

(Means for Equalizing Abutting Pressure of Developing Blade)

Figure 37:
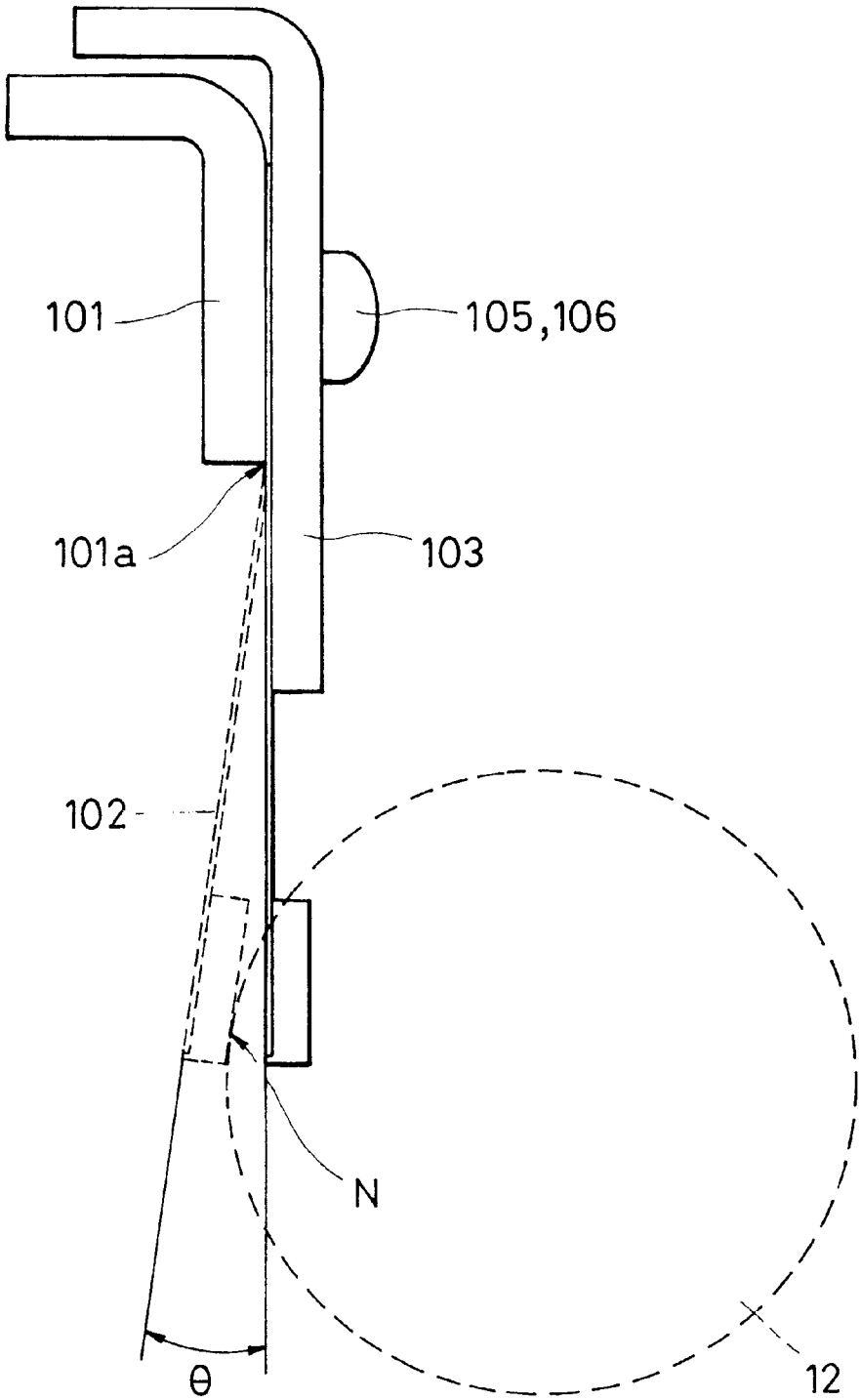
FIG. 37 is a vertical section showing a structure of a developing blade.

As shown in FIGS. 36 and 37, the support plate 101 is arranged on the bearing surfaces 63A1 and 63A2 of the developing member-supporting frame 63A so as to form a bearing surface for supporting the elastic blade 102.

The elastic blade 102 is arranged on the support plate 101, and the presser plate 103 is arranged thereon. The presser plate 103 and the developing member-supporting frame 63A are fastened by the small screws 105 and 106, whereby the support plate 11, the elastic blade 102, and the presser plate 103 are fixed to the developing member-supporting frame 63A.

The press-contacting force of the elastic blade 102 and the developing roller 12 is defined by a distance between a point at which the elastic blade 102 is supported, i.e., a support plate end surface 101*a*, and a point N at which the elastic blade 102 abuts against the developing roller 12, and a deflection angle θ of the elastic blade 102.

Figure 38:
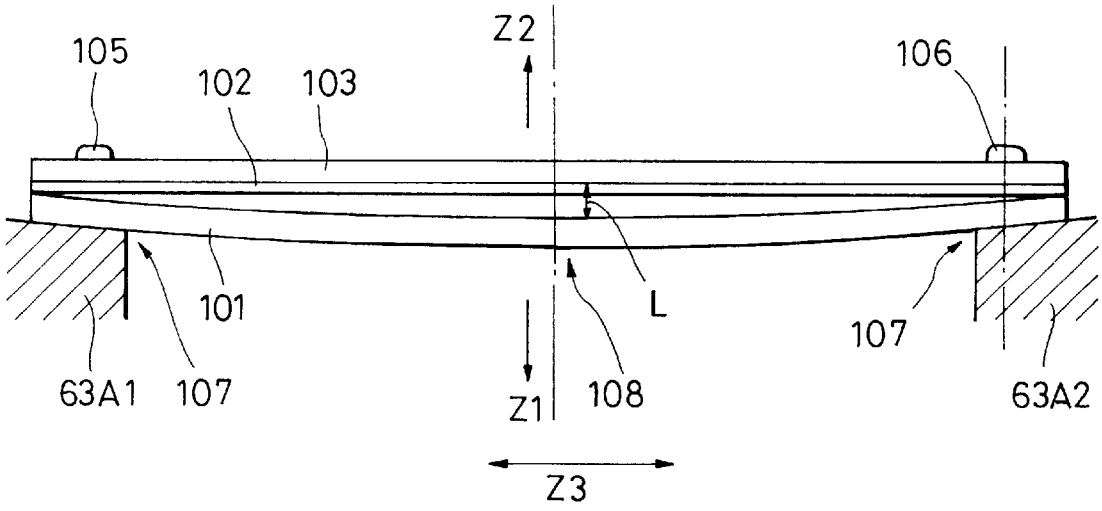
FIG. 38 is a transverse cross section showing a structure of the developing blade.

As shown in FIG. 38, however, if the support plate 101 warps longitudinally in the direction Z1 or if the presser plate 103 warps longitudinally in the direction Z2, the support plate 101, the elastic blade 102, and the presser plate 103 are adhered closely to one another at both ends 107 of the developing member-supporting frame 63A near the fastened points, whereas a clearance L is generated between the support plate 101 and the presser plate 103 at a center portion 108 of the developing member-supporting frame 63A far from the fastened points.

Figure 39:
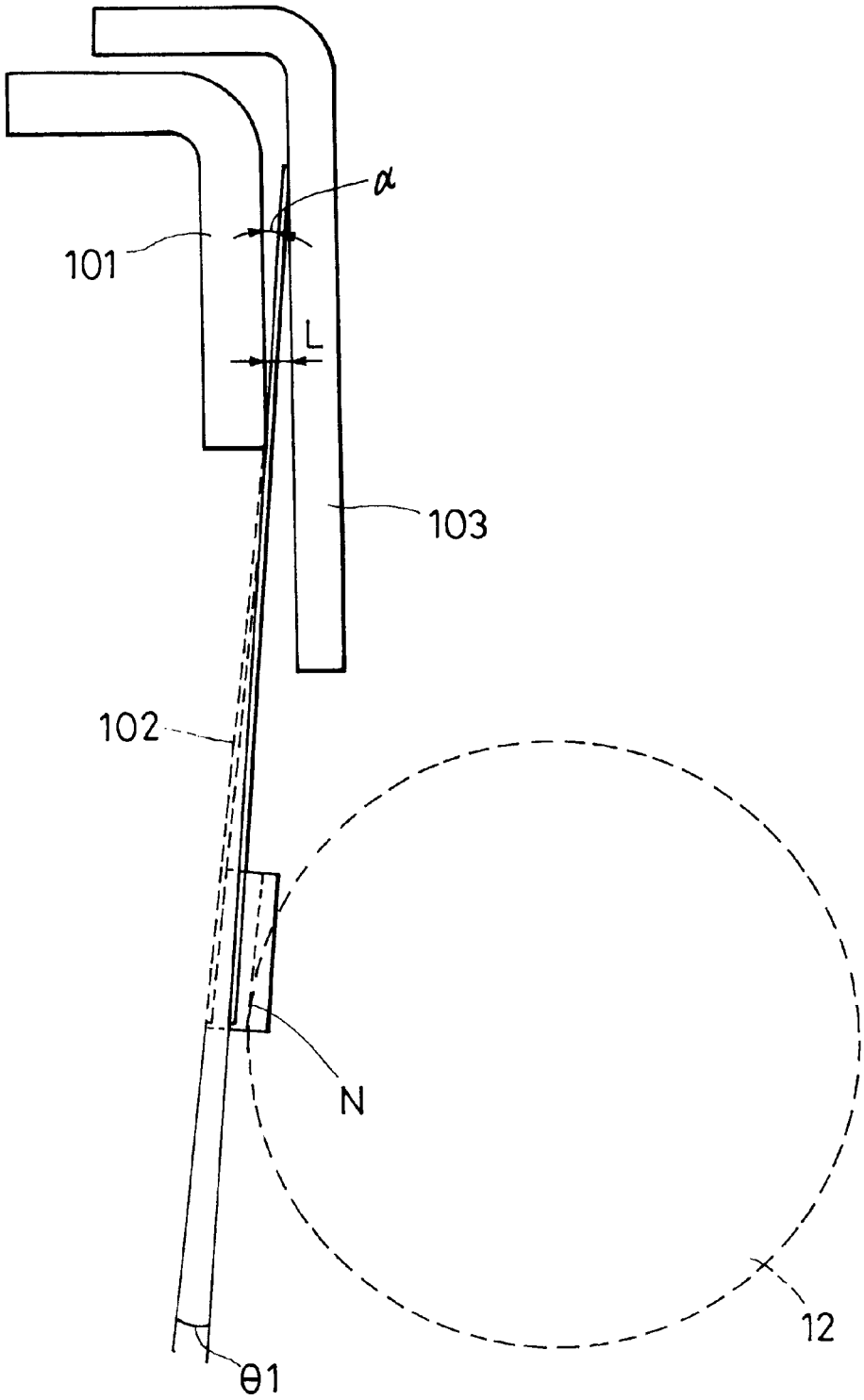
FIG. 39 is a vertical section showing a structure of the developing blade.

Therefore, as shown in FIG. 39, the elastic blade 102 is inclined at an angle a to the support plate 101 at the center portion 108, and hence the deflection angle θ of the elastic blade 102 decreases to θ1, resulting in a decreased abutting pressure of the developing blade 16.

Figure 40:
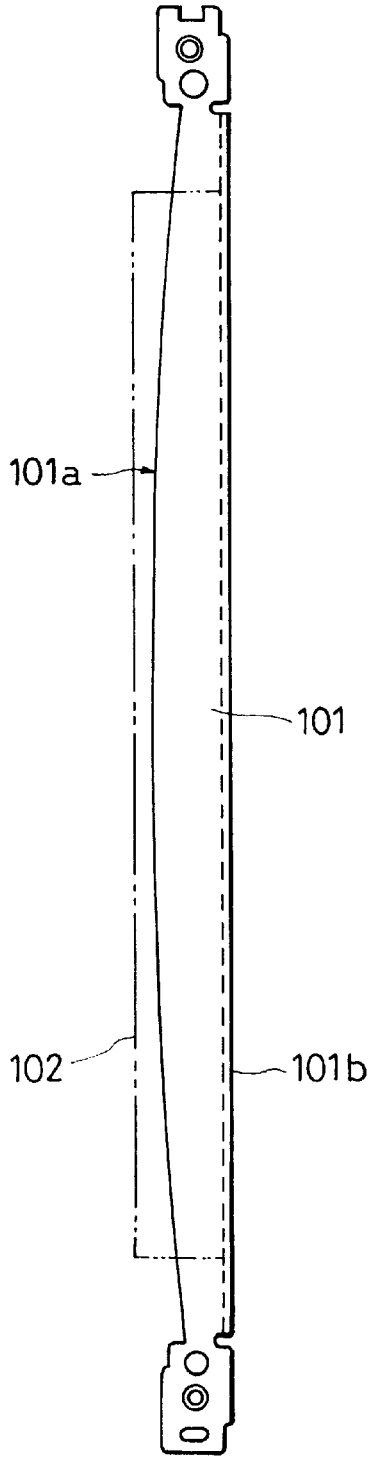
FIG. 40 is a plan view showing a support plate.

In this embodiment, as shown in FIG. 40, the end surface 101*a* of the support plate is of a circular shape such that the longitudinal center portion thereof projects more than the both ends thereof. In addition, a rear edge 101*b* is in parallel with the developing roller 12. This shape allows the width in the center portion of overlapped portions of the support plate 101 and the elastic blade 102 to be wider than that in both ends thereof. The distance between the end surface 101*a* and the point N becomes gradually short toward the longitudinal center of the developing member-supporting frame 63A. In addition, the inclination angle a of the elastic blade 102 to the support plate 101 is reduced.

Consequently, even if the support plate 101 or the presser plate 103 warps as described above to generate the clearance L between the support plate 101 and the presser plate 103, it is possible to prevent a reduction in the press-contacting force of the developing blade 16 by correcting the position of the end surface 101*a* and the deflection angle θ of the elastic blade 102 in the longitudinal direction.

Second Embodiment

The configuration of the developing blade 16 is the same as that of the first embodiment.

Figure 41:
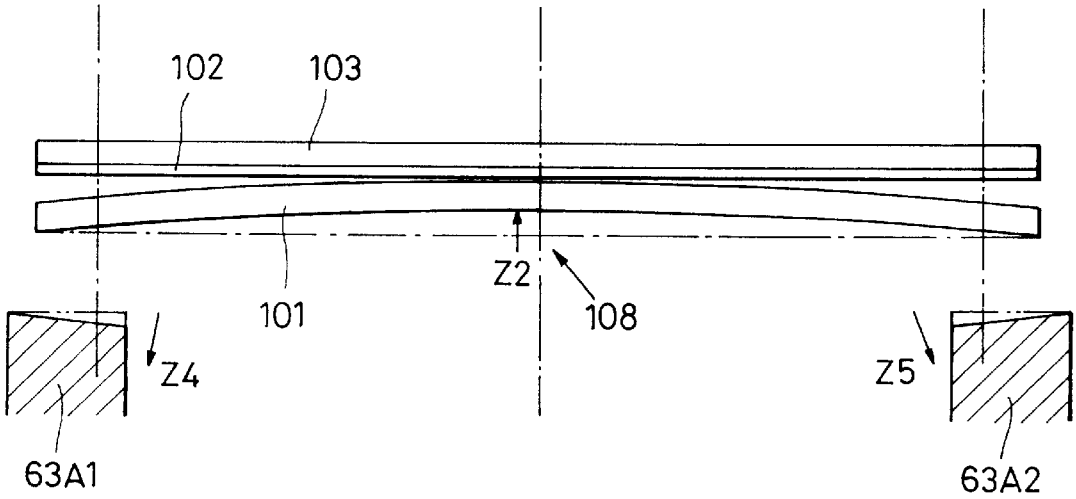
FIG. 41 is a transverse cross section showing a structure of the developing blade.

In the case where the bearing surfaces 63A1 and 63A2 of the developing member-supporting frame 63A are inclined inward in the directions Z4 and Z5, as shown in FIG. 41, the support plate 101 warps in the direction Z1 shown in FIG. 38 under the influence of the bearing surfaces 63A1 and 63A2. Therefore, the clearance L is generated at the center portion 108, and the deflection angle θ of the elastic blade 12 decreases to θ1, as shown in FIG. 39, resulting in a decreased press-contacting force of the developing blade 16.

In this embodiment, the support plate 101 is warped in the direction Z in advance toward the center portion 108, as shown in FIG. 41. This allows the inclination of the bearing surfaces 63A1 and 63A2 in the directions Z4 and Z5, respectively, to be absorbed by the warp of the support plate 101 in the direction Z2, and can prevent the generation of the clearance L also at the center portion of the developing member-supporting frame 63A. Therefore, the deflection angle θ shown in FIG. 39 does not decrease, and a stable abutting pressure of the developing blade 16 can be always provided.

Third Embodiment

The present invention is applicable to a process cartridge. The process cartridge is a cartridge including a charging means or a cleaning means, a developing means, and an electrophotographic photosensitive member integrally formed in a cartridge, and the cartridge can be attached to and detached from an image forming apparatus main body. In addition, the process cartridge is a cartridge including at least one of the charging means and the cleaning means, the developing means, and the electrophotographic photosensitive member integrally formed in a cartridge so as to be attached to and detached from the image forming apparatus main body. Further, the process cartridge is a cartridge including the developing means and the electrophotographic photosensitive member integrally formed in a cartridge so as to be attached to and detached from the apparatus main body.

Figure 42:
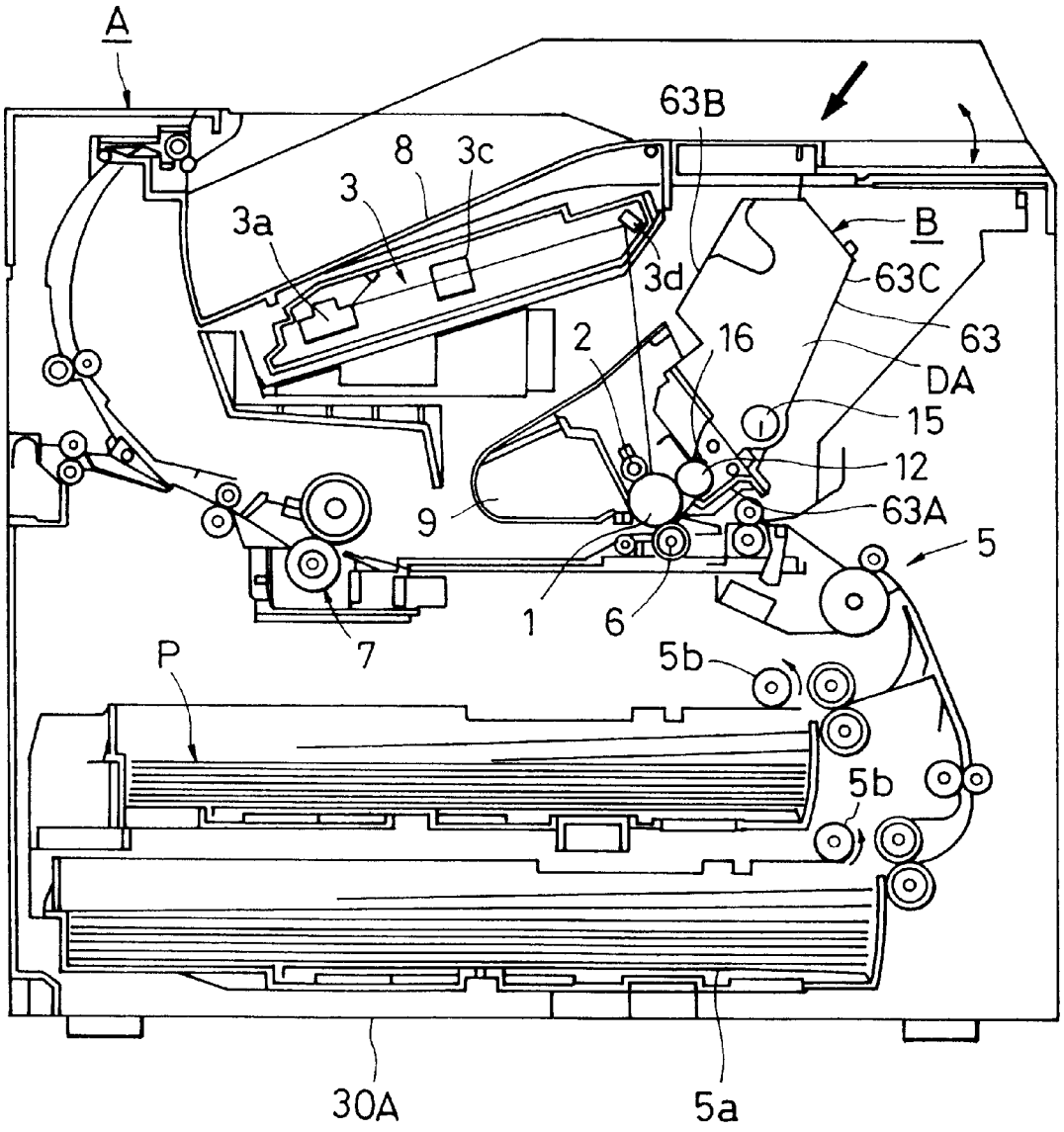
FIG. 42 is a vertical section of an electrophotographic image forming apparatus having a process cartridge attached thereto.

FIG. 42 shows an image forming apparatus (laser beam printer) A having attached thereto a process cartridge B.

The process cartridge B includes a charging unit 2, a developing unit DA including a developing roller 12, and a cleaning unit 9 provided around a photoconductive drum 1, and is integrally formed in a cartridge by a cartridge frame so as to be detachably attached to an image forming apparatus main body 30A. A toner image formed by an image forming section formed in the process cartridge is transferred by a transfer means (transfer roller) 6 to a recording medium P conveyed by a pickup roller 5*b* from a paper feeding cassette 5, is fixed by a fixing means 7 and then is discharged to a discharge section 8.

When a laser beam modulated in response to a time sequence electric image signal of a target image is output from a semiconductor laser to a polygon mirror 3*a*, an exposure means 3 forms a latent image responsive to the target image on the photoconductive drum 1, which is uniformly charged by the charging means 2 in advance and is rotating clockwise, via a lens 3*c* and a reflecting mirror 3*d*. The latent image is applied to the toner from the developing unit DA, and moves to an opposite section of the transfer roller 6.

The developing unit DA has a configuration similar to that of the above-mentioned black developing cartridge Db, and a developing blade 16 is pressed into contact with a generating line of the developing roller 12. The developing blade described in the first and second embodiments may be employed as the developing blade 16.

As described above, there is provided a developing device or a developing means, which is a component of a process cartridge, including a developing roller 12 for developing a latent image formed on a photoconductive drum; a developing blade 16 for controlling the thickness of toner coated on the developing roller 12: and a cartridge frame 63 for supporting the developing roller 12 and the developing blade 16, wherein the developing blade 16 has a developing blade support plate 101 abutting against the cartridge frame 63; an elastic blade 102 overlapped the developing blade support plate 101 and elastically coming into contact with the developing roller 12; a presser plate 103 for clamping the elastic blade 102 between the developing blade support plate 101 and the presser plate 103; and small screws 105 and 106 for fastening the developing blade to the cartridge frame 63, and wherein the width in the center portion of overlapped portions of the developing blade support plate 101 and the elastic blade 102 is wider than that in both ends thereof.

In the developing device, a widthwise one end surface of the developing blade support plate 101 near the developing roller 12 is formed by a smooth curve.

In the developing device, a longitudinal center portion of a front edge of the developing blade support plate 101 is formed as a projection so as to be closer to the developing roller 12 than the both ends thereof.

In the developing device, the rear edge of the developing blade support plate 101, which does not come into contact with the elastic blade 102 and the developing roller 12, is in parallel with the developing roller 12.

In the developing device, the width of projection of a portion of the elastic blade 16, which does not come into contact with the developing blade support plate 101, is smaller than that in both ends thereof.

In addition, there is provided a developing device including a developing roller 12 for developing a latent image formed on a photoconductive drum; a developing blade 16 for controlling the thickness of toner coated on the developing roller 12; and a cartridge frame 63 for supporting the developing roller 12 and the developing blade 16, wherein the developing blade 16 has a developing blade support plate 101 abutting against the cartridge frame 63; an elastic blade 102 overlapped the developing blade support plate 101 and elastically coming into contact with the developing roller 12; a presser plate 103 for clamping the elastic blade 102 between the developing blade support plate 101 and the presser plate 103; and small screws 105 and 106 for fastening the developing blade 16 to the cartridge frame 63, and wherein the surface of the developing blade support plate 101 on the side of contacting the elastic blade 102 is curved so that the longitudinal center portion thereof comes into contact with the elastic blade 102 earlier than both ends thereof.

As described above, according to the present invention, it is possible to reliably obtain an abutting pressure of the developing blade against the developing roller. As a result, it is possible to prevent toner leakage and formation of faulty image due to a deficiency of the abutting pressure. In addition, since the abutting pressure to the developing roller can be reliably obtained even if the support plate and the presser plate warp in the longitudinal direction, machining tolerances of the support plate and the presser plate can be alleviated, and the cost of components can be reduced.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device including a developing-member supporting frame comprising:

a developer carrier for carrying a developer; and a control member for controlling a thickness of the developer on said developer carrier, said control member comprising:

an abutting member abutting against a reference plane of a main body of the developing device, said abutting member being supported at opposing ends of a supporting frame;

an elastic member overlapping said abutting member, wherein said elastic member is inclined at an angle relative to said abutting member at a center portion of the supporting frame with an inclination against said abutting member in the center portion, said elastic member being urged toward said developer carrier, a width in a center portion of overlapped sections of said elastic member and said abutting member being wider than a width at both ends of the overlapped sections; and an overlap member overlapping said elastic member.

2. A developing device according to claim 1, wherein said abutting member abuts against the reference plane at both ends thereof.

3. A developing device according to claim 1, wherein a width of a longitudinal center portion of said abutting member is wider than the width of both ends thereof.

4. A developing device according to claim 1, wherein an end surface of said abutting member on a side of said developer carrier along a width thereof is formed as a projection such that a center portion of the abutting member is closer to said developer carrier than both ends thereof.

5. A developing device according to claim 2, wherein said abutting member is mounted on a reference plane of a developing frame at both ends thereof.

6. A developing device according to claim 1, wherein an amount of a projection of said elastic member in the center portion thereof from said abutting member to said developer carrier is smaller than the projection in both ends thereof.

7. A developing device according to claim 1, wherein said elastic member comprises a metallic plate member, and a resin member provided on an end of said plate member.

8. A developing device according to claim 1, wherein said abutting member comprises a projection projecting toward said elastic member.

9. A developing device according to claim 1, wherein said developing device attaches to and detaches from a main body of an image forming apparatus.

10. A process cartridge for use in a developing device including a developing-member supporting frame comprising:

an image carrier;

a developer carrier for carrying a developer; and a control member for controlling a thickness of the developer on said developer carrier, said control member including:

an abutting member abutting against a reference plane of a main body of the developing device, said abutting member being supported at opposing ends of a supporting frame;

an elastic member overlapping said abutting member, wherein said elastic member is inclined at an angle relative to said abutting member at a center portion of the supporting frame with an inclination against said abutting member in the center portion, said elastic member being urged toward said developer carrier, a width in the center portion of overlapped sections of said elastic member and said abutting member being wider than a width in both ends thereof; and an overlap member overlapping said elastic member.

11. In a developing device having a main body and a developer carrier, a method of forming a control member that controls a thickness of a developer on the developer carrier comprising the steps of:

abutting an abutting member against a reference plane of a main body of the developing device, said abutting member being supported at opposing ends of a supporting frame;

positioning an elastic member on said first member in an overlapping relationship, wherein said elastic member is inclined at an angle relative to said abutting member at a center portion of the supporting frame with a inclination against said abutting member in the center portion so that said elastic member is urged toward the developer carrier and a center portion of overlapped sections of said elastic member and said abutting member is wider than end portions of the overlapped sections; and setting an overlap member on said elastic member in an overlapping relationship with said elastic member.

12. A developing device comprising:

a developer carrier for carrying a developer; and a control member for controlling a thickness of the developer on said developer carrier, said control member including:

an abutting member abutting against a reference plans of a main body of the developing device, said abutting member being supported at opposing ends of a supporting frame;

an elastic member overlapping said abutting member of the supporting frame relative to said abutting member at a center portion of the supporting member with an inclination against said abutting member in a center portion, said elastic member being urged toward said developer carrier, a width in a center portion of overlapped sections of said elastic member and said abutting member being wider than a width at both ends of the overlapped sections; and an overlap member overlapping said elastic member, wherein an abutting pressure between said elastic member and said developer carrier is substantially maintained at a predetermined level regardless of deflection of said abutting member or said overlap member.

13. A developing device comprising:

a developer carrier for carrying a developer;

a regulating member for regulating an amount of the developer on said developer carrier;

first supporting member supporting a developer-carrier side of said regulating member; and a second supporting member supporting an opposite side of the developer-carrier side of said regulating member, wherein a supporting width of said second supporting member is wider in a center portion than in an end portion in a longitudinal direction of said regulating member and wherein a supporting width of said first supporting member for said regulating member is wider than supporting width of said second supporting member.

14. A developing device according to claim 13, wherein said regulating member is an elastic member.

15. A developing device according to claim 13, wherein an end of a free-end side of said second supporting member is convex.

16. A developing device according to claim 13, wherein said first and second supporting members sandwich said regulating member.

17. A developing device according to claim 16, wherein said regulating member comprises a metal plate, and wherein said first and second supporting members sandwich said metal plate.

18. A developing device according to claim 13, wherein said first and second supporting members are fixed outside a supporting portion of said regulating member in the longitudinal direction of said regulating member.

* * * * *

UNITED STATES PATENT AND TRADEMARK OFFICE

CERTIFICATE OF CORRECTION

PATENT NO. : 6,438,347 B2
DATED : August 20, 2002
INVENTOR(S) : Susumu Nittani et al.

It is certified that error appears in the above-identified patent and that said Letters Patent is hereby corrected as shown below:

Title page,
Item [56], FOREIGN PATENT DOCUMENTS,
"8-114078 7/1983" should read -- 58-114078 7/1983 --.

Column 1,
Line 58, "above described" should read -- above-described --.

Column 25,
Line 16, "ends" should read -- end --.

Column 28,
Line 25, "12:" should read -- 12; --.

Column 29,
Line 30, "comprising:" should read -- including: --; and
Line 66, "member," should read -- member --.

Column 30,
Line 43, "a" (second occurrence) should read -- an --; and
Line 58, "plans" should read -- plane --.

Signed and Sealed this

Fourth Day of February, 2003

JAMES E. ROGAN
*Director of the United States Patent and Trademark Office*